US008323157B2

(12) United States Patent
Campanaro et al.

(10) Patent No.: US 8,323,157 B2
(45) **Date of Patent: *Dec. 4, 2012**

(54) METHOD OF USING AN EXERCISE DEVICE HAVING AN ADJUSTABLE INCLINE

(75) Inventors: Thomas J. Campanaro, Rancho Santa Fe, CA (US); Joy L. Campanaro, Rancho Santa Fe, CA (US); Dan McCutcheon, San Diego, CA (US); Douglas Dale McMurray, San Diego, CA (US)

(73) Assignee: Total Gym Global Corp., San Diego, CA (US)

( * ) Notice: Subject to any disclaimer, the term of this patent is extended or adjusted under 35 U.S.C. 154(b) by 131 days.

This patent is subject to a terminal disclaimer.

(21) Appl. No.: 12/841,894

(22) Filed: Jul. 22, 2010

(65) Prior Publication Data

US 2011/0009249 A1 Jan. 13, 2011

Related U.S. Application Data

(63) Continuation of application No. 12/405,489, filed on Mar. 17, 2009, now Pat. No. 7,766,801, which is a continuation of application No. 11/688,539, filed on Mar. 20, 2007, now Pat. No. 7,503,880, which is a continuation-in-part of application No. 10/785,541, filed on Feb. 24, 2004, now Pat. No. 7,270,628.

(60) Provisional application No. 60/806,146, filed on Jun. 29, 2006.

(51) Int. Cl.
*A63B 21/068* (2006.01)

(52) U.S. Cl. ..... 482/96; 482/132; 482/135; 482/142

(58) Field of Classification Search ..... 482/95, 482/96, 132, 135, 142, 145, 908
See application file for complete search history.

(56) References Cited

U.S. PATENT DOCUMENTS

| | | | |
|---|---|---|---|
| 2,733,922 | A | 2/1956 | Diego |
| 3,512,314 | A | 5/1970 | Warren et al. |
| 3,711,812 | A | 1/1973 | Cherry |
| 3,870,297 | A | 3/1975 | Elder |
| 3,892,404 | A | 7/1975 | Martucci |

(Continued)

OTHER PUBLICATIONS

Total Gym 1000 exercise system Exercise Booklet, Fitness Quest Inc., Rev. Apr. 11, 2003.*

*Primary Examiner* — Stephen Crow
*Assistant Examiner* — Victor K Hwang
(74) *Attorney, Agent, or Firm* — Stephen C. Beuerle; Procopio Cory Hargreaves & Savitch LLP

(57) ABSTRACT

A method of using an adjustably inclinable exercise device using guidelines from a selected strength table, hypertrophy table, power table, or endurance table. The exercise device includes a vertical support member, an adjustable incline having a first end and a second end and adjustably supported by the vertical support member for adjusting the incline of the adjustable incline, and a user support platform for engagement by a user movably attached to the adjustable incline and configured for movement along the incline. A user selects parameters including a loading parameter from the selected table, adjusts the incline to an inclination corresponding to the selected loading parameter, and mounts the support platform and engages the exercise device for performance of exercise training according to the selected parameters.

15 Claims, 30 Drawing Sheets

U.S. PATENT DOCUMENTS 4,004,801 A 1/1977 Campanaro et al.
4,101,124 A * 7/1978 Mahnke ..... 482/96
4,383,684 A 5/1983 Schliep
4,672,697 A 6/1987 Schurch
4,700,946 A * 10/1987 Breunig ..... 482/57
4,863,161 A 9/1989 Telle
4,883,249 A 11/1989 Garland
4,911,438 A 3/1990 Van Straaten
5,066,005 A 11/1991 Luecke
5,141,480 A 8/1992 Lennox et al.
5,169,363 A 12/1992 Campanaro et al.
5,201,694 A 4/1993 Zappel
5,308,296 A 5/1994 Eckstein
5,620,403 A 4/1997 Lundin
5,645,509 A 7/1997 Brewer et al.
5,732,425 A 3/1998 Leung
5,733,228 A 3/1998 Stevens
5,785,631 A 7/1998 Heidecke
D405,132 S 2/1999 Westfall et al.
5,906,564 A 5/1999 Jacobsen
5,910,070 A 6/1999 Henry et al.
5,938,571 A 8/1999 Stevens
5,967,955 A 10/1999 Westfall et al.
6,035,462 A 3/2000 Bennett et al.
6,042,508 A 3/2000 Clem et al.
6,117,049 A 9/2000 Lower
6,302,830 B1 10/2001 Stearns
6,390,951 B1 5/2002 Daniel
6,409,631 B1 6/2002 Alessandri
6,475,127 B1 11/2002 Koenig
6,500,097 B1 12/2002 Hall
6,632,161 B1 10/2003 Nir
6,634,996 B2 10/2003 Jacobsen
6,692,412 B2 2/2004 Chen et al.
6,740,009 B1 5/2004 Hall
6,767,314 B2 7/2004 Thompson
6,786,847 B1 9/2004 Morgan et al.
6,921,355 B2 7/2005 Campanaro et al.
7,104,937 B2 9/2006 Arbuckle et al.
7,125,369 B2 10/2006 Endelman
7,204,790 B2 4/2007 Sleamaker
7,247,128 B2 7/2007 Oga
7,270,628 B2 * 9/2007 Campanaro et al. ..... 482/95
7,364,535 B1 4/2008 Rosenow et al.
7,503,880 B2 * 3/2009 Campanaro et al. ..... 482/96
7,766,801 B2 * 8/2010 Campanaro et al. ..... 482/96
7,775,950 B2 * 8/2010 Campanaro et al. ..... 482/130
2003/0139264 A1 7/2003 Kuo
2003/0199363 A1 10/2003 Chen
2005/0026750 A1 2/2005 Oglesby et al.
2005/0159278 A1 7/2005 McVay et al.
2006/0194678 A1 8/2006 Turner
2007/0093369 A1 * 4/2007 Bocchicchio ..... 482/148
2007/0111866 A1 5/2007 McVay et al.
2007/0142175 A1 6/2007 Morgan et al.
2008/0161173 A1 * 7/2008 Campanaro et al. ..... 482/133
2008/0248935 A1 10/2008 Solow et al.

* cited by examiner 110
830
940
700
230
120
260
100
1000
320
240
410
385
390
450
620
240

501
504
503
502
505
415
420
430
380
450
440
501
D
360
370

| Bodyweight | Exercise Resistance Chart | | | | | | | | | |
|---|---|---|---|---|---|---|---|---|---|---|
| | Level | | 1 | 2 | 3 | 4 | 5 | 6 | 7 | 8 |
| | Slope in Degrees | | 4.5° | 7.5° | 10.5° | 13.5° | 16.5° | 20° | 24° | 27° |
| | | % | 10 | 16 | 23 | 29 | 35 | 42 | 50 | 56 |
| | 100 | Weight | 10 | 16 | 23 | 29 | 35 | 42 | 50 | 56 |
| | | % | 10 | 16 | 22 | 29 | 35 | 42 | 50 | 55 |
| | 110 | Weight | 11 | 18 | 24 | 31 | 38 | 46 | 55 | 61 |
| | | % | 10 | 16 | 22 | 28 | 34 | 41 | 49 | 55 |
| | 120 | Weight | 12 | 19 | 26 | 34 | 41 | 49 | 59 | 65 |
| | | % | 9 | 16 | 22 | 28 | 34 | 41 | 48 | 54 |
| | 130 | Weight | 12 | 20 | 28 | 36 | 44 | 53 | 63 | 70 |
| | | % | 9 | 15 | 21 | 27 | 33 | 40 | 48 | 53 |
| | 140 | Weight | 13 | 21 | 30 | 38 | 47 | 56 | 67 | 74 |
| | | % | 9 | 15 | 21 | 27 | 33 | 40 | 47 | 53 |
| | 150 | Weight | 14 | 23 | 32 | 41 | 49 | 60 | 71 | 79 |
| | | % | 9 | 15 | 21 | 27 | 33 | 39 | 47 | 52 |
| | 160 | Weight | 14 | 24 | 34 | 43 | 52 | 63 | 75 | 84 |
| | | % | 9 | 15 | 21 | 27 | 32 | 39 | 46 | 52 |
| | 170 | Weight | 15 | 25 | 35 | 45 | 55 | 66 | 79 | 88 |
| | | % | 9 | 15 | 21 | 26 | 32 | 39 | 46 | 51 |
| | 180 | Weight | 16 | 27 | 37 | 48 | 58 | 70 | 83 | 93 |
| | | % | 9 | 15 | 21 | 26 | 32 | 39 | 46 | 51 |
| | 190 | Weight | 17 | 28 | 39 | 50 | 61 | 73 | 87 | 97 |
| | | % | 9 | 15 | 20 | 26 | 32 | 38 | 46 | 51 |
| | 200 | Weight | 18 | 29 | 41 | 52 | 64 | 77 | 91 | 102 |
| | | % | 9 | 15 | 20 | 26 | 32 | 38 | 45 | 51 |
| | 210 | Weight | 18 | 30 | 43 | 55 | 66 | 80 | 95 | 106 |
| | | % | 9 | 15 | 20 | 26 | 32 | 38 | 45 | 50 |
| | 220 | Weight | 19 | 32 | 45 | 57 | 69 | 83 | 99 | 110 |
| | | % | 9 | 14 | 20 | 26 | 31 | 38 | 45 | 50 |
| | 230 | Weight | 20 | 33 | 46 | 59 | 72 | 87 | 103 | 115 |
| | | % | 9 | 14 | 20 | 26 | 32 | 38 | 45 | 50 |

Ⓐ Ⓑ

FIG. 22

Ⓐ Ⓑ

| | | | | | | | | | |
|---|---|---|---|---|---|---|---|---|---|
| 240 | Weight | 21 | 35 | 48 | 62 | 75 | 90 | 107 | 120 |
| | % | 9 | 14 | 20 | 26 | 31 | 38 | 45 | 50 |
| 250 | Weight | 22 | 36 | 50 | 64 | 78 | 94 | 111 | 124 |
| | % | 9 | 14 | 20 | 26 | 31 | 37 | 44 | 50 |
| 260 | Weight | 22 | 37 | 52 | 66 | 81 | 97 | 116 | 129 |
| | % | 9 | 14 | 20 | 25 | 31 | 37 | 44 | 49 |
| 270 | Weight | 23 | 38 | 54 | 69 | 84 | 100 | 120 | 133 |
| | % | 9 | 14 | 20 | 25 | 31 | 37 | 44 | 49 |
| 280 | Weight | 24 | 40 | 55 | 71 | 86 | 104 | 124 | 138 |
| | % | 9 | 14 | 20 | 25 | 31 | 37 | 44 | 49 |
| 290 | Weight | 25 | 41 | 57 | 73 | 89 | 107 | 128 | 143 |
| | % | 9 | 14 | 20 | 25 | 31 | 37 | 44 | 49 |
| 300 | Weight | 27 | 42 | 59 | 76 | 92 | 111 | 132 | 147 |

FIG. 22
(Continued)

| | BEGINNER | INTERMEDIATE | ADVANCED |
|---|---|---|---|
| Selection | *Single Joint & Multiple Joint* | *Single Joint & Multiple Joint Emphasis on MJ* | *Single Joint & Multiple Joint* |
| Order | *Large to Small Muscle Groups* | *Multiple Joint to Single Joint* | *High Intensity to Low Intensity* |
| Loading | *60%-70% of 1 Rep Max.* | *70-80% of 1 Rep Max.* | *70%-100% of 1 Rep Max. 70-85% Periodized* |
| Volume | *1-3 Sets, 8-12 Reps* | *Multiple Sets 6-12 Reps* | *Multiple Sets, 1-12 Reps with Emphasis on 6-12 Reps Periodized* |
| Rest Interval | *2-3 Mins. for Core 1-2 Mins. for Others* | *2-3 Mins. for Core 1-2 Mins. for Others* | *2-3 Mins. for Core 1-2 Mins. for Others* |
| Velocity | *Slow to Moderate* | *Moderate* | *Intentionally Slow to Fast* |
| *Frequency* | *2-3 x / Week* | *2-4 x / Week* | *4-6 x / Week* |

FIG. 23

| | BEGINNER | INTERMEDIATE | ADVANCED |
|---|---|---|---|
| Selection | *Single Joint & Multiple Joint* | *Single Joint & Multiple Joint Emphasis on MJ* | *Single Joint & Multiple Joint* |
| Order | *Large to Small Muscle Groups* | *Multiple Joint to Single Joint* | *High Intensity to Low Intensity* |
| Loading | *60%-70% of 1 Rep Max.* | *70-80% of 1 Rep Max.* | *70%-100% of 1 Rep Max. 70-85% Periodized* |
| Volume | *1-3 Sets, 8-12 Reps* | *Multiple Sets 6-12 Reps* | *Multiple Sets, 1-12 Reps with Emphasis on 6-12 Reps Periodized* |
| Rest Interval | *1-2 Mins.* | *1-2 Mins.* | *2-3 Mins. for Heavy Sets, 1-2 Mins. for Light to Moderate* |
| Velocity | *Slow to Moderate* | *Slow to Moderate* | *Slow, Moderate, Fast* |
| Frequency | *2-3 x / Week* | *2-4 x / Week* | *4-6 x / Week* |

FIG. 24

| | BEGINNER | INTERMEDIATE | ADVANCED |
|---|---|---|---|
| Selection | *Primarily Multiple Joint* | *Primarily Multiple Joint* | *Primarily Multiple Joint* |
| Order | *Large to Small Muscle Groups* | *Most Complex to Least Complex* | *High Intensity to Low Intensity* |
| Loading | *>80% 1 RM-Strength 30-60% 1 RM Endurance* | *>80% 1 RM-Strength 30-60% 1 RM Endurance* | *>80% 1 RM-Strength 30-60% 1 RM Endurance* |
| Volume | *Train for Strength* | *1-3 Sets, 3-6 Reps* | *1-3 Sets, 3-6 Reps* |
| Rest Interval | *2-3 Mins. for Core* | *2-3 Mins. for Core 1-2 Mins. for Others* | *2-3 Mins. for Core 1-2 Mins. for Others* |
| Velocity | *Moderate* | *Fast* | *Fast* |
| Frequency | *2-3 x / Week* | *2-4 x / Week* | *4-6 x / Week* |

FIG. 25

| | BEGINNER | INTERMEDIATE | ADVANCED |
|---|---|---|---|
| Selection | *Single Joint & Multiple Joint* | *Single Joint & Multiple Joint* | *Single Joint & Multiple Joint* |
| Order | *Variety in Sequencing* | *Variety in Sequencing* | *Variety in Sequencing* |
| Loading | *50%-70% of 1 Rep Max.* | *50%-70% of 1 Rep Max.* | *30%-80% of 1 Rep Max.* |
| Volume | *1-3 Sets, 10-15 Reps* | *Multiple Sets 10-15 Reps or More* | *Multiple Sets 10-25 Reps or More* |
| Rest Interval | *1-2 Mins. for High Rep Sets* | *1-2 Mins. for High Rep Sets* | *<1 Min. for 10-15 Reps* |
| Velocity | *Slow to Moderate Repetitions* | *Moderate to High Repetitions* | *Moderate to High Repetitions* |
| Frequency | *2-3 x / Week* | *2-4 x / Week* | *4-6 x / Week* |

FIG. 26

METHOD OF USING AN EXERCISE DEVICE HAVING AN ADJUSTABLE INCLINE

FIELD OF THE INVENTION

The present invention relates, in general, to an exercise device and a method of using the same. More particularly, the present invention relates to an exercise device and method wherein the exerciser exerts muscle force against an adjustable portion of the exerciser's own body weight, and other methods described herein.

BACKGROUND OF THE INVENTION

Home exercise is becoming increasingly more popular. Home exercise offers the health benefits of regular exercise while recognizing that many people have difficulty in finding sufficient time in their schedule for a full workout at a health club or gymnasium. An exerciser may exercise at home whenever the exerciser's schedule permits. This flexibility in scheduling often allows for a more consistent and thus healthful exercise regime.

Home exercise, however, has its drawbacks. In particular, in order to exercise all or most of the muscle groups, multiple pieces of home exercise equipment may be required. Furthermore, these multiple pieces of equipment may require permanent installation in the exerciser's home.

Permanent or not, many popular pieces of home exercise equipment occupy a great deal of space. This makes the use of this equipment impractical in homes or apartments which do not have the required extra space. Furthermore, non-permanent pieces of equipment are often difficult to disassemble and may require much storage space even when disassembled. A user must then often choose between an exercise device providing a complete exercise regime and a device which fits the exerciser's home space.

There is, thus, a need for exercise equipment which may be easily stored when not in use, does not occupy a great deal of space when in use and provides for exercising all or most of the muscle groups.

Exercise devices are known in which a user, positioned on a support platform, propels that support platform up an inclined ramp. One way by which the platform may be propelled is by pulling a cable connected to the support platform through a variety of pulleys positioned on the exercise device. By changing positions on the platform and by changing the method by which the platform is propelled, a user can exercise multiple muscle groups.

While early versions of these devices did not allow for easy storage, later designs were proposed that allowed for some type of disassembly in the design. Even the later designs do not, however, provide complete foldability of the exercise unit. The designs include some separate elements which must be disengaged to allow for foldability of the device. Thus, these designs cannot be folded and stored as a unit. Moreover, the designs are not easily converted from the folded stored state to an unfolded state for use.

Another problem with early versions of these devices is that they did not allow for a wide variety of different types of muscle exercises, especially multiple muscle exercises for each specific muscle group.

In view of the foregoing, there is a need for an inclined ramp exercise device which is easily foldable to a size which allows for easy storage, is easily unfolded into a useable state, and which allows for exercising multiple muscle groups and multiple exercises for each muscle group.

There is also a need for multiple exercises, sequences of exercises, instruction, and education related to an inclined ramp exercise device.

In the inclined ramp exercise device, a user can make the workout more difficult by increasing the angle and height of the inclined ramp on which the platform is propelled. In the past, this was manually performed by the user by lifting one end of an inclined ramp and setting the inclined ramp at a desired height and angle of inclination for the desired level of difficulty. A user may have to lift and reset the inclined ramp multiple times, depending on which exercises the user is performing and the desired resistance level. This can be tiring and cumbersome.

Thus, a need also exist for an inclined ramp exercise device and a method where the exercise device includes an automatic lift mechanism for automatically setting the height and angle of the inclined ramp.

Alternatively, in circumstances where a consumer can not justify the additional cost of an automatic lift mechanism (e.g., such as, but not limited to home gym use), a need exists for a lift-assist mechanism to assist the user in lifting the inclined ramp and setting the inclined ramp at a desired height and angle of inclination for the desired level of difficulty.

SUMMARY OF THE INVENTION

Accordingly, an aspect of the invention involves a method of using a collapsible exercise device. The method includes providing a collapsible exercise device including a vertical support member, an adjustable incline having a first end and a second end, the first end of the adjustable incline pivotally coupled to, adjustably supported by, and vertically movable with respect to, the vertical support member for adjusting the incline of the adjustable incline, a user support platform movably attached to the adjustable incline, first and second combination pulley-support and pull-up bars each pivotally connected to the first end of the adjustable incline for movement between at least a substantially vertical position and a substantially non-vertical position, first and second pulleys movably connected to the first and second combination pulley-support and pull-up bars for movement of the pulleys to a desired location, and one or more cables extendable through first and second pulleys and connected to the user support platform for movement of the support platform along the adjustable incline through cable movement, wherein the exercise device is foldable such that the vertical support member and the adjustable incline are substantially parallel to each other when collapsed; positioning the first end of the adjustable incline at a desired height with respect to the vertical support member so that the adjustable incline is at a desired inclination; moving the first and second combination pulley-support and pull-up bars to a desired position; moving the first and second pulleys connected to the first and second combination pulley-support and pull-up bars to a desired location; and moving the support platform along the adjustable incline through cable movement through the first and second pulleys on the combination pulley-support and pull-up bars.

Further implementations of the aspect of the invention described immediately above include one or more of the following. The first and second combination pulley-support and pull-up bars each have a trapezoidal configuration. The first and second pulleys each include a collar slidably attached to the combination pulley-support and pull-up bar and a pull pin carried by the collar for locking the pulley in position on the combination pulley-support and pull-up bar. A folding squat platform is pivotally and removably connected to the second end of the adjustable incline. A squat stand is telescopingly and removably engaged with the folding squat platform. A push-up bar is removably connected to the second end of the adjustable incline. A padded foot support is removably connected to the second end of the adjustable incline. A dip bar assembly is connected to the adjustable incline, and the dip bar assembly includes a pair of dip bars movable between at least a retracted, out-of-the way position, and a non-retracted, ready-for-use position. A foot support assembly is pivotally connected to the adjustable incline, and the foot support assembly is pivotable between at least a retracted, out-of-the way position, and a non-retracted, ready-for-use position. The one or more cables include a single cable with opposite ends, and handles each connected to the opposite ends of the single cable. The vertical support member includes a vertical support tower including a tower level track therein, the tower level tracks including multiple vertically spaced hooks, and the first end of the adjustable incline is pivotally connected to, and adjustably supported by the hooks of the tower level track. The vertical support member includes an automatic lift mechanism including a driving mechanism, upper and lower pully assemblies, at least one of which is driven by the driving mechanism, and opposite vertical chains carried by the pully, the adjustable incline is coupled to the opposite vertical chains, and positioning the first end of the adjustable incline at a desired height includes moving the first end of the adjustable incline up and down with the automatic lift mechanism. The collapsible exercise device is used for personal training. The collapsible exercise device is used for group training. The collapsible exercise device is used for Pilates training. The collapsible exercise device is used for rehabilitation. Positioning the first end of the adjustable incline at a desired height includes positioning the first end of the adjustable incline at a desired height level in accordance with a resistance chart indicating the effective weight for various height levels and bodyweights.

Another aspect of the invention involves an exercise device including a vertical support member; an adjustable incline having a first end and a second end, the first end of the adjustable incline adjustably supported by, and vertically movable with respect to, the vertical support member for adjusting the incline of the adjustable incline; a user support platform movably attached to the adjustable incline; first and second pulleys coupled to the adjustable incline; one or more cables extendable through first and second pulleys and coupled to the user support platform for movement of the support platform along the adjustable incline through cable movement; and a non-motorized lift assist mechanism coupled to the adjustable incline and configured to impart a force on the adjustable incline to assist a user in adjusting the incline of the adjustable incline.

Implementations of the aspect of the invention described immediately above include one or more of the following. The vertical support member includes a base, and the exercise device includes a strut coupling the base to the adjustable incline, and the lift assist mechanism couples the strut to the adjustable incline and is configured to impart a force on the adjustable incline to assist a user in adjusting the incline of the adjustable incline. The lift assist mechanism couples the strut to the adjustable incline at a location between where the strut is coupled to the adjustable incline and the vertical support member, and the lift assist mechanism is configured to push upward and toward the vertical support member on the adjustable incline to assist a user in adjusting the incline of the adjustable incline. The adjustable incline includes a lower end adjacent the ground, the lift assist mechanism couples the strut to the adjustable incline at a location between where the strut is coupled to the adjustable incline and the lower end of the adjustable incline, and the lift assist mechanism is configured to pull downward and toward the vertical support member on the adjustable incline to assist a user in adjusting the incline of the adjustable incline. The vertical support member includes the lift assist mechanism incorporated therein. The lift assist mechanism includes a spring. The lift assist mechanism includes a gas spring. The lift assist mechanism includes a push-type gas spring. The lift assist mechanism includes a pull-type gas spring. The lift assist mechanism includes one or more coil springs. The one or more cables include a single cable with opposite ends, and further including handles each connected to the opposite ends of the single cable. The exercise device is collapsible. The non-motorized lift assist mechanism includes one or more non-motorized lift assist mechanisms. The first end of the adjustable incline is adjustably supported by the vertical support member using one or more of hooks, notches, slots, holes, pins, bars or the like. The vertical support member does not include hooks, notches, slots, or holes, and the first end of the adjustable incline includes a clamping mechanism that clamps onto the vertical support member of the vertical support member for adjustably supporting the first end of the adjustable incline by the vertical support member. The clamping mechanism(s) secure to vertical support member(s) by friction and/or a clamping force.

BRIEF DESCRIPTION OF THE DRAWINGS

The accompanying drawings, which are incorporated in and constitute a part of the specification, illustrate embodiments of the invention and, together with the description, serve to explain the objects, advantages, and principles of the invention. In the drawings.

FIGS. 5C and 5D illustrate an embodiment of a telescoping toe bar accessory

FIG. 22 is an exemplary resistance chart for the exercise device illustrated in FIGS. 1-20.

FIG. 23 is an exemplary strength chart with guidelines for the gradual improvement of strength using the exercise device.

FIG. 24 is an exemplary hypertrophy chart with guidelines for the gradual improvement of hypertrophy using the exercise device.

FIG. 25 is an exemplary power chart with guidelines for the gradual improvement of power using the exercise device.

FIG. 26 is an exemplary endurance chart with guidelines for the gradual improvement of endurance using the exercise device.

DETAILED DESCRIPTION OF PREFERRED EMBODIMENTS

Figure 1:
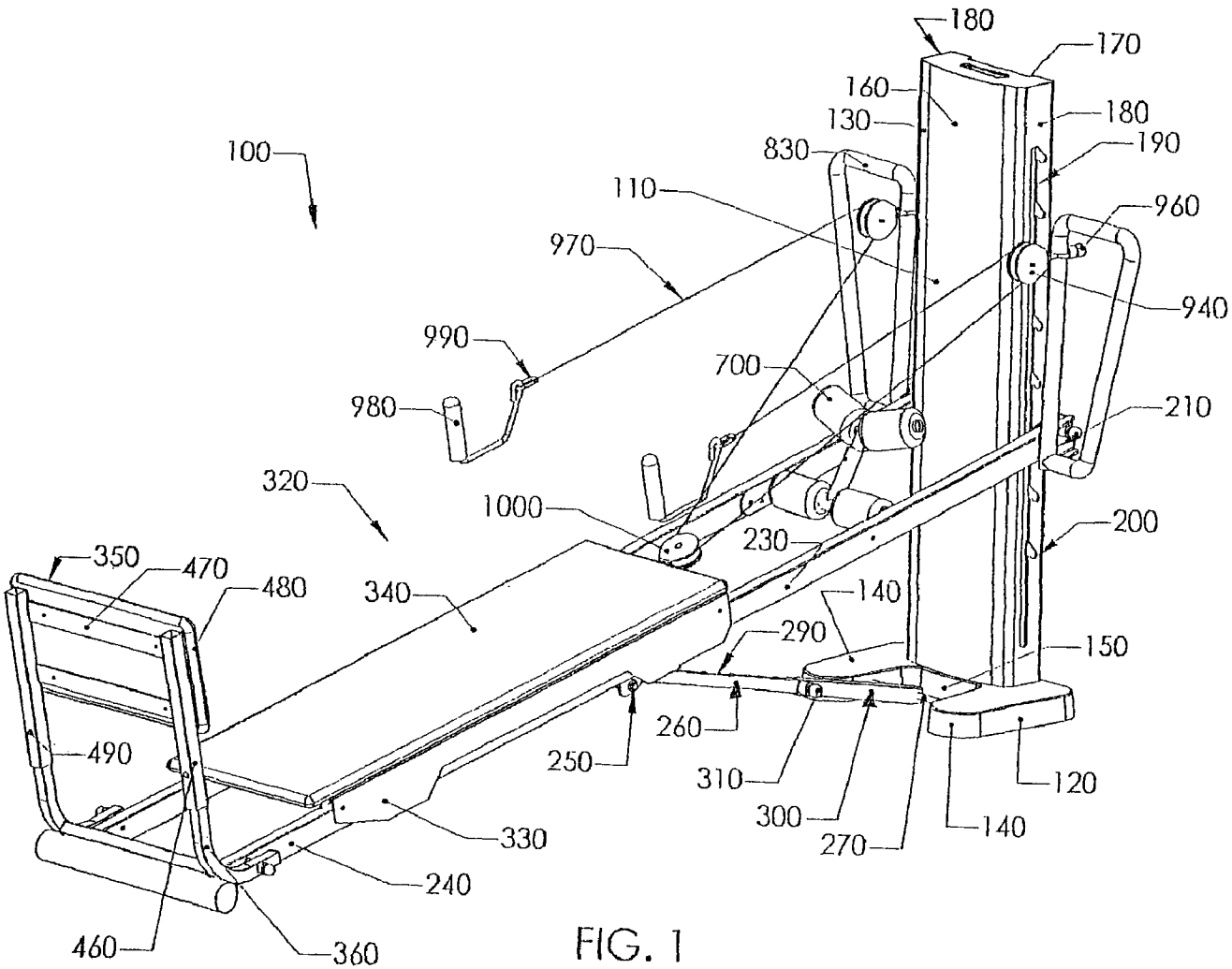
FIG. 1 is a perspective view of an embodiment of an exercise device.
Figure 2:
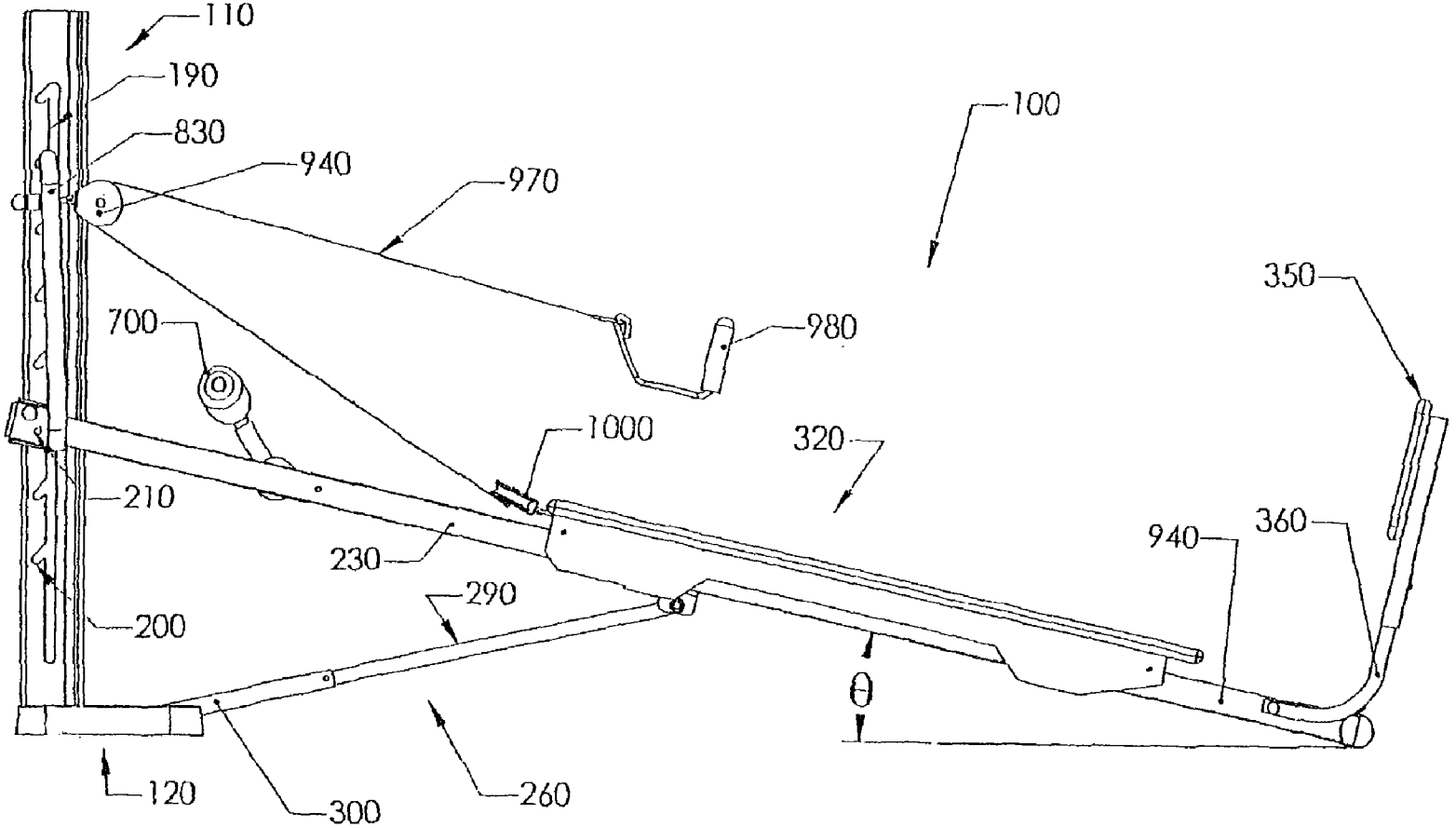
FIG. 2 is a left side elevational view of the exercise device shown in FIG. 1.
Figure 3:
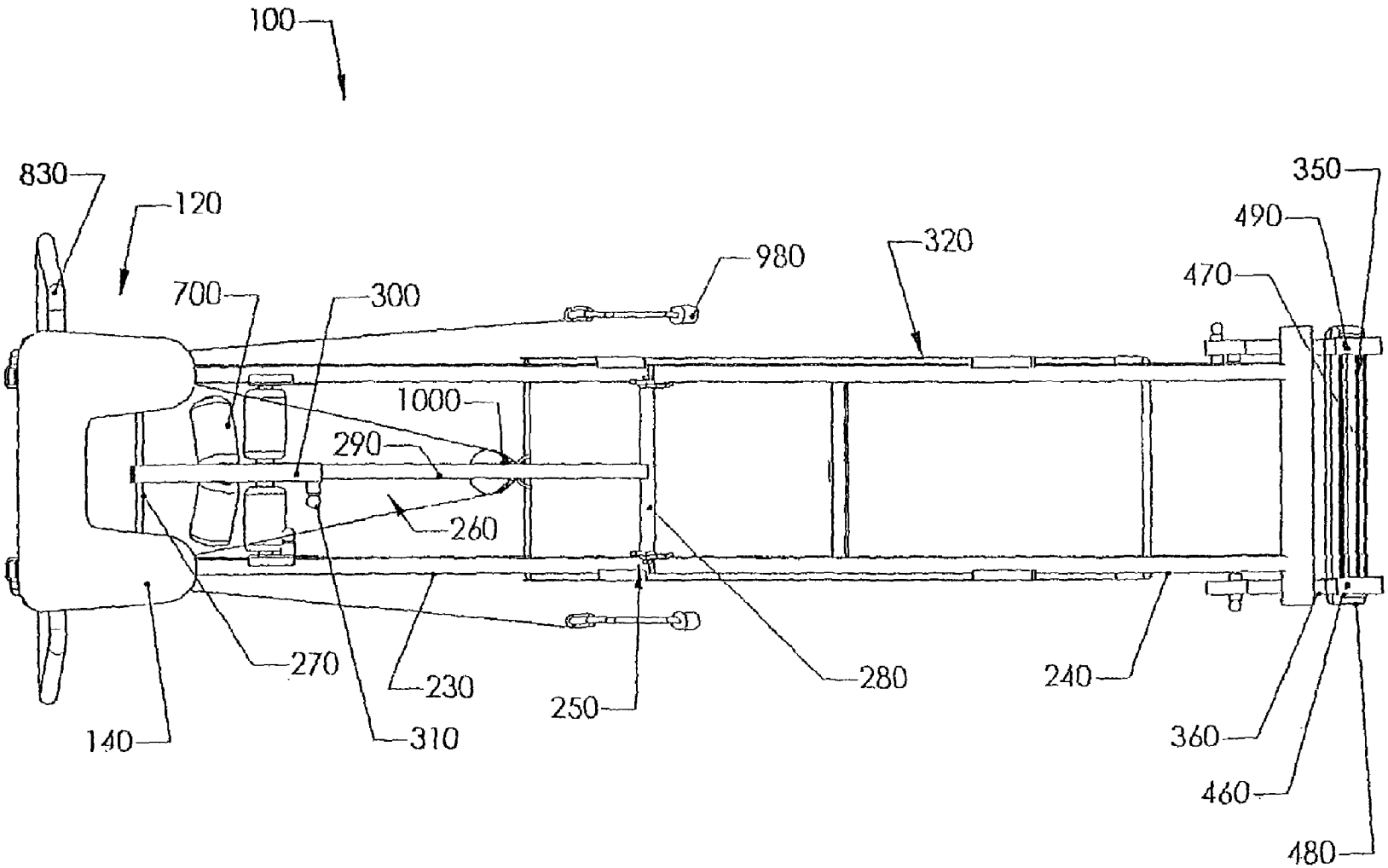
FIG. 3 is a bottom plan view of the exercise device shown in FIG. 1.

With reference to FIGS. 1-3, a collapsible exercise device 100 constructed in accordance with an embodiment of the invention will now be described. The collapsible exercise device 100 is shown in an unfolded state. The collapsible exercise device 100 includes a vertical support member or tower 110 having a base 120 and a tower housing 130. The base 120 includes a pair of opposite foot-shaped base members 140 joined by an intermediate base section 150. The tower housing 130 extends from the intermediate base section 150 of the base 120. The tower housing 130 includes a front vertical face 160, a rear vertical face 170, and opposite symmetric sides 180. The sides 180 include tower level tracks 190 with multiple tower level hooks 200 evenly vertically spaced along the tracks 190.

Slide bars 210 extend inwardly from proximal ends 220 of a pair of upper rails 230. The inwardly extending slide bars 210 may be slid up or down in the tower level tracks 190 and set in corresponding tower level hooks 200 to a desired height. The slide bars 210 may be removable from the upper rails 230. A pair of lower rails 240 are pivotally connected to the upper rails 230 at rail pivot points 250. A strut 260 is pivotally connected to the base 120 through a lower pivot bar 270 at the base members 140 and is also pivotally connected to the rail pivot points 250 through an upper pivot bar 280. The strut 260 includes an upper strut post 290 matingly received within a lower strut post 300. The strut posts 290 may be locked with respect to each other with a spring-loaded pull pin 310 and lateral holes in the upper strut post 290.

In an alternate embodiment, one end of the strut 260 may be pivotally connected to the upper pivot bar 280, while the other end includes a support platform that rests on a floor.

A user support platform 320 is slidably attached to the rails 230, 240 through support frame or glideboard 330 and rollers (not shown) on the support frame 330. A main support pad 340 is attached to and supported by the support frame 330. A bumper (not shown) may be positioned on the lower rails 240 to prevent the user support platform 320 from rolling all the way down the lower rails 240.

Figures 4A, 4B:
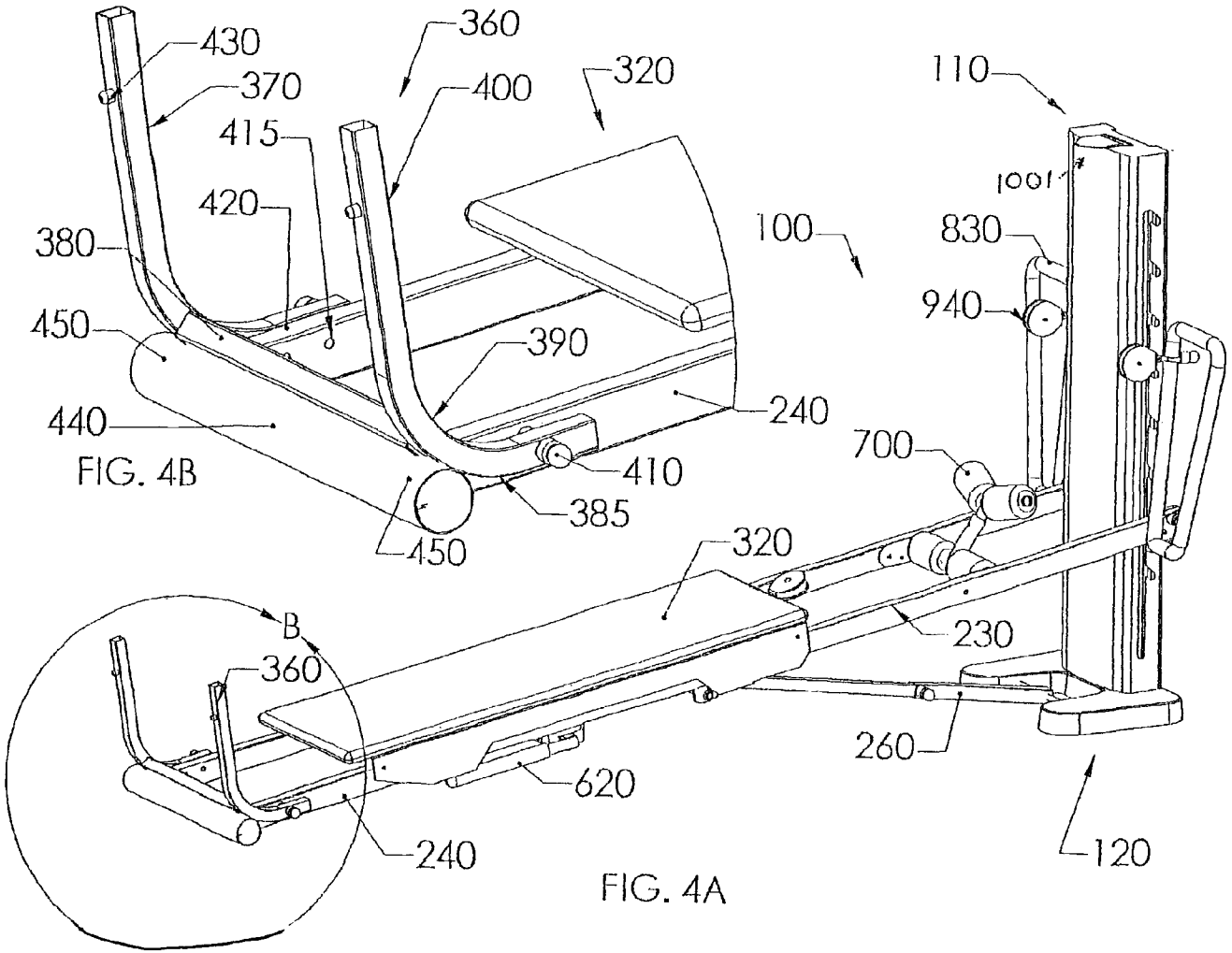
FIG. 4A is a perspective view of the device shown in FIG. 1 with a telescoping squat stand removed from a folding squat platform and the folding squat stand shown in an unfolded state.
FIG. 4B is an enlarged perspective view of the area B of FIG. 4A and details the telescoping squat stand removed from a folding squat platform.

With reference to FIGS. 1, 2, and 4A-5B, a telescoping squat stand 350 and folding squat platform 360 constructed in accordance with an embodiment of the invention will be described. In FIGS. 4A and 4B, the folding squat platform 360 is shown in an unfolded state with the telescoping squat stand 350 removed from the folding squat platform 360. The folding squat platform 360 includes opposite parallel rails 370 joined by perpendicularly extending cross rail 380. Each rail 370 has a generally square cross-section and includes a short, straight pivot portion 385, a curved portion 390, and an elongated distal portion 400. The pivot portion 380 carries a spring-loaded pull pin 410 for locking the folding squat platform 360 within pin holes 415 near a distal end 420 of the lower rails 240. A spring-loaded depressible pin 430 is carried in the elongated distal portion 400 for locking the folding squat platform 360 in place along the folding squat platform 360.

In the unfolded state shown in FIGS. 4A and 4B, the curved portion 390 of the rails 370 and the cross rail 380 are supported by a cross member 440. The cross member 440 has a generally cylindrical configuration and extends perpendicularly between the distal ends 420 of the lower rails, joining the lower rails 240. Ends 450 of the cross member 440 extend laterally beyond the distal ends 420 and may carry rollers or wheels for rolling this part of the exercise device 100 along the floor.

Figures 5A, 5B:
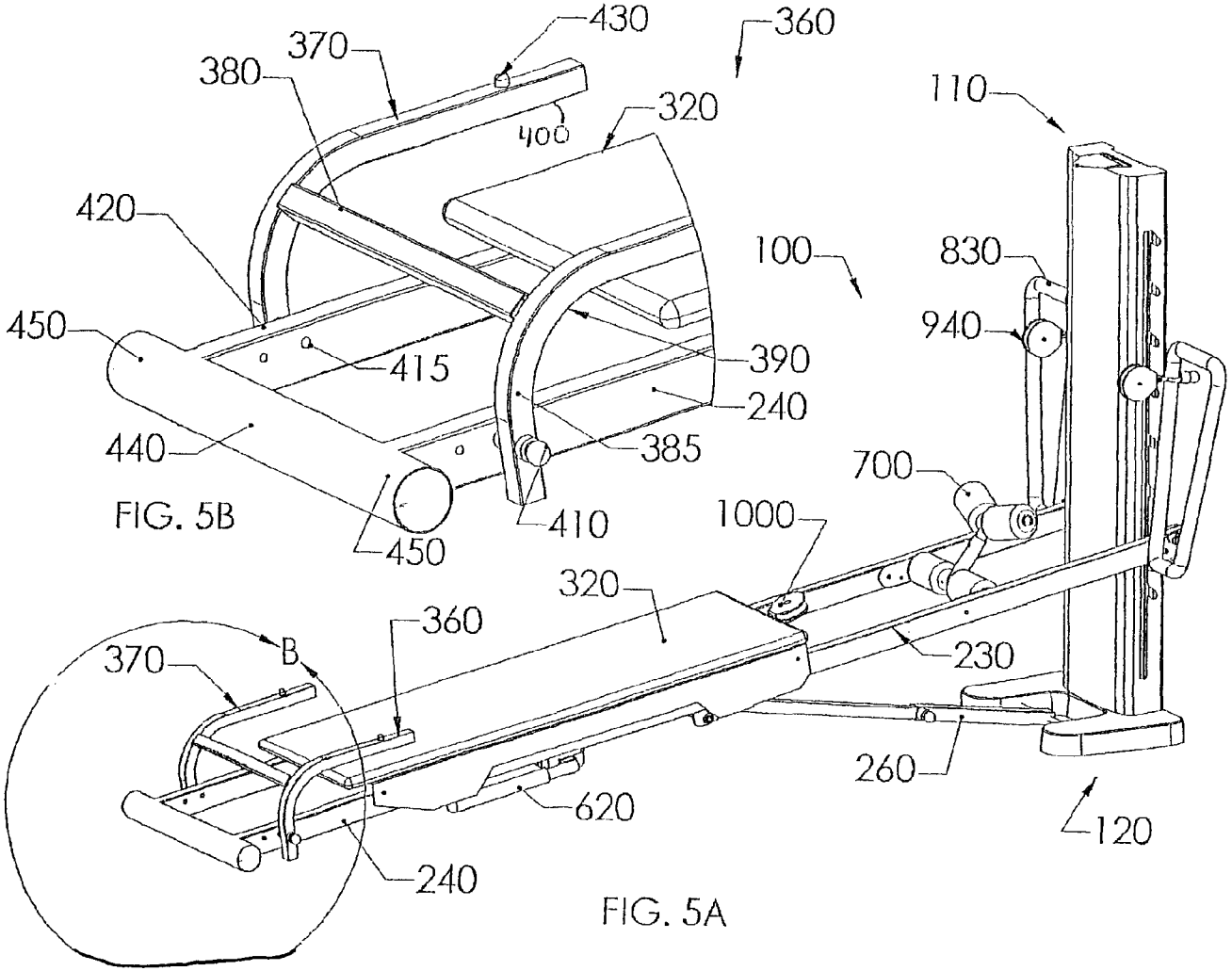
FIG. 5A is a perspective view of the device shown in FIG. 1 with a telescoping squat stand removed from a folding squat platform and the folding squat stand shown in a folded state.
FIG. 5B is an enlarged perspective view of the area B of FIG. 5A and details the folding squat platform shown in a folded state.

The folding squat platform 360 may be pivoted or folded up to the compact position shown in FIGS. 5A and 5B, where the elongated distal portion 400 of the folding squat platform 260 is generally parallel with the lower rails 240. The telescoping squat stand 350 includes opposite straight parallel rails 460, perpendicularly extending supports 470, and a squat platform 480 supported by and connected to the rails 460 and supports 470. The rails 460 include a generally square cross-sectional, hollow configuration and telescope onto (matingly receive) the elongated distal portions 400 of the rails 370. When attaching the squat stand 350 to the rails 370, the pins 430 may be depressed slightly to allow the rails 460 to slide completely onto the rails 370. Each rail 460 may include one or more pin holes 490 that the spring-loaded pin 430 snap locks into when the hole 490 is over the pin 430. The telescoping squat stand 350 may be removed by pressing down on the pins 430 and sliding the rails 460 of the squat stand 350 off of the rails 370 of the folding squat platform 360. The folding squat platform 360 (or the folding squat platform 260 and connected squat stand 350) may be removed from the distal ends of the lower rails 240 by pulling the pull pins 410 out of the pin holes 415 and removing the folding squat platform 360 from the lower rails 240.

Figures 5C, 5D:
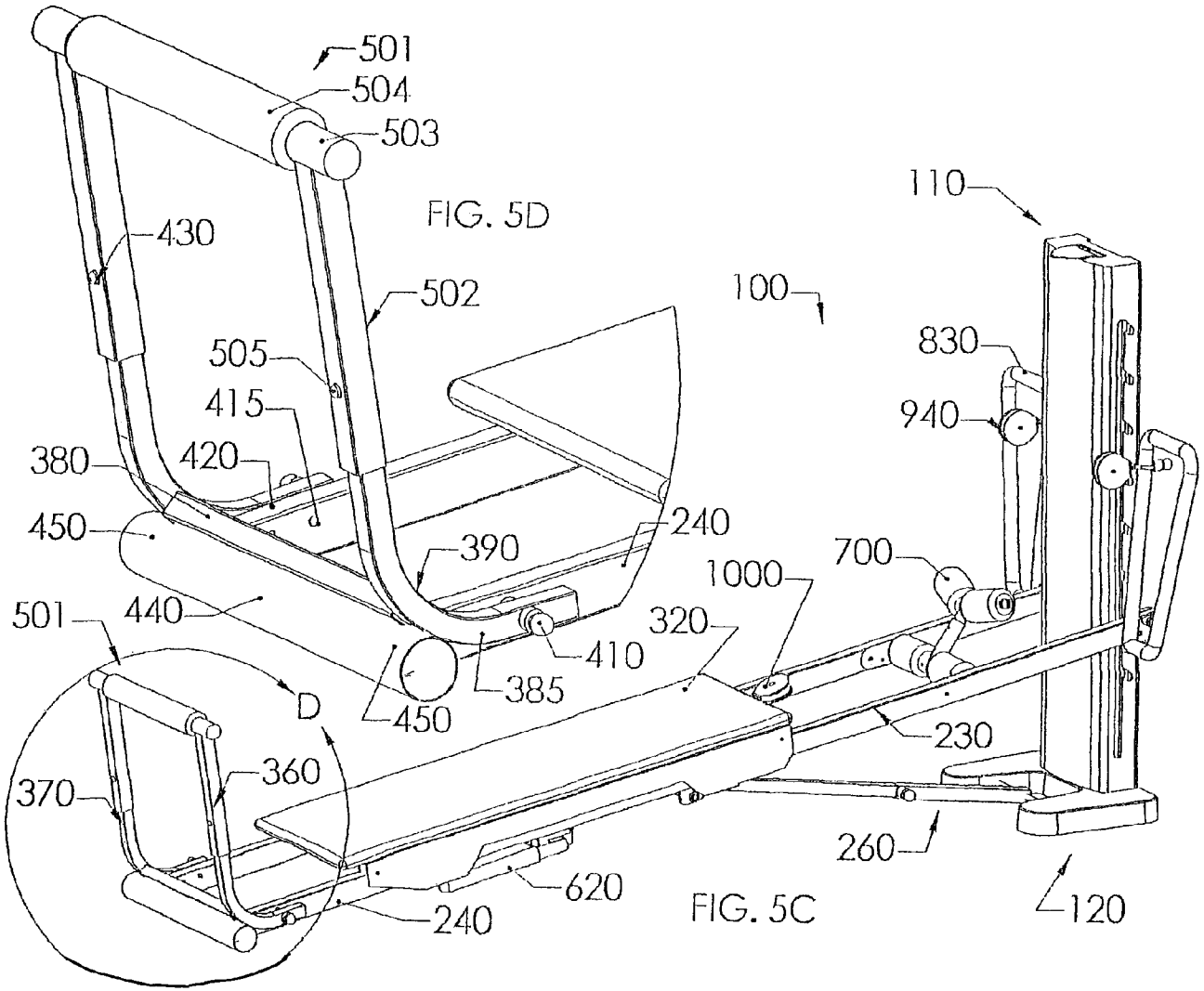
FIG. 5C is a perspective view of the device shown in FIG. 1 with a telescoping squat stand removed from the folding squat platform and an embodiment of a toe bar accessory attached to the folding squat stand.
FIG. 5D is an enlarged perspective view of the area D of FIG. 5C and details the toe bar accessory and the folding squat stand in an unfolded state.

FIGS. 5C and 5D illustrate an embodiment of a telescoping toe bar accessory 501 that attaches to the folding platform 360 in the same manner as the telescoping squat stand 350. The toe bar accessory 501 includes opposite straight parallel rails 502, perpendicularly extending toe bar 503, and a cylindrical toe pad or cushion 504 that surrounds a central portion of the toe bar 503. The rails 502 include a generally square cross-sectional, hollow configuration and telescope onto (matingly receive) the elongated distal portions 400 of the rails 370. When attaching the toe bar accessory 501 to the rails 370, the pins 430 may be depressed slightly to allow the rails 502 to slide completely onto the rails 370. Each rail 502 may include one or more pin holes 505 that the spring-loaded pin 430 snap locks into when the hole 505 is over the pin 430. The telescoping toe bar accessory 501 may be removed by pressing down on the pins 430 and sliding the rails 502 of the toe bar accessory 501 off of the rails 370 of the folding platform 360. The folding platform 360 (or the folding platform 260 and connected toe bar accessory 501) may be removed from the distal ends of the lower rails 240 by pulling the pull pins 410 out of the pin holes 415 and removing the folding platform 360 from the lower rails 240.

Figures 6A, 6B:
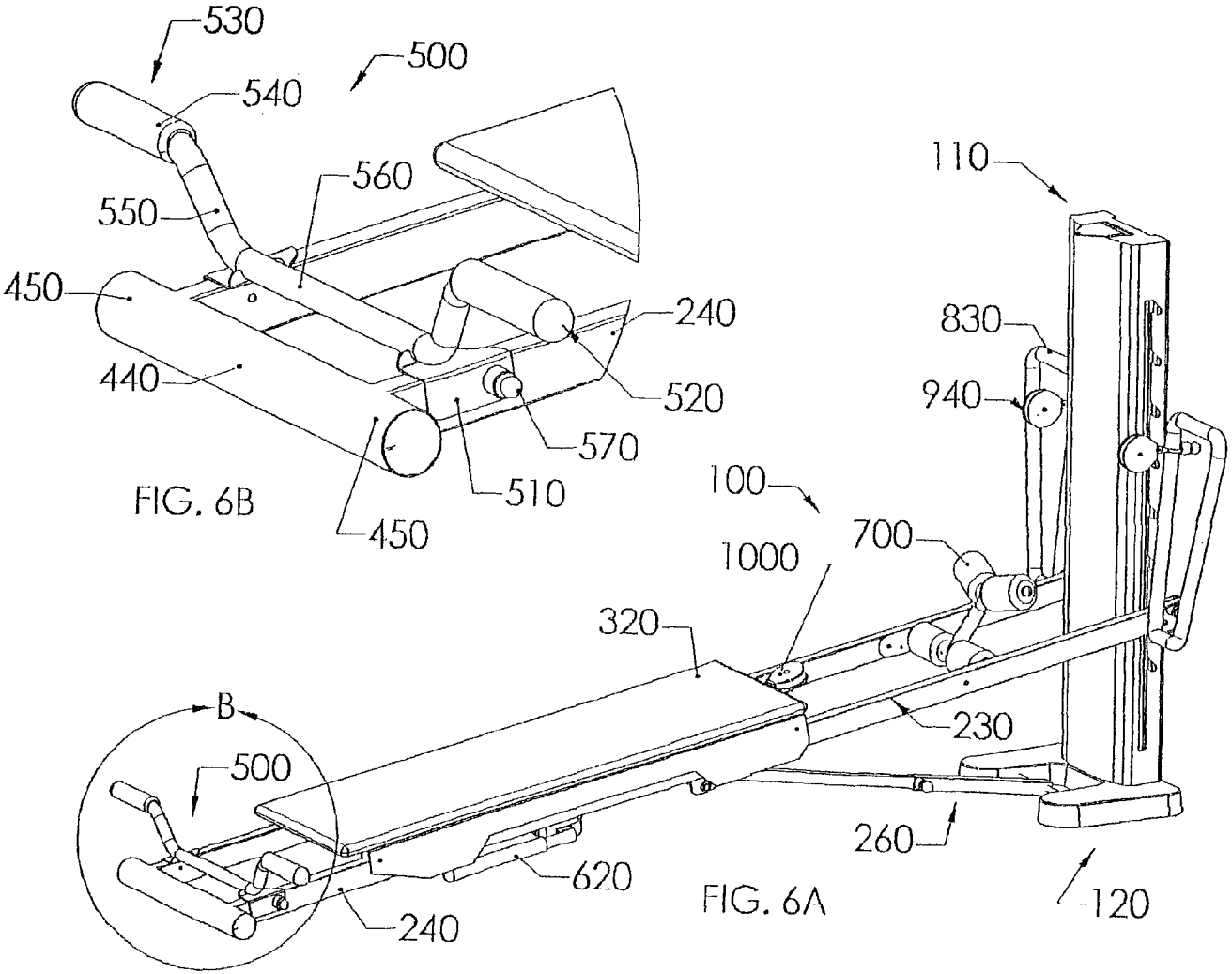
FIG. 6A is a perspective view of the device shown in FIG. 1 with the telescoping squat stand and folding squat platform replaced with a push-up bar accessory.
FIG. 6B is an enlarged perspective view of the area B of FIG. 6A and details the push-up bar accessory.

With reference to FIG. 6A, an embodiment of a push-up bar accessory 500 that may be easily attached to and removed from the distal ends 420 of the lower rails 240 will now be described. The push-up bar accessory 500 includes a pair of opposite coupling brackets 510 for connecting the push-up bar accessory 500 to the distal ends 420 of the lower rails 240. A push-up bar 520 includes handles 530 with grips 540, upwardly angled portions 550, and intermediate portion 560. The push-up bar 520 is connected to the brackets 510 near where the intermediate portion 560 joins the angled portions 550. The brackets 510 carry spring-loaded pull pins 570 for attaching the push-up bar accessory 500 to and removing it from pin holes 415 at the distal ends 420 of the lower rails 240.

Figures 7A, 7B:
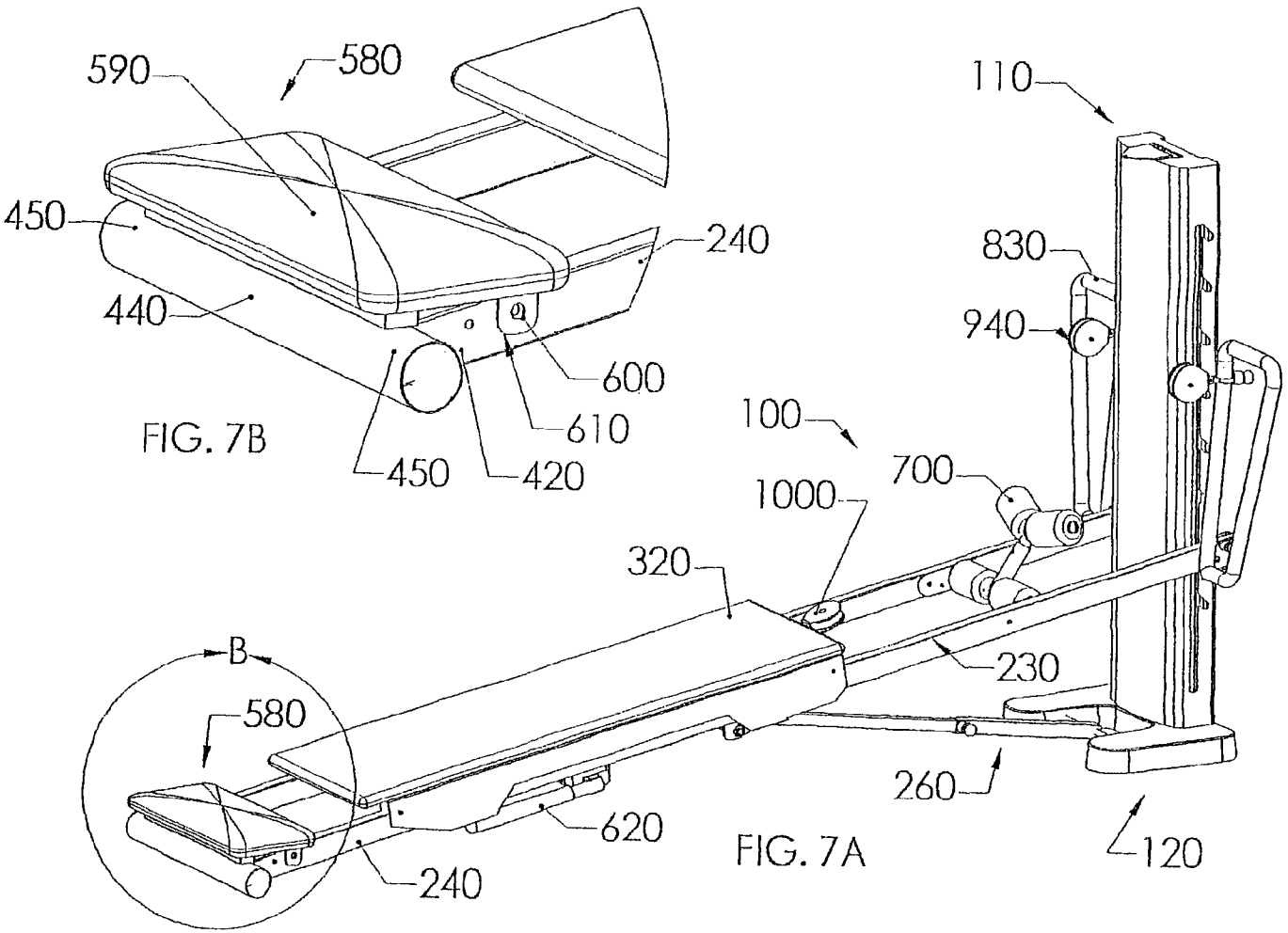
FIG. 7A is a perspective view of the device shown in FIG. 1 with the telescoping squat stand and folding squat platform replaced with a padded foot support accessory.
FIG. 7B is an enlarged perspective view of the area B of FIG. 7A and details the padded foot support accessory.
Figures 8A, 8B:
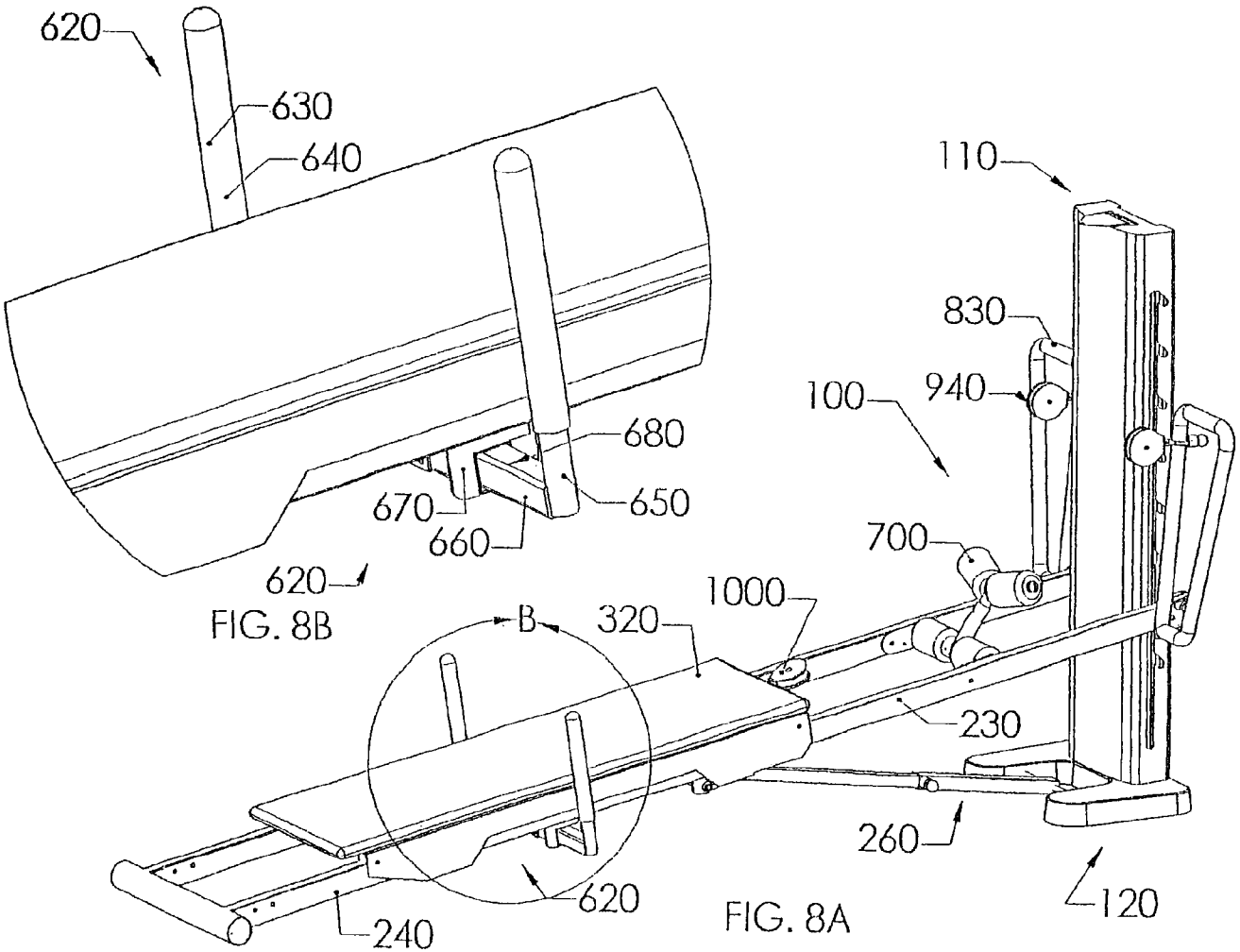
FIG. 8A is a perspective view of the device shown in FIG. 1 without the telescoping squat stand and folding squat platform and shows a dip bar accessory in an unretracted state.
FIG. 8B is an enlarged perspective view of the area B of FIG. 8A and details the dip bar accessory.
Figures 9A, 9B:
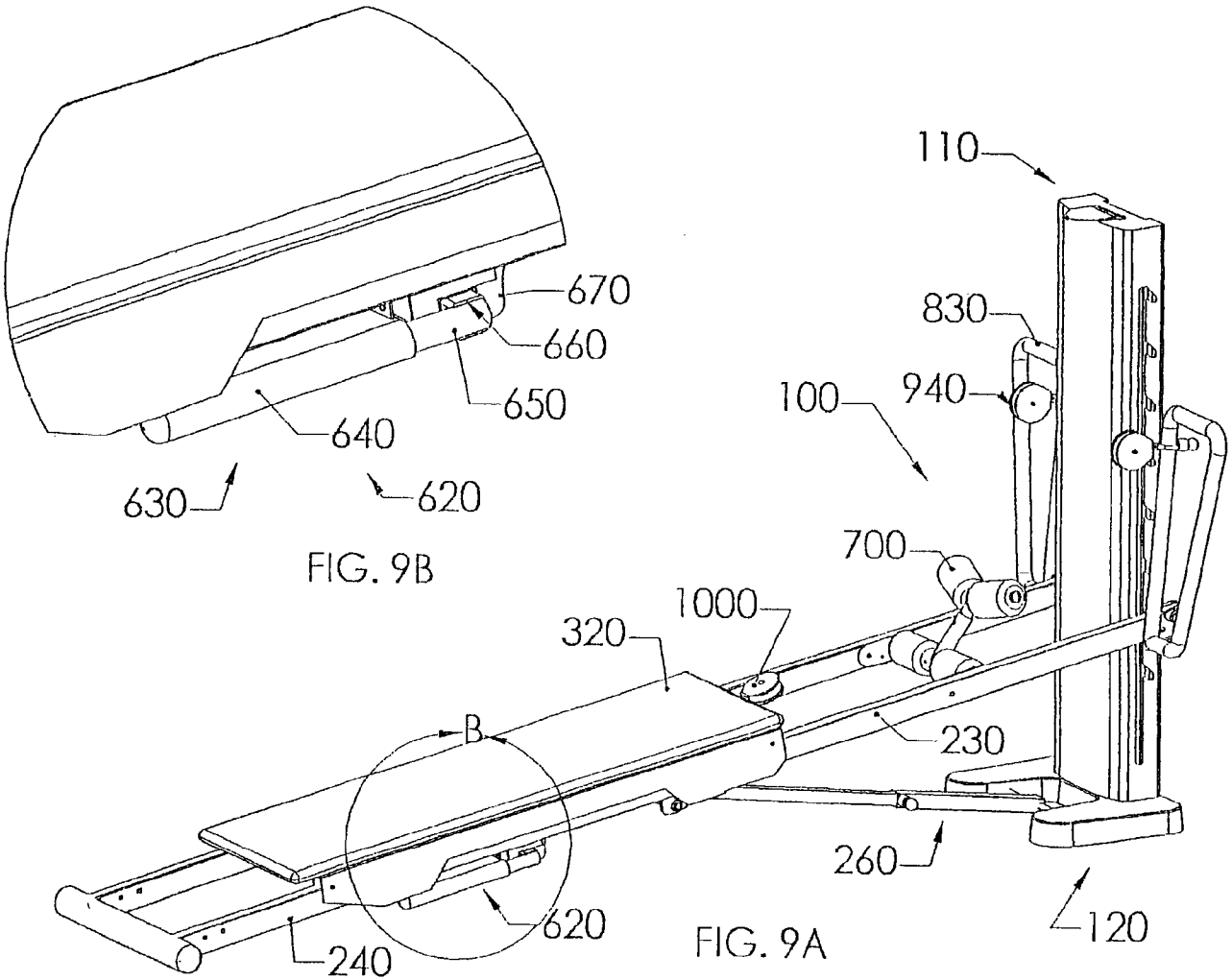
FIG. 9A is a perspective view of the device similar to FIG. 9A and shows the dip bar accessory in a unretracted state.
FIG. 9B is an enlarged perspective view of the area B of FIG. 9A and details the dip bar accessory in a retracted state.
Figures 10A, 10B:
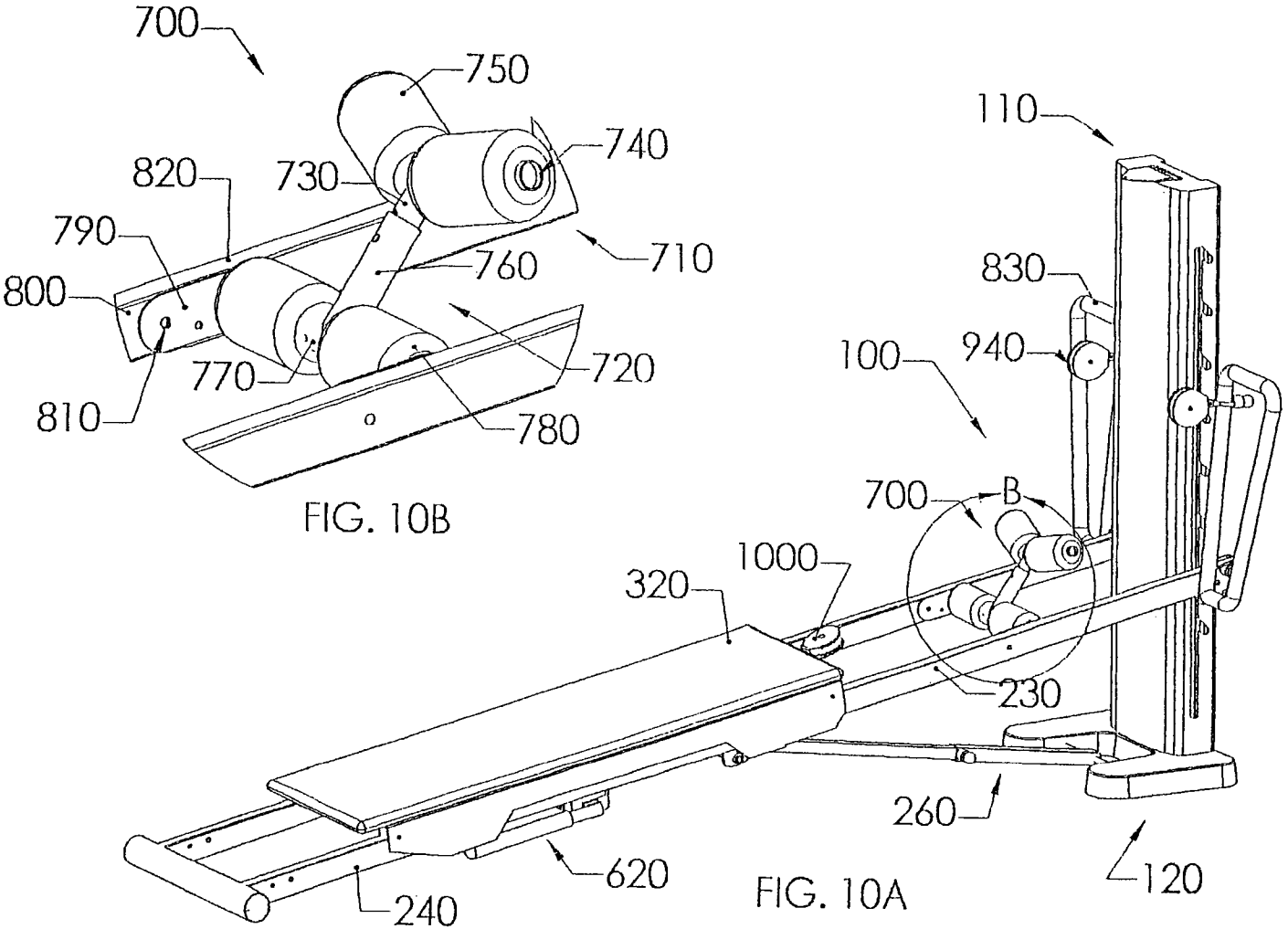
FIG. 10A is a perspective view of the device shown in FIG. 1 and shows a folding foot platform in an unfolded state.
FIG. 10B is an enlarged perspective view of the area B of FIG. 10A and details the foot platform.
Figures 11A, 11B:
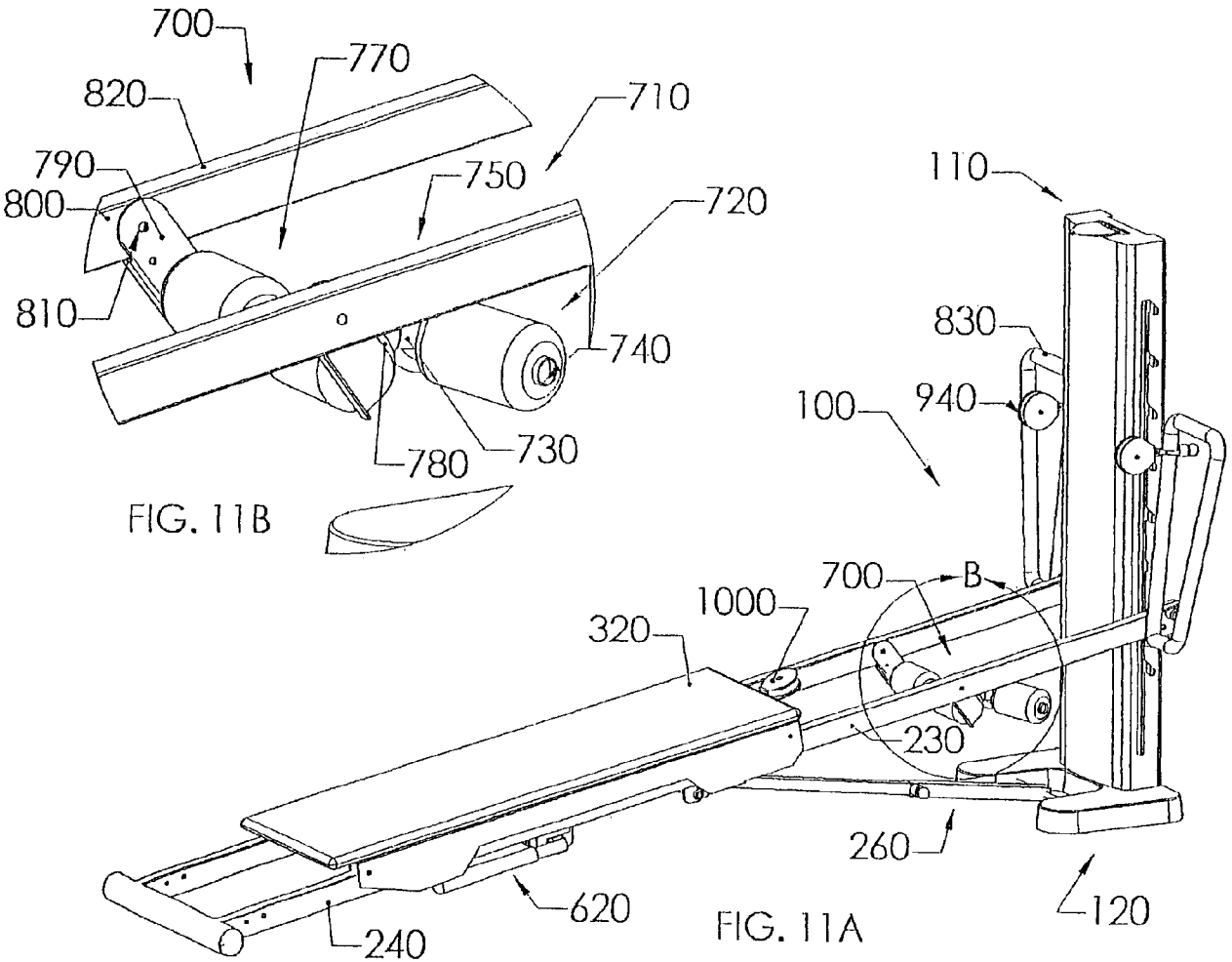
FIG. 11A is a perspective view of the device similar to FIG. 10A and shows the folding foot platform in a folded state.
FIG. 11B is an enlarged perspective view of the area B of FIG. 11A and details the folding foot platform in a folded state.

With reference to FIGS. 7A and 7B, an embodiment of a padded foot support accessory 580 that may be easily attached to and removed from the distal ends 420 of the lower rails 240 will now be described. The padded foot support accessory 580 includes a foot pad 590 supported by and connected to opposite brackets 600 for connecting the padded foot support accessory 580 to the distal ends 420 of the lower rails 240. The brackets 600 carry spring-loaded pull pins 610 for attaching the padded foot support accessory 580 to and removing it from pin holes 415 at the distal ends 420 of the lower rails 240. In the position shown, the padded foot support accessory 580 is supported by the brackets 600 on the lower rails 240 and the cross member 440.

With reference to FIGS. 8A-9B, an embodiment of a dip bar accessory 620 that may be used with the exercise device 100 will now be described. The dip bar accessory 620 includes handles 630 with grips 640 attached at ends 650 to perpendicularly extending cross rails 660. The handles 630 may have a generally cylindrical, tubular configuration and the cross rails 660 may have a generally square cross-sectional, hollow configuration. The cross rails 660 slide laterally in and out within brackets 670 mounted to the lower rails 240. The brackets 670 have rectilinear cut outs 680 that the cross rails 660 slide within. A locking mechanism (not shown) of the brackets 670 (or as one or more separate members) allow the handles 630 to be moved laterally outward and rotated 90 degrees upward to the unretracted state shown in FIGS. 8A and 8B, and moved laterally inward and rotated 90 degrees downward to the retracted state shown in FIGS. 9A and 9B. In the unretracted, active state shown in FIGS. 8A and 8B, the cross rails 660 are low enough and the handles 630 are disposed laterally outward far enough so as to avoid contact with the support frame 330 of the user support platform 320 when the platform 320 is in motion. In the retracted state shown in FIGS. 9A and 9B, the handles 630 are disposed beneath and parallel to the lower rails 240. In this position, the handles 630 are also are disposed laterally inward far enough so as to avoid contact with the support frame 330 of the user support platform 320 when the platform 320 is in motion.

With reference to FIGS. 10A-11B, an embodiment of a folding foot platform 700 that may positioned in an unretracted or unfolded state (FIGS. 10A, 10B) and a retracted or folded state (FIGS. 11A, 11B) will now be described. The folding foot platform 700 includes a generally Y-shaped member 710 telescoped within an upside-down generally T-shaped member 720. The generally Y-shaped member includes a cylindrical main insertion tube 730 and upwardly angled foot retaining tubes 740. Cylindrical toe cushions 750 cover the upwardly angled foot retaining tubes 740. The upside-down generally T-shaped member 720 includes a main receiving tube 760 and outwardly perpendicularly extending cylindrical heel support tubes 770. Cylindrical heel cushions 780 cover the heel support tubes 770. The main insertion tube 730 is slidably received within the main receiving tube 760 and may be locked relative thereto with a pull pin within holes in the tubes 730, 760. Outer lateral ends of the heel support tubes 770 are fixedly connected to pivoting brackets 790. The pivoting brackets 790 are pivotally connected to inner sides 800 of the upper rails 230 through pivot pins 810. In the unretracted state shown in FIGS. 10A, 10B, a user may position his or her feet into the folding foot platform 700 by putting toes underneath the toe cushions 750 and heels on the heel cushions 780. The brackets 790, and, hence, the folding foot platform 700, are prevented from pivoting farther upward than the state shown in FIGS. 10A and 10B by an upper flange 820 of the upper rails 230. When not in use, the folding foot platform 700 may be pivoted or folded to an out-of-the-way, retracted or folded state shown in FIGS. 11A, 11B.

Figures 12A, 12B:
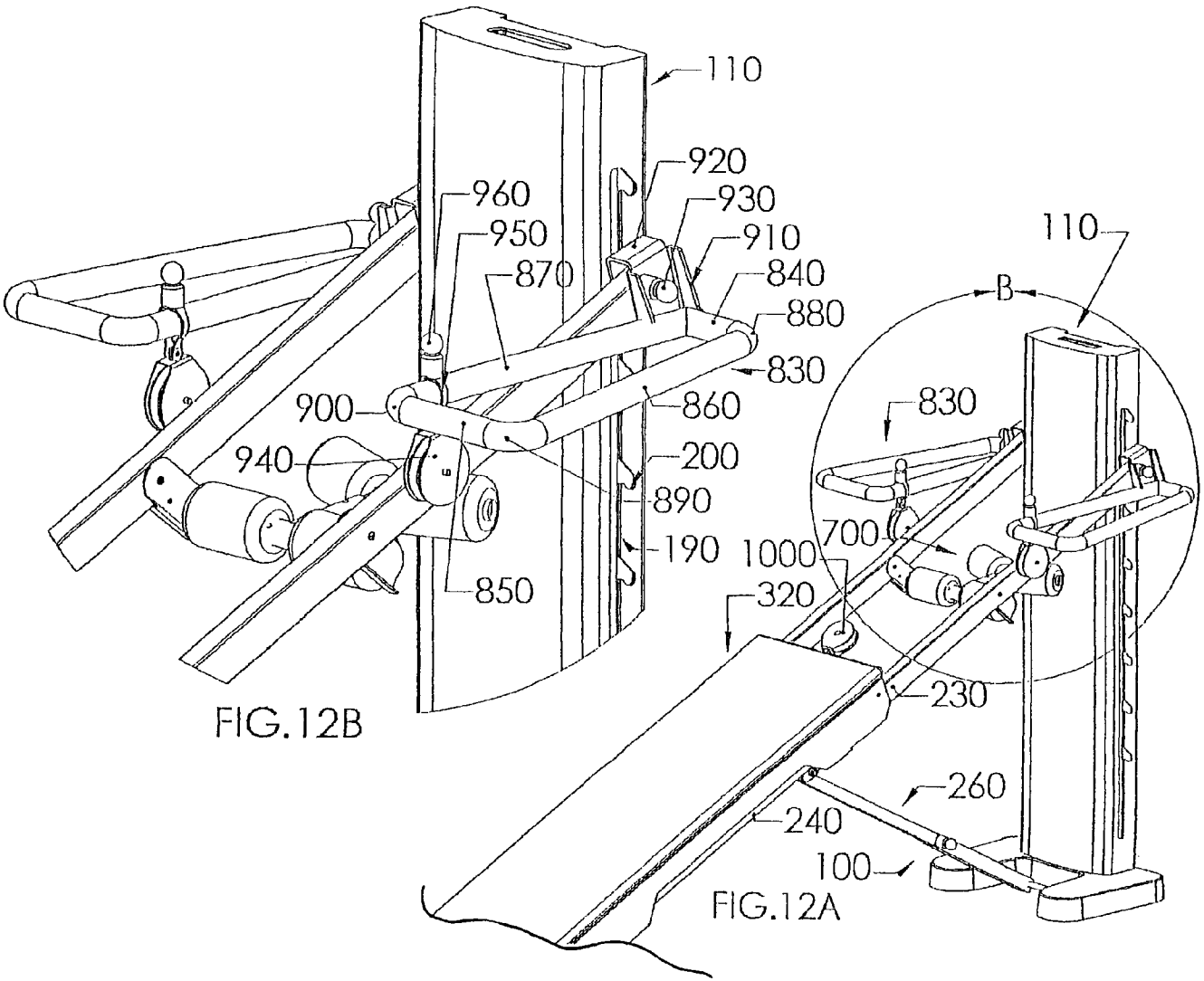
FIG. 12A is a perspective view of the device shown in FIG. 1 and shows folding, combination pulley-support and pull-up bars in a folded down or pull-up state.
FIG. 12B is an enlarged perspective view of the area B of FIG. 12A and details the folding, combination pulley-support and pull-up bars in a folded down or pull-up state.

With reference to FIGS. 1, 12A, and 12B, an embodiment of folding, combination pulley-support and pull-up bars 830 will now be described. In the embodiment shown, each bar 830 has a trapezoidal configuration and includes the following main sections: a short, straight, proximal tubular section 840, a straight, distal tubular section or pull-up handle 850 parallel to and longer than the proximal tubular section 840, an elongated, straight, angled, outer tubular section 860, and an elongated, straight, inner tubular section 870 perpendicular to the proximal tubular section 840 and the distal tubular section 850. An outer end of the proximal tubular section 840 is connected to a proximal end of the outer tubular section 860 by a tubular proximal outer elbow 880. An outer end of the distal tubular section 850 is connected to a distal end of the outer tubular section 860 by a tubular distal outer elbow 890. An inner end of the distal tubular section 850 is connected to a distal end of the inner tubular section 870 by a tubular distal inner elbow 900. An inner end of the proximal tubular section 840 is connected to a proximal end of the inner tubular section 870 by a pivoting bracket 910. The pivoting bracket 910 is pivotally connected to an attachment bracket 920, which is attached to the proximal end 220 of the upper rails 230. The pivoting bracket 910 carries a spring-loaded pull pin 930. The attachment bracket 920 may include a vertical pin hole, a horizontal pin hole, and a collapsing pin hole.

For normal use, the bars 830 may be moved to the position shown in FIG. 1 and locked into place using the pull pin 930 and the vertical pin hole on the attachment bracket 920. For performing chin ups, the bars 830 may be moved to the position shown in FIGS. 12A, 12B and locked into place using the pull pin 930 and the horizontal pin hole on the attachment bracket 920. For collapsing the exercise device 100, the bars 830 may be moved to the position shown in FIG. 13, where the bars 830 are parallel to the upper rails 230 and locked into place using the pull pin 930 and the collapsing pin hole on the attachment bracket 920.

Pulleys 940 are slidably attached to the bars 830. Each pulley 940 includes a collar 950 and a spring-loaded pull pin 960. An exerciser may move each pulley 940 to a desired position on the bar 830 by pulling on the pull pin 960, sliding the pulley 940 via the collar 950 to a desired position on the bar 830, and releasing the pull pin 960 to lock the pulley 940 in place on the bar 830. It should be noted, the pulley 940 may be slid onto sections or elbows other than the inner tubular section 870.

A connector extends through the pulleys 940 and connects to the user support platform 320. The connector may be of any suitable well-known type, but shown by way of example 1 is a cable 970. The cable 970 includes handles 980 (connected via links 990) at each end and extends through the pulleys 940 positioned on the combination pulley-support and pull-up bars 830 and loops through a third pulley 1000 attached to the user support platform 320. The third pulley 1000 is positioned along the lateral centerline of the user support platform 320. This position allows for unilateral (i.e. one arm), bilateral (i.e., two arm) and static equilibrium (i.e. holding the user support platform 320 suspended by keeping a constant force on each handle 980) use.

The cable 970 and the handles 980 may hang from attachment member 1002 (FIG. 4A) when not in use for storage purposes. The attachment member 1002 may also be used for connecting a separate pulley and leg ankle cuff.

The cable 970 should preferably be of sufficient length to extend through the pulleys 940 and allow the exerciser to grasp one or both of the handles 980 while the exerciser is on the user support platform 320 and the user support platform 320 is at rest.

In an alternate embodiment, the connector may be two separate cables extending through the pulleys 940 with each cable fixedly attached to the user support platform 320.

Figure 13:
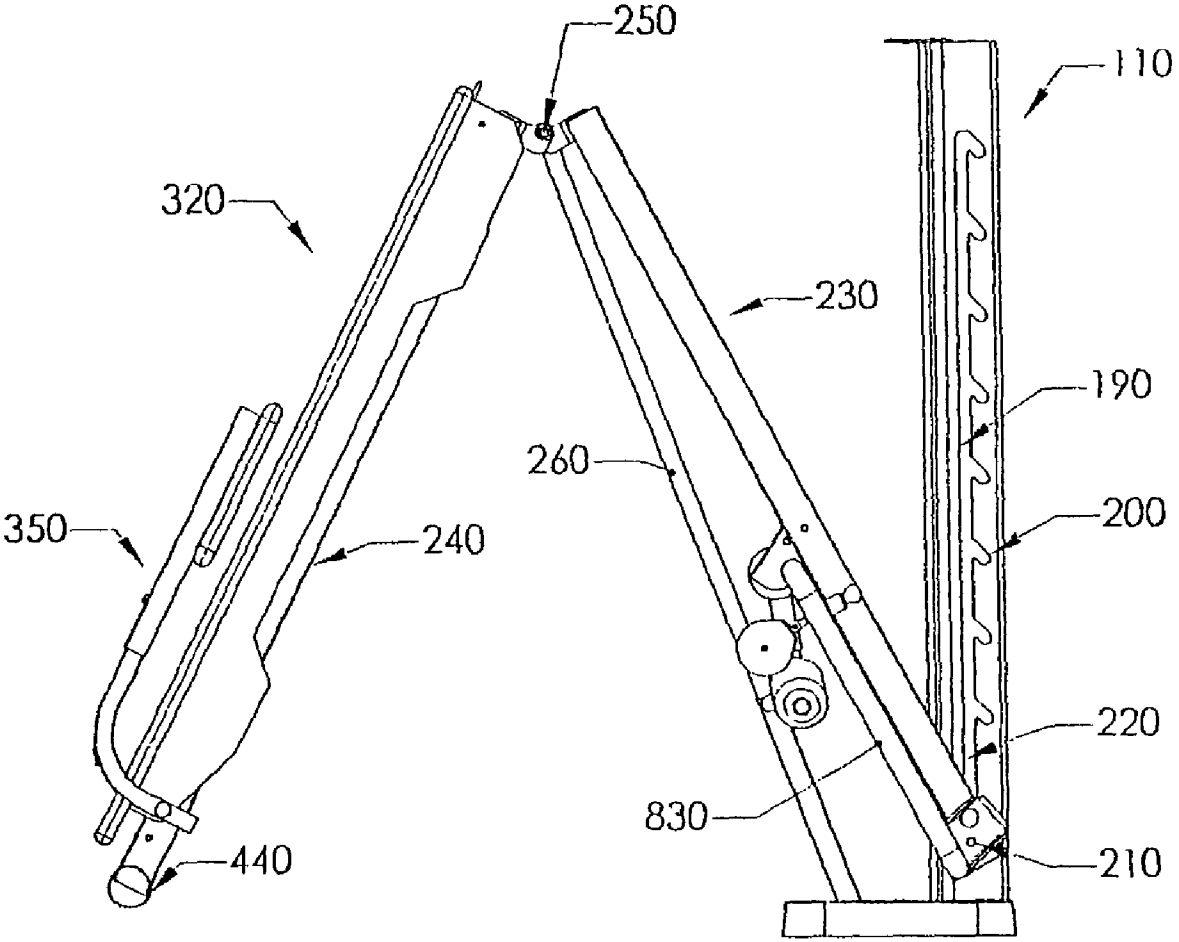
FIG. 13 is a right side elevational view of the exercise device shown in FIG. 1 in a semi-folded state.
Figure 14:
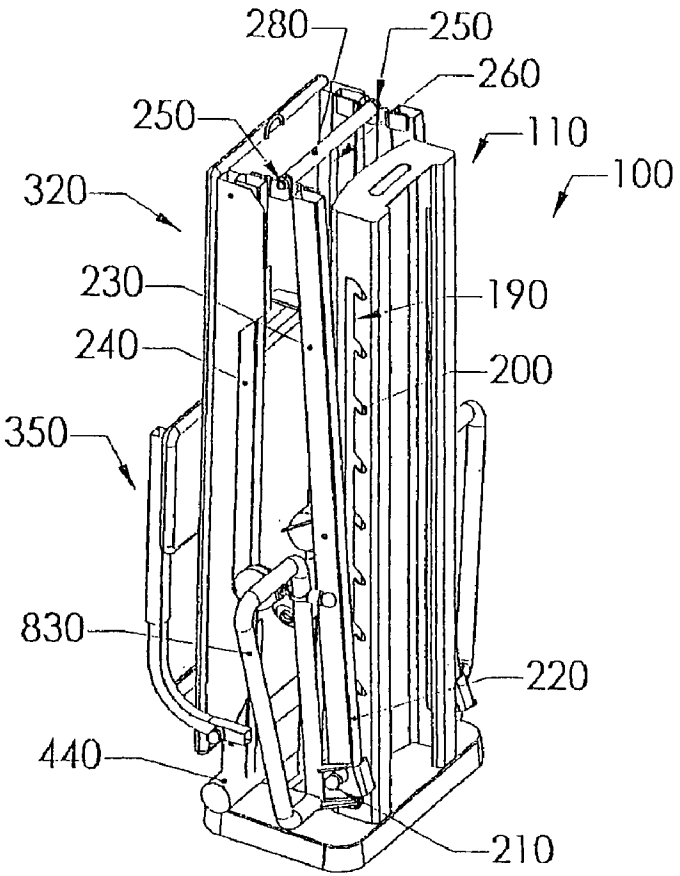
FIG. 14 is a rear perspective view of the exercise device shown in FIG. 1 in a folded state.

With reference to FIGS. 13 and 14, the collapsible or foldable nature of the exercise device 100 will now be described. FIG. 13 shows the collapsible exercise device 100 in a semi-folded state. The slide bars 210 at the proximal ends 220 of the upper rails 230 are lowered to the bottom of the tower level tracks 190 of the vertical support tower 110, and the squat stand 350 is folded over onto the user support platform 320. The rail pivot points 250 and the upper pivot bar 280 are then drawn up away from the floor while rollers on the cross member 440 roll along the floor. The exercise device 100 continues to be folded until the vertical support tower 110, the strut 260, the upper rails 230, the lower rails 240, the user support platform 320, the squat stand 350, and the combination pulley-support and pull-up bars 830 are substantially parallel as shown in FIG. 14. It should be noted that in this position, the user support platform 320 may be rolled up the lower rails 240 and off of the collapsed exercise device 100. To unfold the exercise device 100, the rollers on the cross member 440 at distal ends 420 of the lower rails 240 are rolled along the floor away from the vertical support tower 110. Once the upper rails 230 and the lower rails 240 are extended along the floor 52, the slide bars 210 at the proximal ends 220 of the upper rails 230 are raised via the proximal ends 220 of the upper rails 230 just above a desired height and lowered into tower level hooks 200 at the desired height. The squat stand 350 may then be folded to the position shown in FIG. 1.

In use, the exerciser positions himself or herself on the user support platform 320 and grasps one or both of the handles 980. The exerciser then draws one or both of the handles 980 toward the exerciser and by doing so transports the user support platform 320 up along the lower rails 240 and upper rails 230.

By varying the height of the proximal ends 220 of the upper rails 230 on the tower level hooks 200 of the vertical support tower 110, the angle θ (shown in FIG. 2) may be adjusted. The adjustment of this angle θ alters the percentage of the exerciser's weight which the exerciser's muscles are moving. This allows for adjustment of the intensity of the exerciser's workout. Weight bars (not shown) may be added to the user support platform 320 so that weight plates (not shown) may be positioned on the weight bars, thus adding to the weight propelled by the exerciser's muscles.

The exerciser may vary the position of the pulleys 940 on the combination pulley-support and pull-up bars 830 in the manner described above. For example, the pulleys 940 may be raised or lowered on the inner tubular sections 870 so that the handles 980 and pulling motion are at a more comfortable orientation or to work different muscle groups. The pulleys 940 may be moved to the outer tubular sections 860 (or other sections) for a wider grip and motion of the handles 980 or to work different muscle groups.

An exerciser may also vary the resistance while working upper body muscles by positioning him or herself on the user support platform 320 with the exerciser's feet on the squat stand 350 or floor. The legs and lower body then provide assistance in moving the user support platform 320, lessening the load on the upper body muscles. The exerciser may also use the squat stand 350 to perform the squat exercise for the lower body muscles.

In an alternate embodiment, an exerciser may lie on the user support platform 320 with the exerciser's feet positioned in the foot platform 700 as described above. By bending the exerciser's legs, the exerciser draws the user support platform 320 up along the rails 230, 240. The exercise may also perform sit ups on the user support platform 320 by securing his or her legs in the foot platform 700. In this embodiment, the squat stand 350 and folding platform 260 may be replaced with the padded foot support accessory 580 to support the feet.

In a further embodiment, the squat stand 350 and folding platform 260 may be replaced with the push-up bar accessory 500. The exerciser performs push ups using the push-up bar accessory 500 with his or her feet on the floor, and the chest over the distal part of the lower rails 240. The exerciser may also lie on the user support platform 320 and use the push-up bar accessory 500 to perform a military press or similar exercise.

In another embodiment, the exerciser may lie on the user support platform 320, grip the handles 630 of the dip bar accessory 620 (FIGS. 8A, 8B), and perform dips, exercising the arms and chest.

Furthermore, an exerciser may lower the combination pulley-support and pull-up bars 830 to the position shown in FIGS. 12A, 12B as described above, position himself or herself on the user support platform 320, and grasp the handles 850. By drawing the exerciser toward the handles 850, the exerciser is exercising additional muscle groups.

Figure 15:
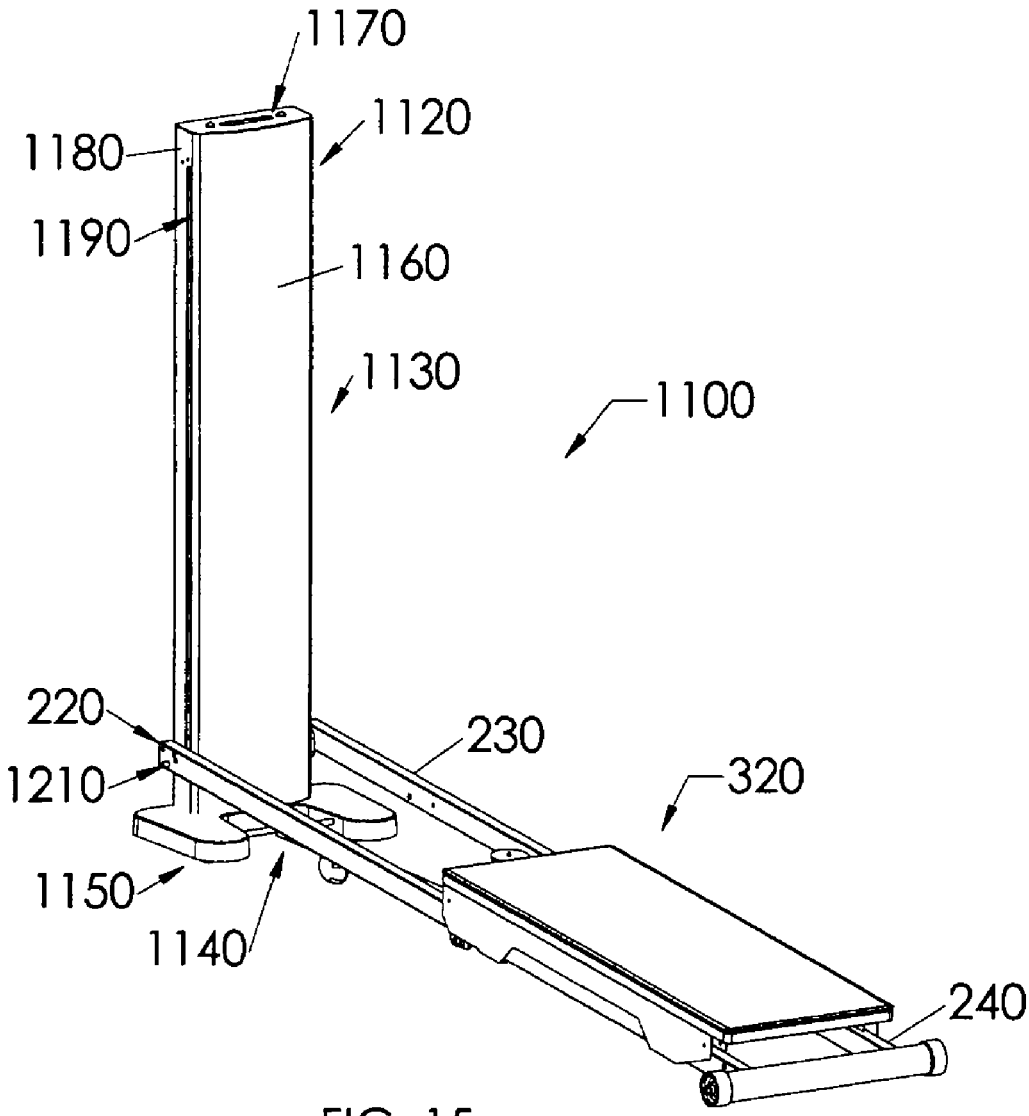
FIG. 15 is a perspective view of an embodiment of exercise device similar to the embodiments of the exercise devices shown in FIGS. 1-14, except components of the exercise devices shown in FIGS. 1-14 are removed and the exercise device of FIG. 15 includes an automatic lift mechanism for automatically setting the height and angle of the rails and user support platform.
Figure 16:
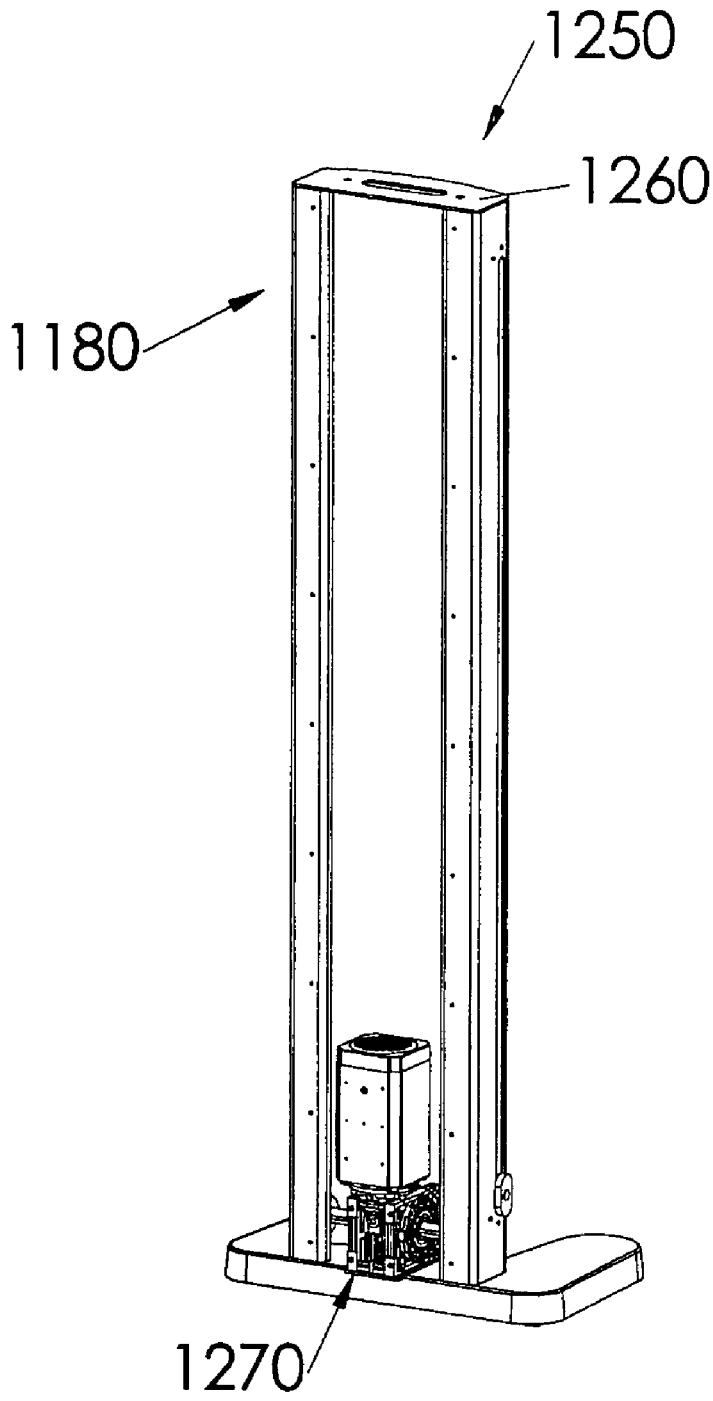
FIG. 16 is a perspective view of an embodiment of the internal construction of the tower illustrated in the exercise device of FIG. 15.
Figure 17:
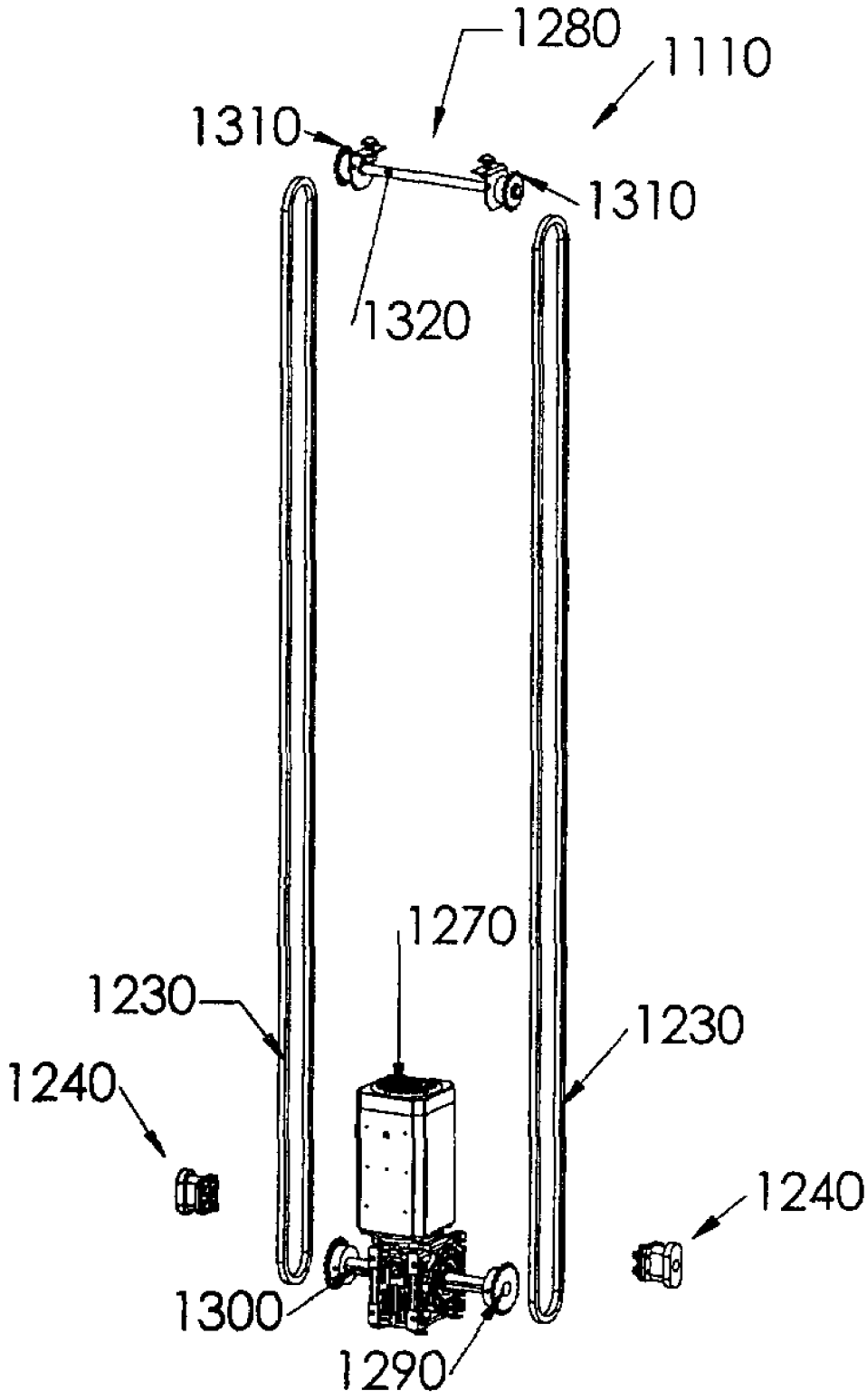
FIG. 17 is a perspective view of an embodiment of an automatic lift mechanism of the exercise device of FIG. 15.

With reference to FIGS. 15-17, an alternative embodiment of an exercise device 1100 will now be described. The exercise device 1100 is similar to the exercise devices shown and described above with respect to FIGS. 1-14, except the exercise device 1100 includes an automatic lift mechanism 1110 (FIG. 17) to set the height and angle of the rails 230, 240 and user support platform 320. This eliminates the need for a user to manually set the height and angle of the rails 230, 240 and user support platform 320 by lifting or lowering the rails 230, 240 and user support platform 320, sliding the inwardly extending slide bars 210 up or down in the tower level tracks 190, and setting the bars 210 in corresponding tower level hooks 200 as described above with respect to FIGS. 1 and 2.

The exercise device 1100 includes a tower 1120 with a tower housing 1130 extending from an intermediate base section 1140 of a base 1150. The tower housing 1130 includes a front vertical face 1160, a rear vertical face 1170, and opposite symmetric sides 1180. The sides 1180 include elongated vertical tracks 1190. Slide bars 1210 extend inwardly from proximal ends 220 of the upper rails 230. The inwardly extending slide bars 1210 are coupled to chains 1230 (FIG. 17) of the automatic lift mechanism 1110 through couplers 1240.

With reference to FIG. 16, an inner frame assembly 1250 of the tower 1120 is shown. The inner frame assembly 1250 includes the sides 1180 extending from the base 1150 and a horizontal cross support 1260 spanning the distance between the sides 1180 at a top of the frame assembly 1250. Near a bottom of the frame assembly, between the sides 1180, a driving mechanism 1270 (e.g. motor with attached power cord) of the automatic lift mechanism 1110 is disposed.

With reference to FIG. 17, the automatic lift mechanism 1110 of the exercise device 1110 will be described in more detail. The automatic lift mechanism 1110 includes the opposite chains 1230, an upper pulley assembly 1280, and the driving mechanism 1270, which includes lower pulleys 1290 and shafts 1300. The upper pulley assembly 1280 includes opposite pulleys 1310 and shaft 1320. In use, after the driving mechanism 1270 is plugged into a wall outlet, the automatic lift mechanism 1110 is actuated to raise or lower the height and angle of the rails 230, 240 and user support platform 320. This may be accomplished with a three-way toggle switch that may be set to an up or raise position for causing the driving mechanism 1270 to rotate in one direction to increase the height and angle of the rails 230, 240 and user support platform 320, may be set to an down or lower position for causing the driving mechanism 1270 to rotate in an opposite direction to decrease the height and angle of the rails 230, 240 and user support platform 320, and may be set to a third neutral position where the driving mechanism 1270 is off and the height and angle of the rails 230, 240 and user support platform 320 is locked in place. Varying the height and angle of the rails 230, 240 and user support platform 320 varies the portion of the exerciser's own body weight that the user exerts muscle force against during use of the exercise device 1100. The automatic lift mechanism 1110 eliminates the need for a user to manually set the height and angle of the rails 230, 240 and user support platform 320 by lifting or lowering the rails 230, 240 and user support platform 320, sliding the inwardly extending slide bars 210 up or down in the tower level tracks 190, and setting the bars 210 in corresponding tower level hooks 200 as described above with respect to FIGS. 1 and 2.

Figure 18:
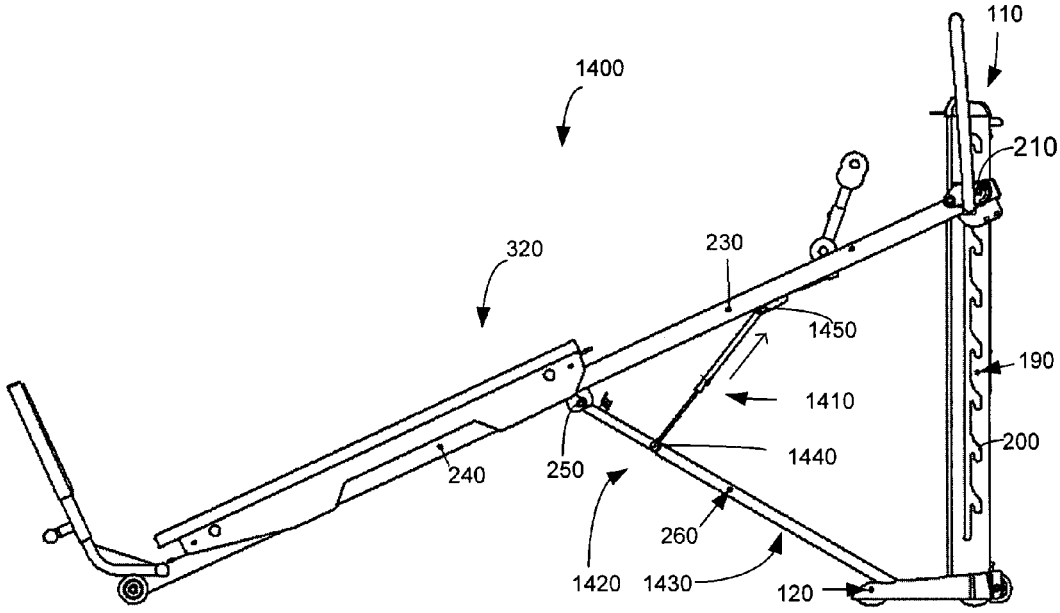
FIG. 18 is a right side elevational view of another embodiment of exercise device similar to the embodiments of the exercise devices shown in FIGS. 1-17, except the exercise device includes a non-motorized lift-assist mechanism to assist the user in setting the height and angle of the rails and user support platform.

With reference to FIG. 18, an alternative embodiment of an exercise device 1400 will now be described. Elements of the exercise device 1400 that are similar to the elements described above with respect to exercise devices 100, 1100 will be described with like reference numbers. The exercise device 1400 is similar to the exercise devices shown and described above with respect to FIGS. 1-17, except the exercise device 1100 includes a non-motorized lift-assist mechanism 1410 to assist the user in setting the height and angle of the rails 230, 240 and user support platform 320. This assists the user and reduces the work required to manually set the height and angle of the rails 230, 240 and user support platform 320 when lifting or lowering the rails 230, 240 and user support platform 320, sliding the inwardly extending slide bars 210 up or down in the tower level tracks 190, and setting the bars 210 in corresponding tower level hooks 200 as described above with respect to FIGS. 1 and 2.

Similar to the exercise device 100, the exercise device 1400 includes a strut 260 that is pivotally connected to the base 120 at one end and is pivotally connected to the rail pivot points 250 at an opposite end. The strut 260 includes an upper half 1420 and a lower half 1430. At approximately a mid-point of the upper half 1420, a bottom end of the non-motorized lift-assist mechanism 1410 is pivotally attached to the strut 260 at pivot point 1440. An opposite end of the non-motorized lift-assist mechanism 1410 is pivotally attached to approximate mid-points of the upper rails 230 though a pivot bar 1450 similar to pivot bar 280 (FIG. 3) discussed above. In the embodiment shown, the non-motorized lift-assist mechanism 1410 is a push-type gas spring. In alternative embodiments, other types of non-motorized lift-assist mechanisms are used such as, but not by way of limitation, standard coil springs (extension and/or compression as needed). The push-type gas spring provides an upward angled force in the direction of the arrow shown, reducing the upward force and work required by a user when raising the height and increasing the angle of the upper rails 230 relative to the ground. This upward force also makes it easier to lower the height and reduce the angle of the upper rails 230 because it reduces the lifting work required of the user. In alternative embodiments, the non-motorized lift-assist mechanism 1410 is connected to the strut 260 and/or the rails 230, 240 at pivot points other than those shown and/or the non-motorized lift-assist mechanism 1410 is disposed at an angle other that that shown.

Figure 19:
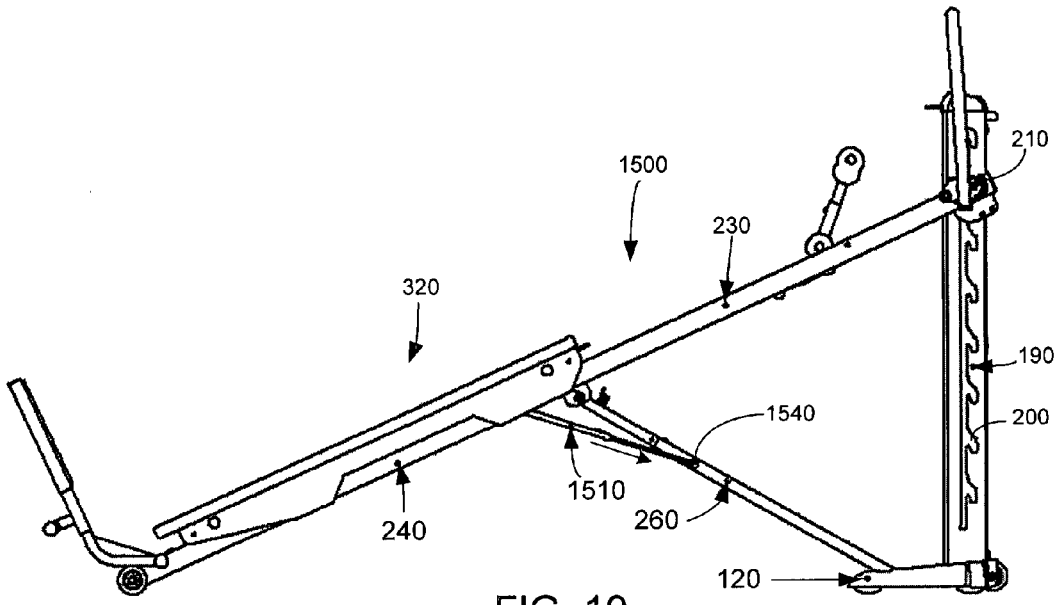
FIG. 19 is a right side elevational view of a further embodiment of exercise device, which is similar to the embodiments of the exercise device shown in FIG. 18, except an alternative embodiment of a non-motorized lift-assist mechanism is shown.
Figures 20A, 20B, 20C, 20D:
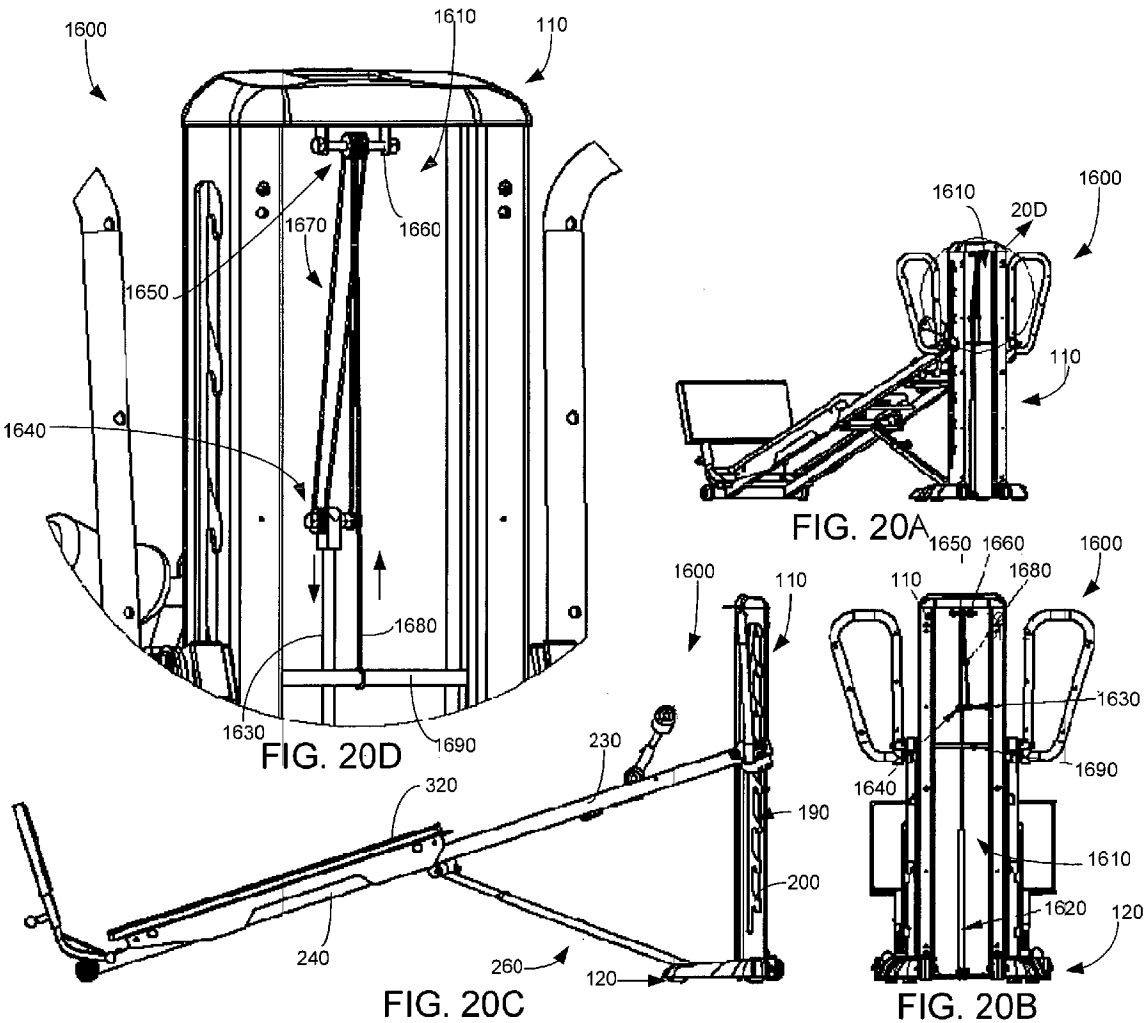
FIG. 20A is a rear perspective view of a further embodiment of exercise device, which is similar to the embodiments of the exercise devices shown in FIGS. 18 and 19, except an alternative embodiment of a non-motorized lift-assist mechanism is shown.
FIG. 20B is a rear elevational view of the exercise device illustrated in FIG. 20A.
FIG. 20C is a right side elevational view of the exercise device illustrated in FIG. 20A.
FIG. 20D is an enlarged view of the area 20D shown in FIG. 20A.

FIG. 19 illustrates a further embodiment of an exercise device 1500. The exercise device 1500 is similar to the exercise device shown in FIG. 18, except an alternative embodiment of a non-motorized lift-assist mechanism 1510 is shown. Steve The non-motorized lift-assist mechanism 1510 includes a pull-type gas spring pivotally mounted between strut 260 at pivot point 1540 and lower rails 230 though a pivot bar (now shown). The pull-type gas spring provides a downward angled force in the direction of the arrow shown. This pulls on the lower rails 230 in the direction of the arrow, reducing the upward force and work required by a user when raising the height and increasing the angle of the upper rails 230 relative to the ground. This downward angled force also makes it easier to lower the height and reduce the angle of the upper rails 230 because it reduces the lifting work required of the user. In alternative embodiments, the non-motorized lift-assist mechanism 1510 is connected to the strut 260 and/or the rails 230, 240 at pivot points other than those shown and/or the non-motorized lift-assist mechanism 1510 is disposed at an angle other that that shown.

FIGS. 20A-20D illustrate a still further embodiment of an exercise device 1600. The exercise device 1600 is similar to the exercise devices shown in FIGS. 18 and 19, except an alternative embodiment of a non-motorized lift-assist mechanism 1610 is shown. Instead of the non-motorized lift-assist mechanism being incorporated between the strut 260 and the rails 230, 240, the non-motorized lift-assist mechanism 1610 is incorporated within the tower 110. The non-motorized lift-assist mechanism 1610 includes a pull-type gas spring 1620, a tension shaft 1630, a lower pulley assembly 1640, an upper pulley assembly 1650, a top shaft 1660, pulley belt arrangement 1670, a cable 1680, and a rail shaft 1690. The pull-type gas spring 1620 is mounted at a bottom end of the base 120. At an opposite end, the pull-type gas spring 1620 is connected to the lower pulley assembly 1640 through the tension shaft 1630. The pulley belt arrangement 1670 couples the lower pulley assembly 1640 to the upper pulley assembly 1650. The upper pulley assembly 1650 is mounted near an inside top of the tower 110 via the top shaft 1660. The upper pulley assembly 1650 is coupled to the rail shaft 1690 via cable 1680. The rail shaft 1690 is connected to, is integral with, and/or forms slide bar(s) 210.

The non-motorized lift-assist mechanism 1610 will now be described in use. The pull-type gas spring 1620 pulls the tension shaft 1630 away from the top shaft 1660, in the direction of the left arrow shown. Through the pulley assemblies 1640, 1650, the pulley belt arrangement 1670, and the cable 1660, the motion of the tension shaft 1630 downwards creates corresponding motion in the rail shaft 1690 upwards (see right arrow) that is three (3) times the motion of the tension shaft 1630. This requires three (3) times the force in the gas spring 1620. In alternative embodiments, other numbers of pulley assemblies are used. Varying the number of pulley assemblies has a corresponding effect on the motion in the rail shaft 1690 relative to the tension shaft 1630 and required force in the gas spring 1620. For example, with more pulley assemblies, the rail shaft could move four (4) times the motion of the tension shaft 1630, requiring four (4) times the force in the gas spring 1620. The upward pulling on the rail shaft 1690 by the cable 1660 via the pulley assemblies 1640, 1650 and the pulley belt arrangement 1670 reduces the upward force and work required by a user when raising the height and increasing the angle of the upper rails 230 relative to the ground. This also makes it easier to lower the height and reduce the angle of the upper rails 230 because it reduces the lifting work required of the user.

In an alternative embodiment of the non-motorized lift-assist mechanism 1610, instead of the pull-type gas spring 1620, a push-type gas spring is used (cylinder head of the push-type gas spring is attached to the top of the tower). The push-type gas spring pushes the tension shaft 1630 away from the top shaft 1660, in the direction of the left arrow shown. This causes the rail shaft 1690 to move upwards in the direction of the right arrow. The upward pulling on the rail shaft 1690 by the cable 1660 via the pulley assemblies 1640, 1650 and the pulley belt arrangement 1670 reduces the upward force and work required by a user when raising the height and increasing the angle of the upper rails 230 relative to the ground. This also makes it easier to lower the height and reduce the angle of the upper rails 230 because it reduces the lifting work required of the user.

Figure 21A:
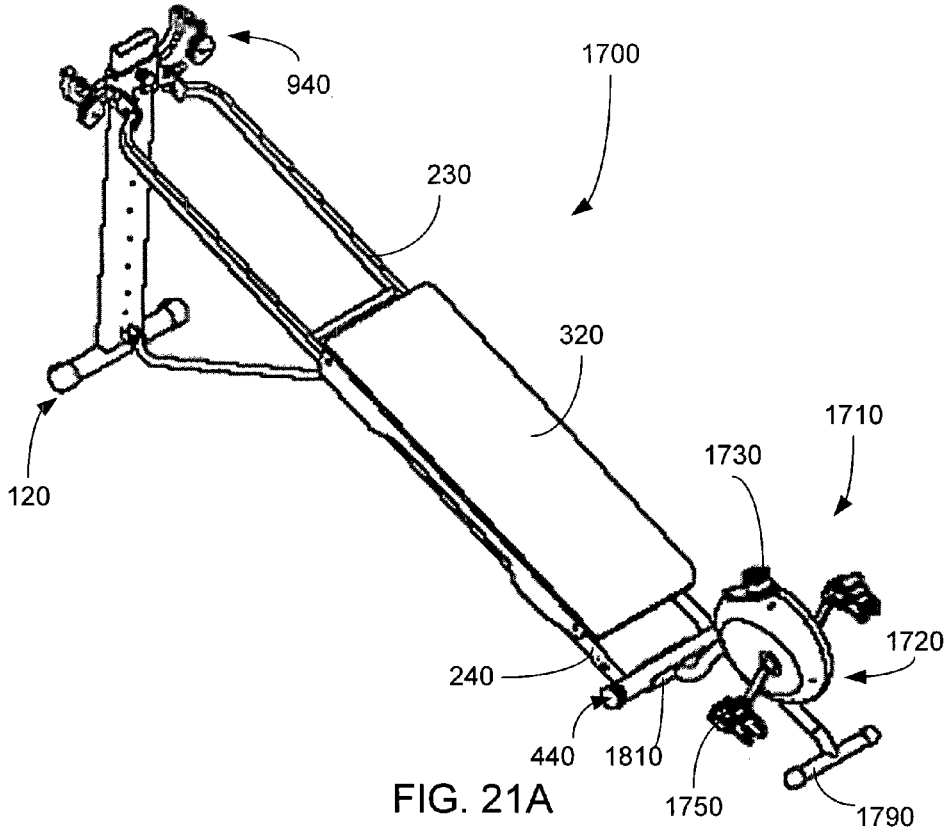
FIG. 21A is front perspective view of another embodiment of an exercise device with a cycling mechanism.
Figure 21B:
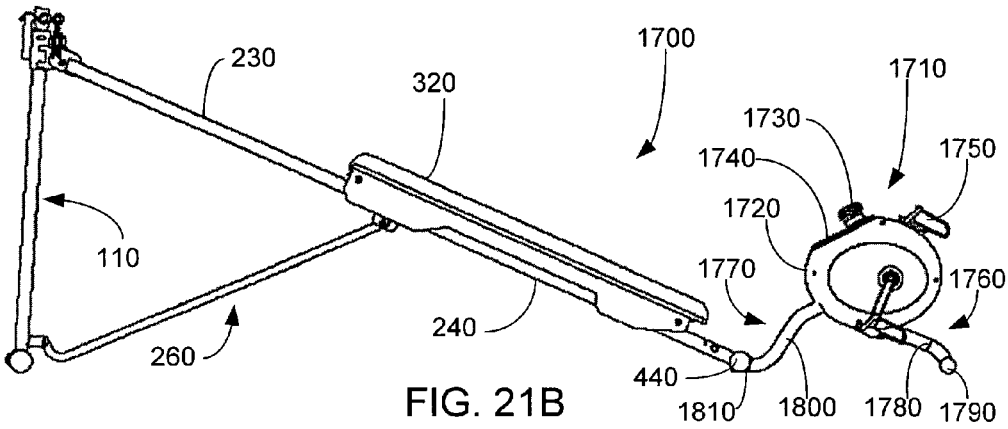
FIG. 21B is left side elevational view of the exercise device and cycling mechanism illustrated in FIG. 21A.

FIGS. 21A and 21B illustrate a still further embodiment of an exercise device 1700 with a cycling mechanism 1710. The exercise device 1700 is a simplified version of the exercise devices shown above with respect to FIGS. 1-20. Although the elements of the exercise device 1700 are not exactly the same as those described above with respect to FIGS. 1-20, many of the elements are similar. Accordingly, similar elements will be identified with the same reference numbers.

The exercise device 1700 includes the cycling mechanism 1710 attached to the cross member 440. The cycling mechanism 1710 includes a housing 1720, a resistance control mechanism 1730 extending from a flat face 1740 of the housing 1720, pedals 1750 extending from opposite sides of the housing 1720 via cranks for cycling pedaling, a front support assembly 1760, and a rear support assembly 1770.

The front support assembly 1760 includes a forwardly extending curved leg 1780 that is aligned longitudinally with the housing 1720. The leg 1780 terminates in a front cross member 1790. The rear support assembly 1770 includes a rearwardly extending curved leg 1800 that is aligned longitudinally with the housing 1720. The leg 1800 terminates in an upwardly concave cuff 1810 that functions as a quick attachment mechanism.

To quickly attach the cycling mechanism 1710 to the exercise device 1700, the cross member 440 is lifted slightly above the ground, the cuff 1810 is positioned underneath the cross member 440, and the cross member 440 is rested on top of the cuff 1810. With the cuff 1810 under the cross member 440, the weight of the user on the exercise device 1700 maintains the cycling mechanism 1710 securely in position relative to the exercise device 1700.

In the embodiment shown, the cycling mechanism 1710 includes an internal magnetic braking mechanism to control resistance during pedaling with the cycling mechanism 1710.

Figure 21C:
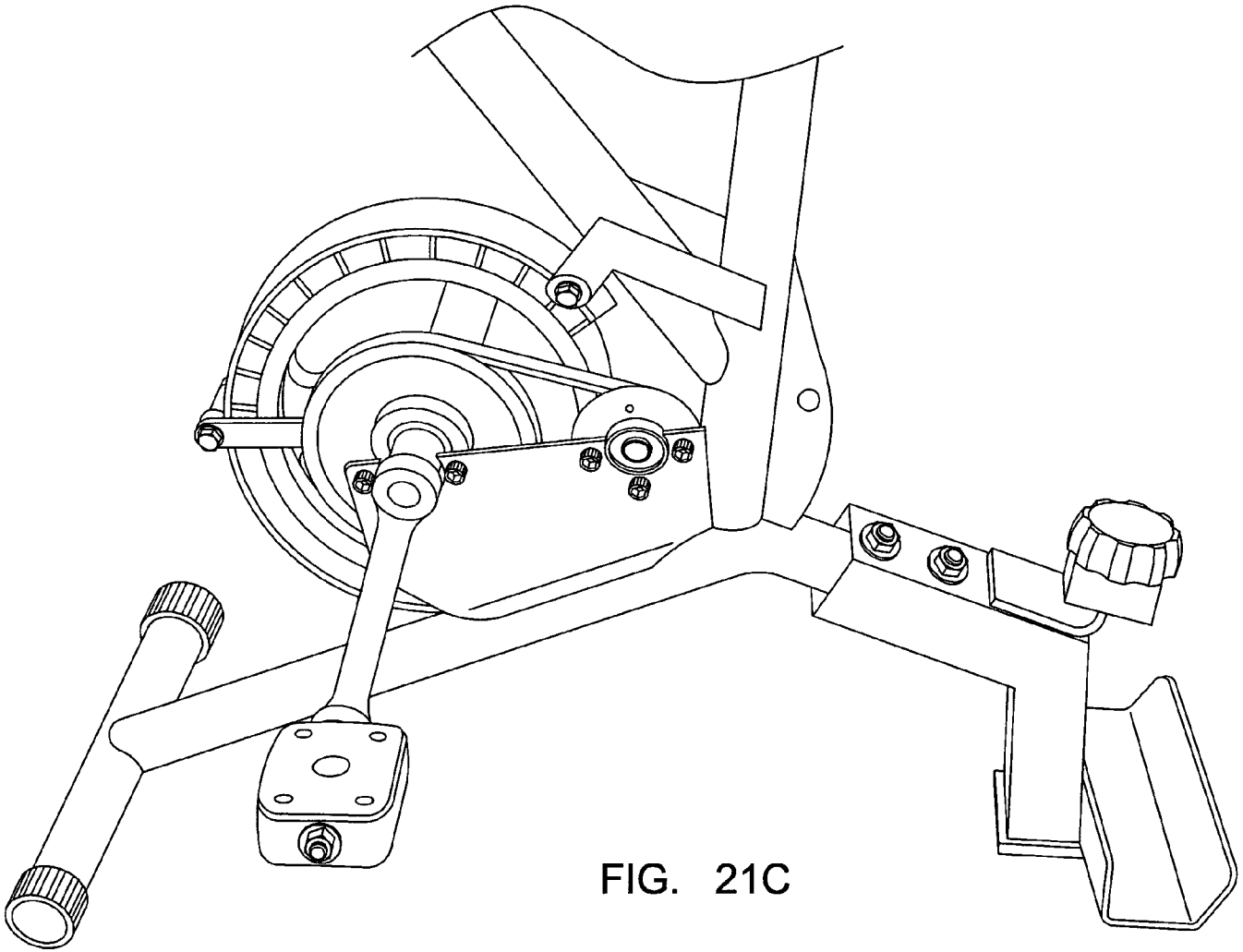
FIG. 21C is perspective view of an embodiment of a two-stage transmission magnetic braking mechanism for the cycling mechanism illustrated in FIGS. 21A and 21B.

With reference to FIG. 21C, an embodiment of the magnetic braking mechanism includes a two-stage transmission. A two stage transmission includes a pedal crank and a large pulley that drives a small pulley on a jack shaft. A second larger pulley on the jack shaft drives a flywheel. The flywheel spins around the crank shaft, making the cycling mechanism 1710, and especially the housing 1720 of the cycling mechanism 1710, very compact and portable. Pedaling resistance is increased by adjusting the resistance control mechanism 1730 correspondingly, causing moving permanent magnets to move closer to the perimeter of the flywheel. Pedaling resistance is decreased by adjusting the resistance control mechanism 1730 correspondingly, causing a cable connected to an arc shaped linkage that supports the magnets to move the magnets farther away from the flywheel. In alternative embodiments, the resistance control mechanism 1730 includes one or more buttons or other inputs for adjusting pedaling resistance.

Figure 21D:
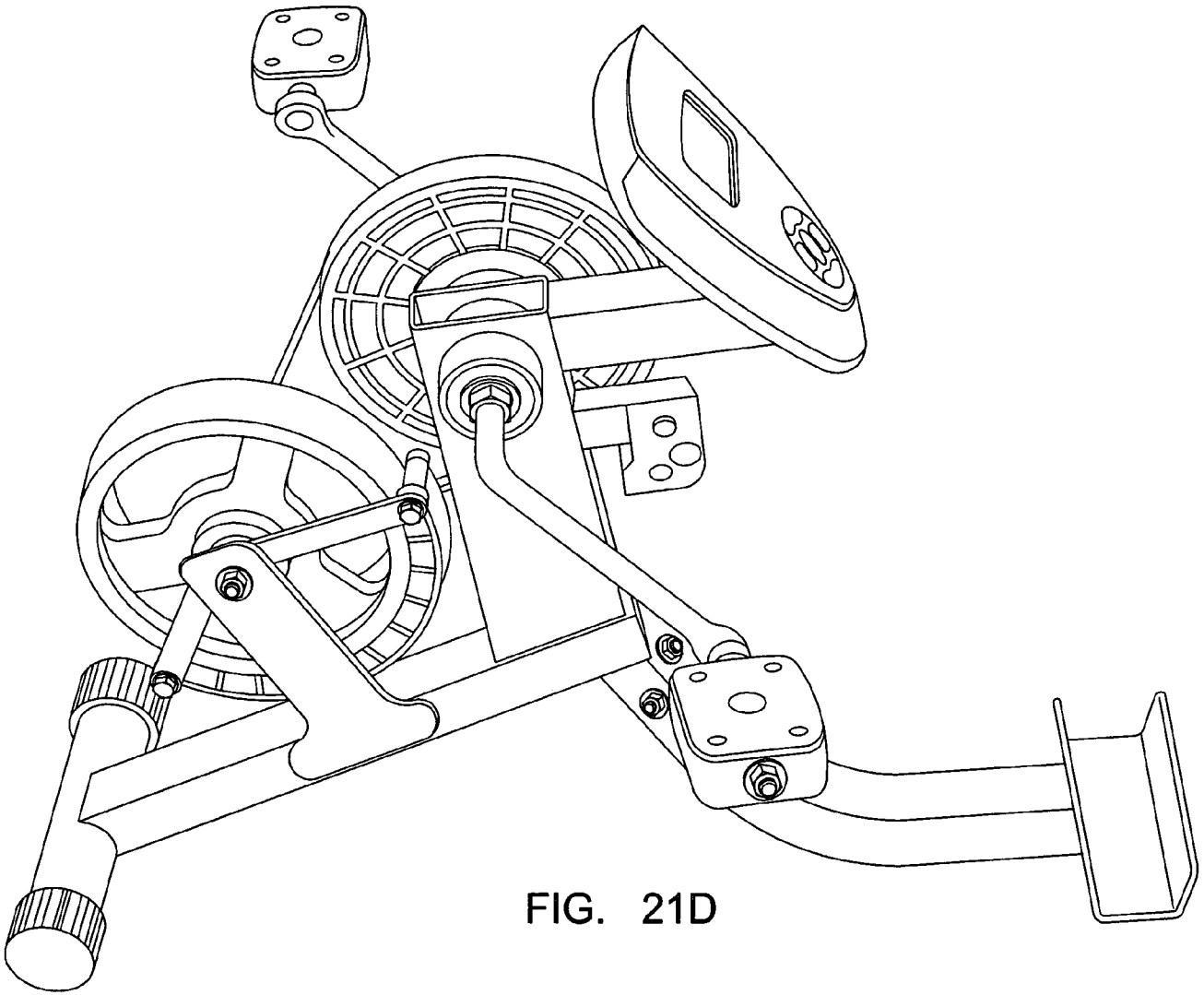
FIG. 21D is a front perspective view of an embodiment of a single-stage transmission magnetic braking mechanism for the cycling mechanism illustrated in FIGS. 21A and 21B.
Figure 21E:
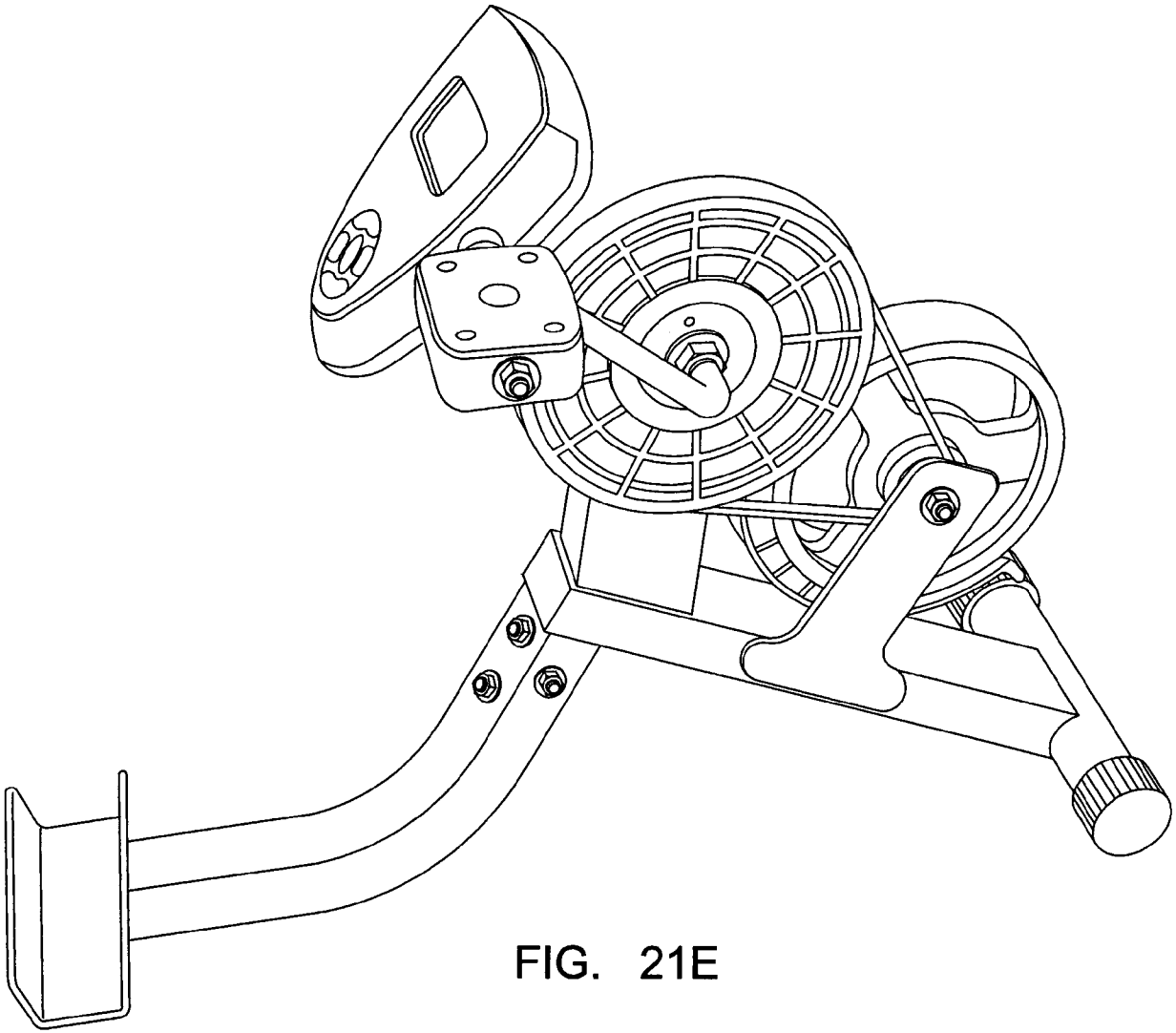
FIG. 21E is a rear perspective view of an embodiment of a single-stage transmission magnetic braking mechanism for the cycling mechanism illustrated in FIGS. 21A and 21B.

With reference to FIGS. 21D and 21E, another embodiment of the magnetic braking mechanism includes a single-stage transmission. The single-stage transmission includes a pedal crank shaft with a large sprocket or pulley that drives a small sprocket or pulley attached to a fly wheel via a chain or belt. This configuration also makes the cycling mechanism 1710, and especially the housing 1720 of the cycling mechanism 1710, very compact and portable. FIGS. 21D and 21E shows an alternative push-button resistance control mechanism where one or more buttons are pushed for adjusting pedaling resistance.

The compact nature of the cycling mechanism 1710 and the quick attachment mechanism make the cycling mechanism 1710 easy to use, easy to attach/detach, and easy to store/use without taking up much space.

In alternative embodiments, the cycling mechanism 1710 includes alternative braking mechanisms such as, but not by way of limitation, a friction brake mechanism.

Although the cycling mechanism 1710 is shown attached to exercise device 1700, in alternative embodiments, the cycling mechanism 1710 is attached to the cross member 440 of the other exercise devices shown and described herein, or other similar exercise devices.

Installation and use of the exercise device 100, 1110, 1400, 1500, 1600, 1700 (hereinafter "exercise device 100") and some of the components for the exercise device 100 will now be described.

Installing the Folding Squat Platform and Telescoping Squat Stand

Align bottom of folding squat platform with lower rails just above base. Using the two holes ½" from the top of the rails, slide the fixed pin into the hole in the outside left rail. Pull the retractable pin on the right side and move the pin over the hole. Release the pin. Move the folding squat platform until the pin engages completely. Align the telescoping squat stand over the folding squat platform tubes until the squat stand pins contact the top of the folding squat platform tubes. Pull the retractable pins and adjust the squat stand to the desired height, then release the pins and raise or lower the squat stand until both pins engage in one of the three adjustment holes in the folding squat platform tubes.

Adjusting the Pulley Locator Brackets

Pulley locator brackets are designed to adjust easily. Simply pull back on the adjustable pin, move the pulley locator bracket to the desired position on the lateral adjustable training (LAT) bars, and allow the pin to engage the slotted hole.

Using the Adjustable Foot Holder

Prior to use, the adjustable foot holder must be rotated to the upright position. Raise the foot holder until the bracket makes contact with the rail snap button. Depress snap button and hold while raising bracket. Continue raising bracket until snap button engages. To begin using the adjustable foot holder, sit on the glideboard 330. Push in the center post snap button and raise the upper foot pad assembly. Place heels past the pads of the lower foot pad assembly. Lower the upper foot pad assembly once feet are in position. Push in the right rail snap button to lower the adjustable foot holder.

Adjusting the LAT Bars

To adjust the LAT bars, pull the pins on the retractable LAT bar to disengage from the rail and lower or raise LAT bars to the desired position. Ensure that the pins engage. Two LAT bar adjustments can be made to accommodate three positions. Normal use: parallel to the tower Pull-Up Position: small angle from the rail Fold up Position: parallel to the bottom of the rail Raising and Lowering the Rail Angle To raise or lower the rail angle, stand alongside the upper rail, facing the tower. Hold the tower with one hand while raising or lowering the upper rail with the other hand. Hint: Push backward slightly on the tower when moving the rails up or down, then pull forward when the desired height is reached and allow the tower crossbar to slip into the desired tower level hook. Any time you wish to have the glideboard 330 free from the pulley cable assembly, simply unfasten the snap hook from the "D" ring, releasing the center cable pulley. Store the center cable pulley in the tower handle as shown. Important: Remember to use ergonomically correct lifting procedures. Maintain spine in a neutral position, knees bent.

Normal Pull-up Fold-up

To Fold the Exercise Device 100

Drop the adjustable foot holder to the down position. To do so, push in the snap button on the inside of the right rail and gently lower the assembly. There is no need to remove the telescoping squat stand and folding squat platform when you move or store the exercise device 100. To fold the folding squat platform, pull the left side retractable pin while pushing the platform gently forward until the retractable pin locks in place in the folded position. Next, adjust the pulley cable pins to the third position on the LAT bars. Ensure that the center pulley is attached to the glideboard 330 "D" ring. Lower the LAT bars to the fold position parallel to the rails. Lower the rails to the bottom position. Push the tower back while you pull the retractable pin on the support strut. When the pin disengages, pull the tower to an upright position. Grab either side of the padded crossbar located in the center of the rails, and pull the rails toward the tower. This will bring the base of the rail to rest on the base of the tower. During this movement, the support strut pin should engage into the folded position. Connect the retainer strap to the glideboard 330 "D" ring to secure exercise device 100 in the upright position. To avoid cable breakage, ensure that cables remain free from contact with hinges, the floor, or wheels. Important: Keep hands, fingers, hair, etc. away from all moving parts. Avoid touching hinges. To move the exercise device 100, stand behind the tower, grasp the tower handle, lean the tower back toward you and roll the exercise device 100 as you would roll a hand truck.

To Unfold the Exercise Device 100 and Return to Use

Pull the Rail Assembly toward the tower. Remove the retainer strap from the glideboard 330 "D" ring. Disengage the retractable support strut knob. Push the lower rails off and away from the base of the tower. Grasp either side of the padded center rail crossbar and allow the rails to unfold slowly away from the tower until the rails are fully extended. Lift the rails to the desired tower level, ensuring that the support strut knob engages. Adjust LAT bars to desired position. To raise the folding squat platform, disengage the retractable pin on the left side and raise the platform until the pin engages in the upright position.

Resistance Chart for Exercise Device 100

The resistance required at each level, taking into consideration the weight of the participant, can be found on the Resistance Chart illustrated in FIG. 22. The Resistance Chart is customized to indicate the exercise load required at each level of exercise device 100. NOTE: This required force is simply the exercise load or amount of external work accomplished to move the glideboard 330 at a specific angle. It does not take into consideration the relative intensity of load when using the pulleys, i.e. knowing how many pounds went up and down the ramp, not how hard it was to pull the weight up and down. The exercise device 100 uses a variable-angle incline plane to create exercise resistance by modifying the user's body weight—the steeper the angle, the more resistance. Simply multiply the user's body weight by the appropriate percentage indicated in the chart. The result of this calculation is the resistance (force) in pounds required to move the glideboard 330. When figuring exercises that incorporate the pulley cables, use 50% of the charted numbers. NOTE: The weight of the glideboard 330 is factored into the resistance chart. Therefore, bodyweight and the level of resistance are the only variables required.

In the following paragraphs, a number of programs for the exercise device 100 will now be described. These programs involve a number of additional aspects of the invention. In the description of some of the programs, a brand name followed by ™ or ® is used to identify the particular program. Some of the additional aspects of the invention described in the following paragraphs include, but not by way of limitation, one or more methods of teaching or instructing, one or more methods of teaching or instructing with respect to an embodiment of the exercise device, one or more methods of using an embodiment of the exercise device, one or more methods of using one or more features of an embodiment of the exercise device, one or more methods of exercising, training, or rehabilitating, and an embodiment of the exercise device. Although the methods in the following paragraphs may be described in a specific order and may be described as including steps performed in a specific order, in one or more alternative embodiments or aspects, one or more of the methods may be performed in a different order than that described and/or one or more steps of one or more of the methods may be performed in a different order than that described. Further, one or more of the methods and/or one or more of the steps may include fewer methods/steps, additional methods/steps, and/or some of the methods/steps combined with different methods/steps.

GRAVITYPost-Rehab®

A. Introduction

GRAVITYPost-Rehab® is a safe and effective program designed to focus on movement dysfunction of the shoulder, lumbar spine and knee. The program provides a series of exercise progressions that allow for a sequential approach to post-rehabilitation. Importantly, the focus is on training of the muscles surrounding the joint rather than the treatment of a specific joint pathology. This approach to post-rehabilitation is possible if you consider that each joint complex, due to its skeletal and muscular system, is designed to move and function in a specific manner. Therefore, it is possible to progress through a series of specific exercises (in a pain-free environment) that will strengthen the stability and function of the joint complex. To minimize any damage to the muscular skeletal system, pain-free is the key consideration during the progressional exercise sequencing. However, it should be observed that significant limitations in range of motion and strength of a movement, as well as pain, may be clear indications that the client should seek advice from a rehab professional.

GRAVITYPost-Rehab® is designed to fit within a personal fitness trainer's scope of practice by focusing on the training and conditioning of the function of the joint complex rather than treating a specific diagnosis, which should only be performed by a physical therapist or physician. Guidelines are given to assist the personal fitness trainer in determining when a client's joint ailment is beyond the scope of the program, requiring referral to a medical professional. In addition to the individual conditioning of the involved joint complex, GRAVITYPost-rehab includes a total body conditioning program to help integrate the overall fitness objectives of the client.

The GRAVITYPost-rehab program can be divided into three stages: awareness, pre-positioning and dynamic. The first stage of the program, 'awareness', involves the client focusing on improving proprioception and coordination of the joint complex and the surrounding local muscle system. This is followed by the 'pre-positioning' stage, which begins to improve the function of the joint complex by initiating specific, controlled movement patterns. Finally, the 'dynamic' stage progresses the client into loaded functional tasks designed to increase the strength and functionality of the joint complex and its relationship to multi joint movements. All three stages work together progressively to achieve the GRAVITYPost-rehab objective: to improve the movement of a joint complex and incorporate it into functional movement patterns while ensuring conditioning of the total body.

GRAVITYPost-Rehab® was developed by a team of physical therapists, exercise physiologists and personal fitness trainers to ensure that the methodology and exercises are pertinent, safe and effective.

GRAVITYPost-rehab objective: to improve the movement of a joint complex and incorporate it into functional movement patterns while ensuring conditioning of the total body.

B. GRAVITYPost-Rehab® in the Health Club Industry

Following a physical injury or surgery, physical therapy is one of the first steps to returning to an active lifestyle. Often the limited number of sessions provided for by the healthcare system can prevent an individual from achieving his or her complete rehabilitation objectives. Therefore, patients may have a greater responsibility in managing their continued rehabilitation following physical therapy. Generally, that person will either do very little and never achieve full potential for joint strength and movement, or return to activity prematurely and unsupervised, risking re-injury.

Below is a representation of a sequence that a moderately active individual may experience in the occurrence of an injury.

In this example, a premature return to an active lifestyle can produce a compound injury or reoccurrence of the original injury, leading back to the cyclic process of care and treatment. However, the opportunity for training an existing movement dysfunction in a joint complex, within a controlled environment, may be the answer for a long-term active lifestyle. With any activity there is a risk of re-injury, but when appropriate training of the injured joint complex occurs, the risk of re-injury is minimized.

In recent years the health club industry has identified the business opportunity that exists in the client demographic that experiences some form of movement dysfunction. The challenge for the clubs, however, is in accessing quality education on post-rehab guidelines for personal fitness trainers, marketing to the targeted population, and acquiring appropriate equipment for a post-rehab program.

The GRAVITY SYSTEM pairs post-rehab guidelines and exercises approved and accredited by leading physical therapists with one of the most effective pieces of post-rehabilitative equipment in the industry. GRAVITYPost-Rehab® provides the necessary information and training to apply a specific exercise sequence for the three most common joint complexes that experience movement dysfunctions: the lumbar spine, shoulder and knee.

C. Client Demographics

GRAVITYPost-Rehab® provides the personal fitness trainer an opportunity to market him or herself to a new client demographic. Among GRAVITYPost-Rehab® clients, movement dysfunctions may be caused by a number of different reasons. A comprehensive health and lifestyle history questionnaire will clarify the client's background and assist in future programming. Some of the types of Post-rehab clients a trainer can anticipate working with are listed below:

Patient referrals from a physical therapist

Patient following a rehabilitation process/procedure

People experiencing consistent re-injury of the shoulder, lumbar spine or knee and have chosen not to seek help from a physical therapist Although the clients will have a variety of backgrounds and causes for their movement dysfunctions, the GRAVITYPost-Rehab® program addresses the common experience of joint pain and/or movement dysfunction through the training not treatment approach. The exercises will be consistent within the program outlined for each joint complex (shoulder, lumbar spine or knee), and each stage (awareness, pre-positioning or dynamic). Throughout the GRAVITYPost-rehab program the client's health history and personal objectives will continue to play a role in determining the next programming goals.

D. The Post-Rehab Network

In order to maximize the client's outcomes, it is ideal for the GRAVITYPost-Rehab® trainer and the client's physical therapist to work together. While this may not always be possible, it is recommended that the trainer communicate with the therapist to report on the client's status and progress. This will help ensure that the GRAVITYPost-rehab program avoids any contraindications for the client, based on the physical therapist's prior assessments and treatments. In the event that a contraindication occurs, the trainer will have an open line of communication to refer the client back to the therapist, if needed.

For a successful line of communication and working relationship between the physical therapist and the trainer, it is imperative that the physical therapist clearly understands the training not treatment approach of the GRAVITYPost-Rehab® program. It is the trainer's responsibility to explain this approach to the therapist and be able to describe how it builds upon the foundation established by the physical therapist.

The GRAVITYPost-Rehab® program was developed by a team of physical therapists, exercise physiologists and personal fitness trainers. It is a sound, safe and effective program. However, trainers should be aware that the physical therapy industry has numerous approaches to treatment and an individual therapist's philosophy will play an integral role in the post-rehab program. In the event that the physical therapist has feedback for program modifications, the personal fitness trainer should follow those suggested guidelines. Both the physical therapist and the personal fitness trainer play integral roles in helping the client return to a functional, active lifestyle. Working together, they can ensure the client's success.

In addition to maximizing the client's outcomes, a good working relationship with the physical therapist provides the opportunity for a two-way referral system between therapist and trainer. By referring clients in need of a physical therapist, the trainer further strengthens his or her professional relationship with the therapist, and the therapist can directly assist the trainer in building his or her business. In some cases a physical therapist may use a personal fitness trainer to assist in other on-site conditioning programs, within the physical therapy clinic.

Principles of GRAVITYPost-Rehab

A. Position Statement

The GRAVITYPost-rehab program was designed for the training of a joint complex that has a movement dysfunction, not on identifying a treatment strategy for a specific pathology. By doing so, the program assists in not only improving functionality of a joint complex, but also falls within the scope of practice of a personal fitness trainer. Careful consideration is given to identifying any contraindications that will direct the personal fitness trainer to cease the program and ask the client to seek medical advice.

Each joint complex is made up of a series of structures including muscles, bones, ligaments, tendons, etc., which are designed to function in a precise manner and through specific movement patterns. Each movement pattern is rarely isolated to a single joint complex and its surrounding tissues, but rather incorporates the involvement of other joints and their structures. When an injury occurs, a part of the joint complex's structure is affected, causing a movement dysfunction. A movement dysfunction can be defined as a pathological change of a joint complex's range of motion and strength, possibly with areas of pain. The medical community, including physical therapists, are the first to diagnose and treat a movement dysfunction.

Following treatment with a physical therapist, continued care may be required to maximize the function of the joint complex and its utilization within the network of structures that are required for movement. GRAVITYPost-Rehab® continues this care through identifying the movement dysfunction and utilizing a progressional sequence of exercises that are safe and performed pain-free. The focus is on training of the structures of the joint complex rather than the treatment of a specific joint pathology.

Training of a movement dysfunction rather than pathology (specific injury) is effective when you consider that numerous pathologies will produce the same movement dysfunction. Therefore, it minimizes the need to know the specific pathology and allows the trainer to focus on restoring the normal loading capacity of the joint complex. This principle is also used in acute rehabilitation with careful attention given to loading and the ability of the structure to cope with this loading. The initial step in all rehabilitation programs is to reduce the loading to achieve a level in which the structure can cope, and then progressively increase the load so that the structure can adapt without further injury. If pain occurs it is always important to reduce the loading or range of motion.

GRAVITYPost-Rehab® utilizes the above guidelines in its training program by ensuring that all exercises are performed pain-free, and strict exercise sequencing and loading guidelines are followed. At all times high quality and control of movement patterns are enforced through careful observation by the personal fitness trainer. With its sequential exercises, each program requires the joint complex to move through an array of movements without producing compensation movements.

In addition to focusing on the specific joint, the GRAVITYPost-Rehab® program utilizes total body conditioning exercises to train a client's complete muscular system. These are performed in conjunction with the three-stage training exercises of the specific joint complex.

B. Local and Global Stability

The muscles and tendons that surround and maintain the structure and function of a joint are the key to its stability. Joint stability is comprised of the local and global muscle systems.

Local Muscle System

Providing support and control at a specific, individual joint, these muscles are primarily responsible for joint stabilization rather than joint movement and are usually deep and located close to the joint8. Their anatomical positioning is often monoarticular (crossing one joint only) and is designed to increase joint stiffness and, hence, extrinsic mechanical stability. For example, biomechanically the transverse abdominis cannot contribute to extension, flexion or lateral flexion, but rather plays an important role in intersegmental stabilization by increasing stiffness of the spine. This is achieved by having a low contractile tone that is initiated prior to and maintained throughout the movement, regardless the direction of movement.

Global Muscle System

Providing movement at a specific joint or region, these muscles are primarily responsible for movement of the joint and for balancing the external load that is being applied. They are generally multi joint muscles (capable of moving and supporting several joints), and are designed for complex movement function10. Their long, usual fusiform shape and often remote location to the joint provide for greater biomechanical opportunities to produce movement. Two examples are the rectus abdominis, which provides movement of the spinal complex, and the pectoralis major, which is a prime mover for the shoulder.

Understanding the characteristics of the local and global muscle systems allows us to more clearly define how stability is achieved from a local and global perspective.

Local Stability

Local stability provides support and control at a specific joint. For example, it maintains the position of each vertebra against each other and increases the "stiffness" of the spinal column. Stiffness between two skeletal structures is the key to its stability, and is produced by the low contractile tone provided by the local muscle system. This "tone" provides intersegmental stabilization, functions as the foundation to all movements, and is essential for skeletal posture. Fortunately, this stiffness or tone can occur with even a minimal amount of contraction. Only 25% of maximum voluntary contraction will result in 80% of possible total stiffness. This is important to appreciate that in everyday movements, a minimal activation of the local muscles will achieve significant local stability.

Global Stability

Global stability incorporates a person's ability to move while being aware of his or her center of gravity in relation to the base of support and the existence of all external forces. One's ability to counteract these external forces, including gravity, while moving with control, is the key to global stability.

When a normal, healthy individual performs a functional movement there will be a contraction of the local muscle system prior the global ones. This sequence is important to ensure that the individual joint segments are stabilized first, therefore minimizing any additional joint movements beyond neutral. Each joint has a "neutral" range within which the joint can move without any structural consequences. A painful presentation may occur when this sequence of muscular contraction is reversed. For example, if at the initiation of a movement the global stabilizers contract prior to the local stabilizers, and this sequence occurs repeatedly over a period of time, it will produce excessive movement at the joint, which will result in greater friction and wear and tear at the joint site, producing pain. When this occurs the client requires therapeutic exercises, which focus on training the local muscle systems, in order to change the altered innervation pattern. Once this is achieved, focus can then be placed on training of the global muscle system, which occurs during a post-rehabilitation program. It is important to understand that by training the global muscle system, local stability may not be improved.

How to Recognize Possible Lack of Local Muscle Control

It is important for a personal fitness trainer to know when to refer a client back to a medical professional. The following criteria will assist in the identification of poor local muscle control.

- Exercise is pain-generating
- Pain worsens with overload
- There is no improvement over 10-12 sessions over 4 weeks
- Painful state occurs that is not limited by movement
- Symptoms increase (pain, reduced ROM, decrease in loading) over sessions
- Feeling of poor joint control occurs
- There is a sudden change of the correct movement pattern C. Core Stability (Local and Global)

Core stabilization has always been recognized as essential in functional movements. All skeletal muscles of the trunk and pelvic region are in some way responsible for the stabilization of the lower spine. To assist in understanding core stabilization and control, it is important to identify how spinal stability is possible.

Core Stability Defined

A simple definition of core stability is the ability to control the positioning of the spine while performing movement in the extremities (i.e. proximal stability with distal mobility). Controlling the spine involves the ability to control the shoulder girdle and pelvis, due to their anatomical relationship with the spine. Core stability, through control of the spine, is the result of properly recruiting both the local and global muscle systems. Hodges and Richardson discuss how the lumbar spine area is inherently unstable. In other words, the lumbar spine relies on the active support of its surrounding musculature. This active support comes from four mechanisms: tension from the thoracolumbar fascia, the intra-abdominal pressure mechanism, the role of the paraspinal muscles and the role of deep lumbar extensors.

The thoracolumbar fascia (TLF) enhances posterior static and dynamic stability through its structural and muscular attachments. There are three layers of the fascia, each layer connecting muscles, and all layers feeding into the fascia of the spinal column. Increasing tension in the transversus abdominis (TVA), the internal obliques, and the rectus abdominis increases tension on the TLF. The increase in tension creates greater support for the spine and assists in equalizing pressures and forces on the spine. In addition, the increased tension of the TLF compresses the erector spinae and multifidus muscles, encouraging these to contract and resist spine flexion forces.

The lateral fibers of the TLF's middle layers blend with the fibers of the internal obliques and the TVA. Contraction of these muscles creates an increase in intra-abdominal pressures, which in turn increases the tension against the TLF. This mechanism is an important stabilizer during flexion and/or lifting activities.

The paraspinal muscles (interspinalas and intertransversarii) provide an individual stabilizing effect on their adjacent vertebrae, acting in a similar way to ligaments. The deep lumbar muscle, the multifidus, has been shown to be active throughout a full range of motion of the lumbar spine and during movements of the lower and upper limbs. The paraspinals and deep lumbar muscles appear to work together to create stabilization for the lumbar spine against rotational and extension forces.

From the information above, it is clear that active support of the spine comes from the deep muscles of the trunk and spine. However, core stabilization is not only a result of which muscles are recruited, but also the sequencing and timing of their recruitment. Hodges and Richardson showed that the co-contraction of the transverse abdominis and multifidus muscles occurred prior to any movement of the limbs, and that the timing of coordination of these muscles was very significant. Of particular relevance to the GRAVITYPost-Rehab® program, they also showed that back injury patients were unable to recruit their TVA and multifidus muscles early enough to stabilize the spine prior to movement. Hides, et al. also found that the multifidus muscle showed poor recruitment in back injury patients. It will be critical in the GRAVITYPost-rehab program to be aware of difficulties the back injury client may have related to core stabilization. If they have any problems/pain during participation in the program, do not proceed with general core stability exercises but refer to a physical therapist.

Hodges & Richardson, 1996, demonstrated that back pain occurred when the contraction of the transverse abdominis contracted 40-120 m.sec. following deltoideus anterior activation.

The Functional Result of Core Stability

Core stabilization allows an individual to perform a movement while maintaining good postural alignment, particularly in the lumbar-pelvic region. Without this core stability and the resulting neutral posture, the participant's movement technique may be compromised. Aside from an increased risk of injury, the movement will not be as effective or efficient as needed for the desired results. This is of particular concern in the GRAVITYPost-Rehab® environment, where a client's ability to improve his or her muscle function is directly related to performing the movements correctly.

Cycle of Injury as it Relates to Core Stability

Without stability at the body's core, other muscular imbalances can occur. If core stability is not addressed before attempting to rectify the additional muscular imbalances, they will persist, which often leads to an increased risk of repeated injury or overload. Addressing core stability in the GRAVITYPost-Rehab® environment is essential for client outcomes and the prevention of future problems.

D. Neutral Pelvis and Lumbar Spine Positioning

The definition of "neutral position of spine" falls under different definitions, according to different people. For instance, one source may state that neutral spine is the midpoint between anterior pelvic tilt and posterior pelvic tilt. In this position the lumbar spine is considered to have a natural lordotic curvature and the sacral spine will maintain its natural kyphotic curvature (between flexion and extension). Others may state that neutral spine is the position in which the participant is pain-free. In GRAVITYPost-Rehab®, the goal is to obtain and maintain a natural lordotic curve, however pain-free is the first objective and one should never move while experiencing pain.

Throughout all exercises it is important for the participant to be aware of and maintain a neutral and/or pain-free lumbar spine. To find the appropriate lumbar spine positioning, GRAVITYPost-Rehab® provides exercises that focus on tilting of the pelvic girdle in a supine position. The personal fitness trainer can assist in the participant's awareness of pelvic tilting by explaining that as the lumbar spine flattens out (flexion), the pelvis will tilt posteriorly, and alternatively, by increasing the lumbar curvature (extension), the pelvis will tilt anteriorly. Continuous cueing to maintain lumbar and pelvic position is important throughout all exercises.

Neutral positioning of the whole spinal complex is essential for successful core stability and exercise outcomes. The normal curvatures of the spine consist of anterior in the cervical section, posterior in the thoracic and anterior in the lumbar region.

Again a neutral spine can be defined as the place where the participant is pain-free. Note that the convexity of the curves can vary slightly from individual to individual, so it is important to recognize a genetically inherited curvature vs. poor posture and instability of the spine.

E. 3 Stage Approach to Training a Movement Dysfunction

GRAVITYPost-rehab is based on principles that are incorporated in rehabilitation within the physical therapy industry. These principles progress from formal motor skill training leading to gradual incorporation of skills into light functional tasks and progress to loaded functional tasks. Based on these principles, GRAVITYPost-Rehab® approaches the training of a movement dysfunction in 3 stages:

Awareness

To improve joint stability and restore full functional range of motion, it is essential that the client develops a correct perception of isolated muscle action and joint position. To do so, specific exercises are designed to enhance and develop a person's awareness of the joint complex. The awareness stage focuses on improving proprioception and coordination of the joint and surrounding global muscle system. Be aware of fatigue due to intensity; focus is on proprioception and coordination (quality of movement).

Pre-Positioning

Following the achievement of joint complex awareness the next step is to progressively improve the function of the joint. To do so, specific exercises are designed to actively and passively position one section of a joint complex, preventing it from movement, while actively moving another. This occurs by isometrically contracting local muscle systems of a specific region while initiating functional movement with different levels of loading. The focus is on the quality and control of movement and the loading should be modified to achieve this.

Dynamic

The third stage is to allow the joint to progress into loaded functional tasks. These active movements of the joint complex through a pain-free range of motion focus on strength, endurance and appropriate range of motion. This final stage builds upon the cognitive control of the stabilizing muscle systems as well as the application of long-term functional behaviors. During this stage a greater focus can be given to intensity, however the quality and control of movement should never be compromised.

F. Total Body Conditioning

Each joint complex is a vital member of a complete skeletal structure. In order to maximize the effectiveness and function of a joint complex, it is important to consider that the body rarely functions in isolation and that most movements utilize an array of muscles and joints. Training the total body is essential in helping to strengthen and stabilize the other major joint complexes and prevent future compensatory movement patterns. Within the GRAVITYPost-Rehab® program, exercises focusing on the other major joint complexes are an essential part of the training philosophy to maximize client outcomes. These additional exercises also provide the important principle of a recovery period for the targeted joint complex throughout the training. Each training session will incorporate three to four specific, targeted joint exercises intertwined with a complete set of total body conditioning exercises. The total body conditioning exercises minimize the involvement of the targeted joint while maximizing the benefits of resistance exercises on exercise device 100.

Total body conditioning will also assist in preventing future injuries by improving the body's overall muscle strength and joint range of motion. Following the program, the participant will have a greater awareness of his or her limitations and be able to appropriately modify movement behaviors to reduce the risk of injuries. The trainer will have the opportunity to promote the use of appropriate long-term functional movement behaviors, such as appropriate lifting and reaching techniques, to further assist the client's safe return to an active lifestyle.

G. Assessing Your Client

1. Medical Clearance

Prior to beginning a new exercise program, it is important that a complete medical clearance has been given by the client's physician. For the GRAVITYPost-Rehab® client who has been under the care of a physical therapist, it is recommended that the physical therapist also provides clearance. The trainer should have permission from the client to share program details as needed with the physical therapist and/or physician.

2. Health and Lifestyle History

As with any personal training client, a Post-Rehab® client's health and lifestyle history should be evaluated to provide a comprehensive understanding of past and present activities, medical concerns, health issues and lifestyle habits. Such information is essential for effective programming and to help prevent future health problems.

Many health clubs and trainers already use some type of standardized health history form, however it may be necessary to create an additional form to collect any information not covered in the standardized form.

3. Identifying Movement Dysfunction

Prior to beginning the GRAVITYPost-rehab program, the joint complex's limitations must be observed in order to determine the degree of movement limitation. The personal fitness trainer should determine limitations on range of motion and strength by understanding a specific joint complex's normal and acceptable range of motion and comparing it with the client's ability to move within that range. Often a comparative observation can be made to the range of motion and strength of the opposite joint when considering the knee and shoulder joint complexes.

To identify movement dysfunction, the trainer should address the following points with the client: What joint is involved? What movement is difficult? What is/are your objective(s)? What has been your course of rehabilitation? Are you aware of any restrictions (as recommended by the physical therapist or physician)? Do you have any exercise guidelines given to you by your physical therapist or physician?

4. Initial Contraindications

Clients who experience any of the following during initial assessment or during any part of the program must be referred to their physical therapist or physician for further evaluation:

Acute injury that limits movement

Acute injury without diagnosis

Painful state that is not limited by movement

Loss of movement without pain

H. Post-Rehab Principles

The following list outlines basic training principles that should be followed in the GRAVITYPost-Rehab® program.

Warm Up and Cool Down

Ensure the client has performed an adequate warm-up prior to beginning the exercises. Emphasis should be placed on raising the core temperature of the body and preparing the muscular-skeletal system for the work to be performed. Specific focus should be given to the targeted joint complex ensuring that an initial light load is used. Begin all warm-up exercises with a low intensity. At the end of the session include a cool-down to help the body recover and return to its pre-exercise levels. Emphasis should be placed on stretching the muscles worked during the session.

Quality of Movement

The goal of GRAVITYPost-Rehab® is to help clients regain functional range of motion and strength of a joint complex that has demonstrated a movement dysfunction. The movements required to perform the exercises listed are very specific and must be executed correctly in order to produce results. For quality control, the following should be considered:

Speed: Slow to fast—Moving slowly allows more control both in the concentric and eccentric movement phases. As the client becomes more capable and proficient with a movement pattern, speed or tempo can increase.

Range of motion: To ensure a pain-free environment, progress from limited to full range of motion.

Difficulty of movement: Be aware that the more difficult the exercise, the more quickly fatigue sets in, thus making it more challenging for the client to maintain quality of movement. In the case of fatigue allow for greater rest periods and/or reduce the load.

Signs of fatigue are: Loss of coordination, Loss of quality of movement, Decreased range of motion.

Lever: The length of the lever or distance between the resistance and the joint complex (axis) will often determine the amount of load at the joint. By reducing this distance, the torque at the joint will also be reduced, allowing for greater control and comfort.

Intensity: The higher the intensity and/or load placed upon the joint complex, the more challenging it will be for the client to maintain quality of movement. Have the client work at a low intensity until quality of movement has been demonstrated, then progress with care.

Magnitude

When determining programming for the client, consider the following:

Load: Start with a low load while the client learns the movement pattern. Once adequate control and proper form have been established, increase the load by changing the incline level.

Repetitions: All exercises should be performed for 12-15 repetitions. For unilateral exercises, perform the exercise for 12-15 repetitions on each side.

Rest Period: To maximize the training effect, rest periods should vary depending upon the exercise intensity. With the GRAVITYPost-Rehab® program, rest of targeted muscle groups is possible while performing the conditioning exercises. Length of rest period should be dependent on the fatigue level of the client.

Sets: It is recommended the client perform 2-4 sets of each GRAVITYPost-rehab exercise within a single training session. An exercise which proves to be difficult should be continued within a number of sessions until proficiency is achieved.

Modifications

If the client is unable to perform the movement pattern described in the exercise, modify the lever, load or position on the glideboard 330 to ensure success.

Progression

Within GRAVITYPost-rehab, progression is addressed in two ways: 1) within an individual exercise, the client may increase in load (incline) and 2) between exercises, having successfully completed an exercise the client will progress to the next exercise in the sequence. This progression may be within a stage (i.e. pre-positioning) or it may involve incorporating the first exercise from the next stage (i.e. dynamic). Once the criteria of proficiency are met for an exercise, the trainer could then take the exercise out of the program and replace it with the next exercise in the sequence for the following session. The trainer will continue to repeat an exercise until proficiency is achieved.

The following are indications that the proficiency in an exercise has been achieved and it is safe to progress the client and include the next exercise in the sequence:

Quality of movement has been demonstrated.

The recommended number of repetitions is able to be performed with low exertion.

Adequate muscular strength and endurance have been demonstrated.

The movement is able to be performed in a pain-free range of motion.

In the event that the client completes an exercise with proficiency in a single session, he or she may progress to the next exercise in the sequence during the following session.

Breathing

The client should maintain normal breathing patterns while performing the exercises. Do not allow clients to hold their breath during any phase of the exercise.

Conditioning Outcomes

Following ACSM guidelines for specific training objectives will assist the trainer in achieving individual goals.

Symptoms

Throughout each exercise, respect must be given to client symptoms.

Pain: Regardless of the positions and actions described in the exercise templates, the client should always stay within a pain-free range of motion. In the event of pain, a decrease in the range of motion and/or a reduction in load should eliminate this symptom. If pain persists the exercise should be avoided and medical advice sought.

Excessive heart rate and breathing: This typically indicates a load that is too high for the client and should be reduced. Clients who experience abnormal heart rate and breathing should cease exercising and seek medical advice.

Neurological: Numbness and tingling. A reassessment of positioning and movement pattern should occur, and if symptoms persist, cease the exercise and seek medical advice.

Training Contraindications

Clients who meet any of the following criteria during any part of the program must be referred to their physical therapist or physician for further evaluation:

No improvement in 10-12 sessions over 4 weeks

Increase or changes in symptoms (pain, reduced ROM, decrease in loading) over sessions I. Homework Become comfortable with the exercise device 100

Review position statement and program procedures

Learn all program contraindications

Practice exercises, cueing, positioning etc. (with partner if possible)

Rehearse program session prior to implementation

A. Safety Considerations

When training on exercise device 100, have clients consider the following:

Always consult with a doctor before beginning any exercise program

Avoid baggy clothing on the exercise device 100 to prevent snagging or pulley jams Tie back long hair when lying on the exercise device 100

Avoid dehydration by drinking adequate amounts of fluids before, during and after exercise Use strict lifting techniques when adjusting levels on the exercise device 100

Ensure cross bar is secured in tower slot

Keep fingers above glideboard 330 at all times

Use the handles 980 to maintain control of glideboard 330 at all times when using the cable pulley system Body positioning on glideboard 330—minor adjustments may be required for different body types

| B. Specific Joint Complex Exercises | |
|---|---|
| LUMBAR SPINE (Part A) AWARENESS (4 Exercises) | |
| 1. | Pelvic Rocking |
| 2. | Single Leg Extension |
| 3. | Single Arm Raise |
| 4. | Squat |
| PRE-POSITIONING (8 Exercises) | |
| 5. | Arm Pullover (Lumbar in Flexion) |
| 6. | Hamstring Curl (Lumbar in Flexion) |
| 7. | Squat (Lumbar in Extension) |
| 8. | Rowing in Heel Sit (Lumbar in Neutral) |
| 9. | Kneeling Single Handle Row (Lumbar in Neutral) |
| 10. | Kneeling Single Arm Row with Shoulder Abduction (Lumbar in Neutral) |
| 11. | Single Arm Pulley Press (Lumbar in Neutral) |
| 12. | Rocking Baby (Lumbar in Neutral) |
| DYNAMIC (6 Exercises) | |
| 13. | Upper Back Extension |
| 14. | Upper Back Extension with Arm Pulley |
| 15. | Back Extension with Row in Adduction |
| 16. | Back Extension with Rotation |
| 17. | Assisted Abdominal Crunch |
| 18. | Side Bending |
| SHOULDER (part b) AWARENESS (4 exercises) | |
| 1. | Depression of Scapula |
| 2. | Elevation of Scapula |
| 3. | Retraction of Scapula |
| 4. | Protraction of Scapula |
| PRE-POSITIONING (4 exercises) | |
| 5. | Shoulder Extension (Scapula in Retraction and Depression) |
| 6. | Shoulder Flexion (Scapula in Retraction and Depression) |
| 7. | Shoulder External Rotation (Scapula in Retraction and Depression) |
| 8. | Shoulder Internal Rotation (Scapula in Retraction and Depression) |
| DYNAMIC (9 exercises) | |
| 9. | Pull Up |
| 10. | Pull Up with Pulleys |
| 11. | Shoulder Adduction (In Supine) |
| 12. | Shoulder Abduction (In Supine) |
| 13. | Single Arm Shoulder Flexion |
| 14. | Single Arm Shoulder Extension |
| 15. | Single Arm External Rotation and Overhead Press |

-continued

| | |
|---|---|
| 16. | Shoulder Extension with Trunk Flexion and Rotation |
| 17. | Kneeling Shoulder Flexion with Trunk Extension and Rotation |
| | KNEE (part b) |
| | AWARENESS (2 exercises) |
| 1. | Unilateral Squat |
| 2. | Unilateral Hamstring Curl |
| | DYNAMIC (14 exercises) |
| 3. | Bilateral Squat |
| 4. | Unilateral Squat |
| 5. | Bilateral Squat with External Rotation of Hips |
| 6. | Unilateral Squat with External Rotation of Hip |
| 7. | Bilateral Plyometric Squat |
| 8. | Unilateral Plyometric Squat |
| 9. | Bilateral Plyometric Skiing |
| 10. | Unilateral Plyometric Skiing |
| 11. | Side-lying Single Leg Squat |
| 12. | Quadraped |
| 13. | Triped |
| 14. | Seated Hamstring Curl |
| 15. | Reverse Lunge |
| 16. | Lateral Lunge |
| | C. Conditioning Exercises |
| | LUMBAR SPINE (6 exercises)- Part A |
| 1. | Squat |
| 2. | Pull Up |
| 3. | Pullover Triceps Extension |
| 4. | Inverted Biceps Curl |
| 5. | Bi-lateral Shoulder Abduction |
| 6. | Supine Fly |
| | SHOULDER (6 exercises)- Part B |
| 1. | Squat |
| 2. | Leg Curl |
| 3. | Inverted Abdominal Crunch |
| 4. | Upper Back Extension |
| 5. | Biceps Curl |
| 6. | Triceps Press |
| | KNEE (6 exercises)- Part B |
| 1. | Pull Up |
| 2. | Row with Trunk Flexion and Extension |
| 3. | Chest Press |
| 4. | Pullover Crunch |
| 5. | Triceps Press |
| 6. | Biceps Curl |

D. Sample Programming (Lumbar Spine)

Each GRAVITYPost-Rehab® session should address both the specific exercises for the joint complex as well as the total body conditioning exercises listed for that joint. The client should progress through the stages in order (Awareness, Pre-positioning and Dynamic), and the specific joint exercises must be performed in the order listed in the manual. The conditioning exercises can be inserted throughout the session to build in rest periods for the targeted joint complex.

Scenario I

A new client continues to experience lower back pain at work. He has received physical therapy which has been successful however experiences some lingering pain. He was originally diagnosed with poor core stability and it was recommended that he focus on strengthening the thoracolumbar fascia. Below is an outline of an initial exercise session for the lumbar spine Awareness stage.

Scenario II

The client has mastered Awareness exercises #1 and #2. Below is an outline of an exercise session, demonstrating how to progress the client into the Pre-positioning stage while continuing to complete the Awareness exercises.

Post-Rehab™ Lumbar Spine Exercises

Post-Rehab™ Exercises—Section 1

| Lumbar Spine Exercises | |
|---|---|
| Awareness | |
| 1 | Pelvic Rocking |
| 2 | Single Leg Extension |
| 3 | Single Arm Raise |
| 4 | Squat |
| | Pre-Positioning |
| 6 | Arm Pullover (Lumbar in Flexion) |
| 5 | Hamstring Curl (Lumbar in Flexion) |
| 7 | Squat (Lumbar in Extension) |
| 8 | Rowing in Heel Sit (Lumbar in Neutral) |
| 9 | Kneeling Single Handle Row (Lumbar in Neutral) |
| 10 | Kneeling Single Arm Row with Shoulder Abduction (Lumbar in Neutral) |
| 11 | Single Arm Pulley Press (Lumbar in Neutral) |
| 12 | Rocking Baby (Lumbar in Neutral) |
| | Dynamic |
| 13 | Upper Back Extension |
| 14 | Upper Back Extension with Arm Pulley |
| 15 | Back Extension with Row In Adduction |
| 16 | Back Extension with Rotation |
| 17 | Assisted Abdominal Crunch |
| 18 | Side Bending |
| Lumbar Spine Conditioning Exercises | |
| 1 | Squat |
| 2 | Pull Up |
| 3 | Pullover Triceps Extension |
| 4 | Inverted Biceps Curl |
| 5 | Bilateral Shoulder Abduction |
| 6 | Supine Fly |

Lumbar Spine

Awareness

Definition of Awareness

To improve joint stability and, correspondingly, pain-free functional movement, it is essential that the client develop a correct perception of isolated muscle action and joint position. To do so, specific exercises are designed to enhance and develop a person's awareness of the position of the joint. The Awareness stage focuses on improving proprioception and coordination of the joint and surrounding local muscle system. Be aware of fatigue due to intensity; focus is on proprioception and coordination (quality of movement), NOT strength or endurance training Specific Objectives From performing the awareness exercises for the lumbar spine, the client should be able to find his or her neutral or pain-free position, which is typically the mid-range between flexion and extension.

Initially, clients should be cued to use their hands to detect lumbar position. As lumbar position awareness increases, the client should be able to perform the exercises without using the hands for detection. The trainer may monitor the individual's lumbar stability by placing his or her hand under the spine.

Special Considerations

If a client is unable to achieve and maintain a pain-free, neutral lumbar position, instruct him or her to stay in a position as close to neutral as possible, without pain. The goal should be to progress the lumbar spine to a pain-free and anatomical neutral position.

1 Pelvic Rocking

Joint Complex: Lumbar Spine; Stage: Awareness; Pulley Pin Placement: N/A; Incline Guideline: 1; Starting Position:

Upright Supine—Straddle the glideboard 330, facing the tower. Sit at the top edge of the glideboard 330 and lie back, making sure head is fully supported, with knees and hips slightly flexed and feet resting on the rails.

Exercise Description

Begin by slightly rocking the pelvis forward and back. Client should focus on his or her awareness of whether the lumbar spine is in neutral, flexed or extended position.

Teaching Tips

- Maintain pain-free lumbar position throughout the exercise.
- Use hands to detect pelvic tilting and lumbar position.
- Shorten the distance between the ribs and the hips.
- To flex the lumbar spine, bring the pubic bone toward the rib cage and imprint the low back into the glideboard 330.
- To extend the lumbar spine, slowly peel your low back off the glideboard 330, dropping the pubic bone toward the glideboard 330.

Safety Aspects

- Ensure head is fully supported on the glideboard 330.
- Perform movement slowly with control.
- If client cannot place feet on glideboard 330, place feet on the floor.
- If a client has pain with lumbar extension, begin in a seated position, feet on the floor in front of the base of the glideboard 330, or placed against the base of the squat stand. Progress client to a supine position.

Repetitions: 12-15 times; Sets: 2-4; Variations: None

2 Single Leg Extension

Joint Complex: Lumbar Spine; Stage: Awareness; Pulley Pin Placement: N/A; Incline Guideline: 1; Starting Position: Inverted Supine—Straddle the glideboard 330, facing the tower. Sit at the top edge of the glideboard 330 and lie back, making sure head is fully supported, with knees and hips slightly flexed and feet resting on the rails. Through pelvic rocking, obtain neutral or pain-free lumbar position. Place the hands palm up, under the lumbar spine.

Exercise Description

While maintaining a neutral or pain-free lumbar position, extend one leg at a time, keeping contact between the heel and rail. Slowly return to the starting position. Repeat for the desired number of repetitions then change legs.

Teaching Tips

- Maintain neutral or pain-free lumbar position throughout the exercise.
- Use hands to detect lumbar position.
- Wear socks.
- Maintain equal weightbearing onto the pelvis.
- Press equally through the foot, keeping the knee facing up toward the ceiling.
- Avoid movement of the thoracic and cervical spine as compensation.
- To enhance awareness of neutral pelvic positioning, perform the movement in both flexion and extension, followed by holding the spine at the midpoint.

Safety Aspects

- Ensure head is fully supported on glideboard 330.
- Perform movement slowly with control.
- If client is unable to perform the motion inverted, perform the movement upright supine with feet on the floor.
- If unable to maintain neutral pelvis, decrease the range of motion of the lower extremity.

Repetitions: 12-15 times on each leg; Sets: 2-4; Variations: Knee Lift: Upon return, flex hip and lift knee towards the chest, maintaining neutral or pain-free lumbar position.

Variation (Knee Lift)

3 Single Arm Raise

Joint Complex: Lumbar Spine; Stage: Awareness; Pulley Pin Placement: N/A; Incline Guideline: 1; Starting Position: Upright Supine—Sit at the bottom edge of the glideboard 330, facing away from the tower. Lie back, ensuring head is fully supported, knees are flexed and feet are placed against the telescoping squat stand, shoulder-width apart. Through pelvic rocking, obtain neutral or pain-free lumbar position. Place one hand under the lumbar spine palm up, the other arm is extended at the side, palm down.

Exercise Description

While maintaining neutral or pain-free lumbar position, slowly raise extended arm overhead, then return to starting position. Repeat for the desired number of repetitions then change arms.

Teaching Tips

- Maintain neutral or pain-free lumbar position throughout the exercise.
- Keep the knees slightly flexed.
- Use one hand to detect lumbar position.

Safety Aspects

- Ensure head is fully supported on glideboard 330.
- Perform movement slowly with control.

Repetitions: 12-15 times on each arm; Sets: 2-4; Variations: None

4 Squat

Joint Complex: Lumbar Spine; Stage: Awareness; Pulley Pin Placement: N/A; Incline Guideline: 4; Starting Position: Upright Supine—Push the glideboard 330 halfway up the rails. Straddle the glideboard 330 and sit at the bottom edge, facing away from the tower. Lie back with head resting on the glideboard 330, legs extended but knees not locked, feet placed against telescoping squat stand, shoulder-width apart. Through pelvic rocking, obtain neutral or pain-free lumbar position. Place both hands under the lumbar spine, palms up.

Exercise Description

While maintaining neutral or pain-free lumbar positioning, lower the glideboard 330 to a squat position by flexing the knees. Slowly return to starting position.

Teaching Tips

- Use the hands to detect lumbar positioning.
- Relax the head, neck and shoulders.
- Maintain neutral or pain-free lumbar position throughout the exercise.

Safety Aspects

- Squat as deeply as possible without causing pain or losing the position of the lumbar spine.
- Perform movement slowly with control.

Repetitions: 12-15 times; Sets: 2-4; Variations: None

Lumbar Spine

Pre-Positioning

Definition of Pre-Positioning

Following the achievement of joint complex awareness, the next step is to progressively improve the dynamic function of the joint. To do so, specific exercises are designed to actively and passively position one section of a joint complex, preventing it from movement, while actively moving another. This occurs by isometrically contracting all stabilizing muscle systems of a specific region while initiating functional movement with different levels of loading. The focus is on the quality and control of movement, and the loading should be modified to achieve this.

Specific Objectives

By performing an isometric contraction, the muscles of the lower trunk are strengthened.

The client will be introduced to functional movement, utilizing the extremities, while maintaining an appropriate lumbar position.

Special Considerations

As in the Awareness stage, focus should be placed on maintaining the spine in a pain-free position, regardless of the position stated in the exercise description. The goal would be to move toward the recommended lumbar position while remaining pain-free.

5 Arm Pullover (Lumbar in Flexion)

Joint Complex: Lumbar Spine; Stage: Pre-positioning; Pulley Pin Placement: 1-2; Incline Guideline: 2-3; Starting Position: Upright Supine—Grasp handles 980 and pull the glideboard 330 halfway up the rails. Sit at the bottom edge facing away from the tower, head supported and feet resting on the bottom of the glideboard 330. Extend arms overhead.

Exercise Description

Flex lumbar spine and achieve contact with glideboard 330. While maintaining this lumbar position, perform a pullover movement, sliding the glideboard 330 towards the tower. Perform the desired number of repetitions, then change legs and repeat the exercise.

Teaching Tips

Tuck the chin toward the chest and maintain contact between the head and glideboard 330 throughout the exercise.

Maintain consistent contact and pressure between the lumbar spine and the glideboard 330 throughout the exercise.

Safety Aspects

Modify the pullover action as needed due to client's strength or pain-free range of motion limitations.

Avoid pressing the feet against the glideboard 330. Maintain tension in the abdominals to keep the lumbar spine in contact with the glideboard 330.

Repetitions: 12-15 times on each leg; Sets: 2-4

Variations

A: Unilateral Leg Extension—From the starting position, extend one leg. Hold this position while maintaining lumbar flexion and performing the pullover. Perform the desired number of repetitions on each leg.

B: Bilateral Knee Raise—From the starting position, lift the feet off the board by flexing the hips to no more than 90°. Hold this position while maintaining lumbar flexion and performing the pullover.

C: Single Knee, Single Leg Extension—From the bilateral knee raise position, extend one leg. Hold this position while maintaining lumbar flexion and performing the pullover. Perform the desired number of repetitions on each leg.

D: Bilateral Leg Extension—From the single knee, single leg extension position, extend the other leg. Hold this position while maintaining lumbar flexion and performing the pullover.

6 Hamstring Curl (Lumbar in Flexion)

Joint Complex: Lumbar Spine; Stage: Pre-positioning; Pulley Pin Placement: N/A; Incline Guideline: 1-2; Starting Position: Inverted Supine—Sit at the top end of the glideboard 330 and place feet into the Folding Foot Holder. Lie back with head resting on the glideboard 330 and legs extended, knees slightly flexed.

Exercise Description

Press the lumbar spine against the glideboard 330 by tilting the pelvis. Maintain this position while flexing the knees and using the hamstrings to pull the glideboard 330 towards the feet. Slowly return to starting position.

Teaching Tips

Maintain consistent contact and pressure between the lumbar spine and the glideboard 330 throughout the exercise.

Move through full range of hamstring flexion while maintaining lumbar position.

If needed, the client can use hands to detect lumbar and pelvic positioning.

Plantar flex the feet, gently pointing them toward the floor.

Maintain a static thoracic and cervical spine throughout the movement.

Keep the shoulders away from the ears.

Maintain the hips, knees and ankles in alignment.

Tuck the chin toward the chest and maintain contact between the head and glideboard 330 throughout the exercise.

Safety Aspects

Lower and raise upper body with control when getting into and out of position.

Use the Support Wedge Pillow for those who cannot assume an inverted position or maintain thoracic positioning.

Repetitions: 12-15 times; Sets: 2-4; Variations: None

7 Squat (Lumbar in Extension)

Joint Complex: Lumbar Spine; Stage: Pre-positioning; Pulley Pin Placement: N/A; Incline Guideline 6-8; Starting Position: Upright Supine—Push the glideboard 330 halfway up the rails. Straddle the glideboard 330 and sit at the bottom edge, facing away from the tower. Lie back with head resting on glideboard 330, legs extended but knees not locked, feet placed against telescoping squat stand, in a plié position.

Exercise Description

Place lumbar spine into extension by anteriorly tilting the pelvis. Squat with as much hip flexion as possible while still maintaining the position of lumbar extension. Slowly return to starting position. Maintain the position of lumbar extension throughout the exercise.

Teaching Tips

Use the hands to detect lumbar extension.

Be aware of degree of knee flexion, always maintaining a pain-free range of motion.

Relax the head, neck and shoulders.

Maintain lumbar extension throughout the exercise.

Modify foot position (plié) as needed to allow for greater hip flexion.

Make sure the knees track over the middle of the feet.

Safety Aspects

Squat as deeply as possible without causing pain or loosing the position of the lumbar spine.

Ensure head is fully supported on glideboard 330.

Repetitions: 12-15 times; Sets: 2-4; Variations: None

8 Rowing in Heel Sit (Lumbar in Neutral)

Joint Complex: Lumbar Spine; Stage: Pre-positioning: Pulley Pin Placement: 2; Incline Guideline: 2-4; Starting Position: Kneeling Backwards—Grasp handles 980 and pull glideboard 330 halfway up the rails. Place hands, knuckles down, on the glideboard 330 to stabilize movement. Kneel at the top edge of the glideboard 330 facing the tower, sit back on heels. Extend arms toward pulleys with palms facing each other.

Exercise Description

While maintaining a neutral or pain-free lumbar position, pull the handles 980 towards the rib cage, leading with the elbows. Return to starting position by slowly extending the arms.

Teaching Tips

Throughout the row action, maintain scapula in retracted position and lumbar spine in a neutral or pain-free position.

Avoid excess movement of the sagittal plane.

Maintain a neutral and pain-free spine.

Keep wrists neutral throughout movement.

Focus on recruiting the shoulder extensors to perform the movement, instead of the biceps.

Maintain ears over the shoulders.

Safety Aspects

If client is unable to kneel with full knee flexion, place a Support Wedge Pillow between the calves and the buttocks.

If client is unable to go into full plantar flexion, place a rolled up towel between the ankle and glideboard 330.

REPETITIONS: 12-15 times; Sets: 2-4; Variations: Seated—Movement can be performed in a seated rather than kneeling position, however care should be given to maintaining neutral or pain-free lumbar position, as it is harder to control in the seated position.

9 Kneeling Single Handle Row (Lumbar in Neutral)

10

Joint Complex: Lumbar Spine; Stage: Pre-positioning; Pulley Pin Placement: 2; Incline Guideline: 2-4; Starting Position: Kneeling Backwards—Connect both cables 970 to a single handle. Pull the glideboard 330 halfway up the rails. Place hands, knuckles down, on the glideboard 330 to stabilize movement. Kneel at the top edge of the glideboard 330 facing the tower. Grasp handle 980 with both hands, extend arms toward pulleys. Move into a high-kneeling position by lifting the buttocks off the heels.

Exercise Description

From the high kneeling position, maintain a neutral or pain-free lumbar position and allow the body to lean forward without changing degree of hip flexion. Hold this position while pulling the handle 980 towards the trunk, leading with the elbows. The torso should not be allowed to move. Return to starting position by slowly extending at the elbows.

Note: The high kneeling position is designed to challenge stability. The focus in this position is to remain as far forward as possible without falling forward.

Teaching Tips

Throughout the row action, maintain scapula in retracted position and spine in a neutral or pain-free position.

Maintain static core stability.

Maintain neutral wrists throughout the movement.

Safety Aspects

Be aware of the client's stability, beginning with greater knee flexion and progressing to a high kneeling position.

REPETITIONS: 12-15 times; Sets: 2-4; Variations: None.

11 Kneeling Single Arm Row with Shoulder Abduction (Lumbar in Neutral)

Joint Complex: Lumbar Spine; Stage: Pre-positioning; Pulley Pin Placement: 2; Incline GuidelineL: 2-5; Starting Position: Kneeling Backwards—Grasp one handle, pull the glideboard 330 partway up the rails. Place hands, knuckles down, on the glideboard 330 to stabilize movement. Kneel in the middle of the glideboard 330 facing the tower. Extend one arm towards the pulleys, place the other hand palm up on the lumbar spine. Move into a high-kneeling position by lifting the buttocks off the heels.

Exercise Description

From the high kneeling position, maintain a neutral or pain-free lumbar position and allow the body to lean forward without changing degree of hip flexion. Hold this position while moving the shoulder and performing a high elbow row. The torso should not be allowed to move. Return to starting position by slowly extending the arm. Repeat for the desired number of repetitions then change arms.

Teaching Tips

Throughout the row action, maintain the spine in a neutral or pain-free position.

Maintain static core stability.

Use one hand behind the back to detect neutral spine and help stabilize the opposite shoulder.

Do not allow the torso to rotate during the row action.

Maintain neutral wrists during movement.

Safety Aspects

Be aware of the client's stability, beginning with greater knee flexion and progressing to a high kneeling position.

During shoulder adduction, be aware of maintaining core stabilization.

REPETITIONS: 12-15 times; Sets: 2-4; Variations: None.

12 Single Arm Pulley Press (Lumbar in Neutral)

Joint Complex: Lumbar Spine; Stage: Pre-positioning; Pulley Pin Placement: 2; Incline Guideline: 2-5; Starting Position: Kneeling Forward—Grasp one handle, pull the glideboard 330 partway up the rails. Place hands, knuckles down, on the glideboard 330 to stabilize movement. Kneel at the top edge of the glideboard 330 facing away from the tower. Feet should be positioned to allow the toes to hang over the top edge of the glideboard 330. Pull the handle 980 in front of the client with the cable 970 running under the arm, next to the torso. Grasp the handle 980 with both hands, keeping the cable 970 aligned to one side, elbows flexed. Move into a high-kneeling position by lifting the buttocks off the heels.

Exercise Description

From the high kneeling position, maintain a neutral or pain-free lumbar position and allow the body to lean forward, away from the tower without changing degree of hip flexion. Hold this position while performing a front press, using both hands, extending the arms in alignment with the pulley. The torso should not be allowed to move. Return to starting position with control. Repeat for the desired number of repetitions then change sides.

Teaching Tips

Throughout the press action, maintain the spine in a neutral or pain-free position.

Maintain static core stability.

Do not allow the torso to rotate during the row action.

Allow toes to lay over top edge of glideboard 330 for stability.

If client is unable to go into full plantar flexion, place rolled up towel between ankles and the glideboard 330.

Knees can be spread apart for a greater base of support.

Safety Aspects

Ensure to anchor in and out of starting position by placing knuckles on the glideboard 330.

Visual inspection of lumbar spine will help in assessing position.

Be aware of core stability during pressing movement.

Repetitions: 12-15 times; Sets: 2-4; Variations: None.

13 Rocking Baby (Lumbar in Neutral)

Joint Complex: Lumbar Spine; Stage: Pre-positioning; Pulley Pin Placement: 2; Incline Guideline: 1-3; Starting Position: Kneeling Lateral—Stand to the side of the rails and grasp the handle 980 on the same side of the exercise device 100. Pull the glideboard 330 halfway up the rails. Place hands, knuckles down, on the glideboard 330 to stabilize movement. Kneel on the top portion of the glideboard 330 facing sideways. Flex the elbows, grasp the handle 980 with both hands and hold it to the side of the body closer to the tower.

Exercise Description

In a low kneeling position, maintain neutral or pain-free lumbar positioning and a static trunk. With both hands, pull the handle 980 across the body to the other side. Return with control. Repeat for the desired number of repetitions then change sides, facing the other direction. Note: The torso should remain perpendicular to the glideboard 330, NOT the floor.

Teaching Tips

- All movement occurs at the shoulder girdle. There is no trunk rotation.
- Maintain neutral or pain-free lumbar positioning throughout the exercise.
- Knees can be spread apart for a greater base of support.
- To increase stability, hook the toes over the edge of the glideboard 330 and press the shins into the glideboard 330.

Safety Aspects

- Anchor in and out of lateral kneeling position.
- If client is unable to kneel with full knee flexion, place a Support Wedge Pillow between the calves and the buttocks.
- Be aware of cervical spine positioning.
- Visual inspection of lumbar spine will help in assessing position.

REPETITIONS: 12-15 times; Sets: 2-4; Variations: High kneeling position with the trunk leaning forward without loosing a neutral or pain-free lumbar positioning.

Lumbar Spine

Dynamic

Definition of Dynamic

The third stage is to allow the joint to progress into loaded functional tasks. These active movements of the joint complex through a pain-free range of motion focus on strength, endurance and appropriate range of motion. This final stage incorporates cognitive control of all stabilizing muscle systems, as well as the application of long-term functional behaviors. During this stage, a greater focus can be given to intensity, however the quality and control of movement should never be jeopardized.

Specific Objectives

Throughout the Dynamic stage, the client should be able to maintain awareness and muscle control while performing multi joint movements. Consideration is given to exercises that will help the client perform normal, everyday tasks pain free.

Special Considerations

- Care should be taken to maintain control of the lumbar spine and to remain in a pain-free position throughout the exercises.
- Due to the sensitive nature of the joint, all exercises should begin with low intensity, progressing as the client's strength improves and appropriate function is achieved.

14 Upper Back Extension

Joint Complex: Lumbar Spine; Stage: Dynamic; Pulley Pin Placement: N/A; Incline Guideline: 2-3; Starting Position: Kneeling Backwards—With glideboard 330 resting at the base, place hands, knuckles down, on top to stabilize movement. Kneel in the middle of the glideboard 330 facing the tower, sit back on the heels. Place hands palms up, behind the back and resting on the lumbar spine. Lean forward, resting chest and trunk on thighs.

Exercise Description

While maintaining the lumbar position, lift the ribcage off the thighs by extending the cervical and thoracic spine. Movement should begin with cervical spine and articulate into thoracic spine. Note: Maintain the contact between the abdomen in contact with the thighs throughout the movement.

Teaching Tips

- Initiate the movement by lengthening the neck and slightly raising the head.
- Avoid hyperextension of the cervical spine.
- Keep lumbar movement to a minimum.
- End of the movement occurs when ribcage and upper trunk lose contact with the thighs.
- Maintain buttocks in contact with the heels.

Safety Aspects

- If client is unable to kneel with full knee flexion, place a Support Wedge Pillow between the calves and the buttocks.
- Ensure to anchor in and out of starting position by placing knuckles on the glideboard 330.
- Avoid pressing the hands into the lower back/sacrum area. Arm should be relaxed.

REPETITIONS: 12-15 times; Sets: 2-4; Variations: None

15 Upper Back Extension with Arm Pulley

Joint Complex: Lumbar Spine; Stage: Dynamic; Pulley Pin Placement: 1; Incline Guideline: 1-2; Starting Position: Kneeling Backwards—Grasp handles 980 and pull glideboard 330 halfway up the rails. Place hands, knuckles down, on the glideboard 330 to stabilize movement. Kneel at the top edge of the glideboard 330 facing the tower, sit back on heels. Lean forward, resting chest and trunk on thighs. Extend arms toward pulleys with palms facing each other.

Exercise Description

While maintaining the lumbar position, lift the ribcage off the thighs by extending the cervical and thoracic spine. As soon as the ribs lift off the thighs, pull the handles 980 toward the rib cage, leading with the elbows. Articulation of the spine should begin with cervical spine and move into thoracic spine. Return to starting position by slowly extending the arms and lowering the ribcage and trunk onto thighs.

Teaching Tips

- Initiate the movement by lengthening the neck and slightly raising the head.
- Avoid hyperextension of the cervical spine.
- Keep lumbar movement to a minimum.
- End of the movement occurs when ribcage and upper trunk lose contact with the thighs and hands reach the sides of the torso.
- Maintain buttocks in contact with the heels.
- Maintain neutral wrists.
- Avoid shoulder elevation.

Safety Aspects

- If client is unable to kneel with full knee flexion, place a Support Wedge Pillow between the calves and the buttocks.
- Anchor in and out of starting position by placing knuckles on the glideboard 330.

REPETITIONS: 12-15 times; Sets: 2-4; Variations: A: Reverse Fly—While maintaining the lumbar position, lift the ribcage off the thighs by extending the cervical and thoracic spine. Simultaneously, pull the arms back in an outward arc until hands are directly out to the side from the torso. Articulation of the spine should begin with cervical spine and move into thoracic spine. Slowly return to starting position. B: Upright Row—While maintaining the lumbar position, lift the ribcage off the thighs by extending the cervical and thoracic spine. Simultaneously, pull the handles 980 up toward the shoulders, leading with the elbows. Articulation of the spine should begin with cervical spine and move into thoracic spine. Slowly return to starting position.

16 Back Extension with Row in Adduction

Joint Complex: Lumbar Spine; Stage: Dynamic; Pulley Pin Placement: 2; Incline Guideline: 2-3; Starting Position: Kneeling Backwards—Grasp handles 980 and pull glideboard 330 halfway up the rails. Place hands, knuckles down, on the glideboard 330 to stabilize movement. Kneel at the top edge of the glideboard 330 facing the tower, sit back on heels. Lean forward, resting chest and trunk on thighs. Extend arms toward pulleys with palms facing each other.

Exercise Description

Lift the ribcage and trunk off the thighs by articulating the spine into extension, starting with the cervical and moving to the lumbar region. Simultaneously pull the handles 980 toward the rib cage, leading with the elbows. Return to starting position by slowly extending the arms and lowering the ribcage and trunk onto thighs.

Teaching Tips

- Initiate the movement by lengthening neck and slightly raising the head.
- Avoid hyperextension of cervical and lumbar spine.
- Arm movement should begin simultaneously with thoracic extension. The tendency will be to begin the movement with the arms.
- Move thoracic spine into full extension.
- End of the movement occurs when hands reach the sides of the torso and the whole spine is in an upright and neutral position.
- Maintain neutral wrists.
- Keep weight evenly distributed through the pelvis.

Safety Aspects

- Anchor in and out of starting position by placing knuckles on the glideboard 330.
- If client is unable to kneel with full knee flexion, place a Support Wedge Pillow between the calves and the buttocks.

REPETITIONS: 12-15 times; SETS: 2-4; VARIATIONS: None

17 Back Extension with Rotation

Joint Complex: Lumbar Spine; Stage: Dynamic; Pulley Pin Placement: 2; Incline Guideline: 2-3; Starting Position: Kneeling Backwards—Grasp handles 980 and pull glideboard 330 halfway up the rails. Place hands, knuckles down, on the glideboard 330 to stabilize movement. Kneel at the top edge of the glideboard 330 facing the tower, sit back on heels. Lean forward, resting chest and trunk on thighs. Extend arms toward pulleys with palms facing each other.

Exercise Description

Lift the ribcage and trunk off the thighs by articulating the spine into extension, starting with the cervical and moving through to the lumbar region. Simultaneously pull one handle 980 toward the rib cage, leading with the elbow, and rotating the torso in the same direction. Opposite hand maintains a static position with elbow slightly flexed. Slowly return to starting position then repeat for the desired number of repetitions before changing sides.

Teaching Tips

- Initiate the movement by lengthening neck and slightly raising the head.
- Avoid hyperextension of cervical and lumbar spine.
- Move thoracic spine into full extension.
- Keep the pelvic position facing forward and static throughout the exercise.
- Allow the head to rotate in direction of torso rotation.
- End of the movement occurs when hand reaches the side of the torso, trunk is rotated and the whole spine is in an upright and neutral position.
- Maintain neutral wrists.
- Keep weight evenly distributed through the pelvis.

Safety Aspects

- Anchor in and out of starting position by placing knuckles on the glideboard 330.
- If client is unable to kneel with full knee flexion, place a Support Wedge Pillow between calves and the buttocks.

REPETITIONS: 12-15 times; Sets: 2-4; Variations: None

18 ASSISTED ABDOMINAL CRUNCH

Joint Complex: Lumbar Spine; Stage: Dynamic; Pulley Pin Placement: N/A; Incline Guideline: 2-6; Starting Position: Upright Supine—Push the glideboard 330 halfway up the rails. Straddle the glideboard 330 and sit at the bottom edge, facing away from the tower. Lie back with head resting on glideboard 330, legs extended but knees not locked, feet placed against telescoping squat stand, shoulder-width apart. Cross arms and rest hands on the chest. Flex knees to approximately 90° and hold.

Exercise Description

While maintaining the squat position, flex the abdominals, raising the head and shoulders off the glideboard 330 and keeping the chin tucked in throughout the movement. Return to starting position with control.

Teaching Tips

- Maintain a neutral or pain-free lumbar position throughout the exercise.
- Allow the thoracic spine to flex during the crunch movement.
- Movement of the upper body should be a result of shortening the abdominals, not flexion at the hip.
- Progress from high to low incline, based client's abdominal strength.
- Hold thumbs on chin to help maintain position of the head.
- Keep the glideboard 330 stationary throughout the movement.

Safety Aspects

- Be aware of clients with poor quadriceps strength and modify degree of knee flexion accordingly.

REPETITIONS: 12-15 times; Sets: 2-4; Variations: None

19 Side Bending

Joint Complex: Lumbar Spine; Stage: Dynamic; Pulley Pin Placement: N/A; Incline Guideline: 2-4; Starting Position: Side-lying—Lie on one side with hips at the bottom of the glideboard 330 and top foot braced against the base. Bottom leg is flexed with foot placed on knee of top leg. Rest hand of top arm on hip, lower arm rests on glideboard 330 while supporting and securing the head.

Exercise Description

Use the muscles of the trunk to raise the shoulder and torso off the glideboard 330 along the frontal plane (lateral flexion).

Teaching Tips

- Avoid pushing on the head with the bottom arm.
- Do not allow the torso to rotate during movement.
- Maintain contact between the pelvis and the glideboard 330.
- Allow the spine to flex laterally.
- Keep the breastbone facing forward and the ear, shoulder and hip in alignment.
- Avoid thoracic or cervical flexion.

Safety Aspects

- Ensure that the client's hip and foot positioning is secure and properly aligned.
- The higher the incline, the easier the movement.

REPETITIONS: 12-15 times; Sets: 2-4; VARIATIONS: None

Lumbar Spine

Conditioning Exercises

1 Squat

Joint Complex: Lumbar Spine; Stage: Conditioning; Pulley Pin Placement: N/A; Incline Guideline: 3-6; Starting Position: Upright Supine—Push the glideboard 330 halfway up the rails. Straddle the glideboard 330 and sit at the bottom edge, facing away from the tower. Lie back with head resting on glideboard 330, legs extended but knees not locked, feet placed against telescoping squat stand in alignment directly under hip joints.

Exercise Description

While maintaining the spine in a neutral or pain-free position, lower the glideboard 330 by flexing the knees. Return to the starting position with control.

Teaching Tips

Be aware of degree of knee flexion, always maintaining a pain-free range of motion.

Ensure that middle of patellae align with middle of the feet throughout the motion.

Relax the head, neck and shoulders.

Maintain the spine in a neutral or pain-free position throughout the exercise.

Safety Aspects

Do not lock knees at the top of the movement.

REPETITIONS: 12-15 times; Sets: 2-4; Variations: None

2 Pull Up

Joint Complex: Lumbar Spine; Stage: Conditioning; Pulley Pin Placement: N/A; Incline Guideline: 3-6; Starting Position: With the LAT bars in the pull up position, push the glideboard 330 halfway up the rails. Lie prone with chest near the top edge of the glideboard 330, with neutral spinal curvature. Grasp the LAT bars, palms facing down and arms extended. If the telescoping squat stand is attached, bend the knees to ensure feet do not make contact with it.

Exercise Description

While maintaining the spine in a neutral or pain-free position, pull the glideboard 330 up the rails until hands are level with shoulders. Allow shoulders to move through full range of motion with scapular movement, from elevation through to depression. Lower the glideboard 330 back down the rails until arms are fully extended.

Teaching Tips

Initiate pull up with scapula depression, followed by arm movement.

Ensure sternum maintains contact with the glideboard 330.

Maintain neutral or pain-free spinal curvature throughout the exercise.

Cue client to keep the shoulders away from the ears.

Avoid hyperextension of the lumbar spine.

Safety Aspects

Avoid hyperextension of the cervical spine.

If movement produces pain in lumbar spine, place both knees outside of the guideboard and extend legs.

REPETITIONS: 12-15 times; Sets: 2-4; Variations: None

3 Pullover Triceps Extension

Joint Complex: Lumbar Spine; Stage: Conditioning; Pulley Pin Placement: 2; Incline Guideline: 2-4; Starting Position: Upright Supine—Grasp handles 980 and pull the glideboard 330 halfway up the rails. Straddle the glideboard 330 and sit at the bottom edge facing away from the tower. Lie back, ensuring head is fully supported and chin tucked toward the chest. Place both feet on the bottom edge of the glideboard 330, with arms extended overhead toward the pulley.

Exercise Description

Move the glideboard 330 up the rails by flexing the elbows and pulling the handles 980 toward the torso. Position the upper arms close to the rib cage, palms facing up with elbows flexed. Keeping elbows stationary, press down on the handles 980 until arms are fully extended, next to the thighs. Return to starting position with control.

Teaching Tips

Maintain lumbar spine in a neutral and pain-free position.

Maintain neutral wrists.

Safety Aspects

Do not lock the elbows out at the bottom of the press.

Do not raise the head during movement.

REPETITIONS: 12-15 times; Sets: 2-4; Variations: None

4 Inverted Biceps Curl

Joint Complex: Lumbar Spine; Stage: Conditioning; Pulley Pin Placement: 1 or 6;

Incline Guideline: 2-4; Starting Position: Inverted Supine—Grasp handles 980 and pull the glideboard 330 halfway up the rails. Straddle the glideboard 330 and sit at the top edge facing the tower. Lie back, ensuring head is fully supported. Place both feet on the top edge of the glideboard 330. Arms are extended, parallel to the torso, palms facing up.

Exercise Description

Pull the glideboard 330 up the rails by curling the handles 980 up toward the shoulders. Return to starting position with control.

Teaching Tips

Maintain the spine in a neutral or pain-free position.

Maintain neutral wrists.

If the glideboard 330 contacts the top or bottom of the rails, adjust body position.

Safety Aspects

Ensure head is fully supported by the glideboard 330, placing pillow or towel behind head if neck is hyperextended.

REPETITIONS: 12-15 times; Sets: 2-4; Variations: None

5 Bilateral Shoulder Abduction

Joint Complex: Lumbar Spine; Stage: Conditioning; Pulley Pin Placement: 2 or 5; Incline Guideline: 2-4; Starting Position: Inverted Supine—Grasp handles 980 and pull the glideboard 330 halfway up the rails. Straddle the glideboard 330 and sit at the top edge. Lie back, ensuring head is fully supported. Place both feet on the top edge of the glideboard 330 with arms extended along the torso, palms facing in.

Exercise Description

Pull the glideboard 330 up the rails by bringing the arms away from the hips, up to shoulder height and with slight shoulder flexion throughout the movement. Return to starting position with control.

Teaching Tips

Keep arms straight with a slight flexion of the elbow throughout the movement. If discomfort is felt in the shoulders, stop just short of shoulder height or within a pain-free range of motion.

Maintain position of the elbows above the glideboard 330 with slight shoulder flexion.

If the glideboard 330 contacts the top or bottom of the rails, adjust body position.

Maintain neutral wrists.

Maintain the spine in neutral or pain-free position.

Arms should always be seen in peripheral vision.

Safety Aspects

Do not raise the handles 980 above shoulder level.

Ensure head is fully supported by the glideboard 330.

Avoid excessive shoulder depression and elevation during the movement.

REPETITIONS: 12-15 times; Sets: 2-4; Variations: None

6 Supine Fly

Joint Complex: Lumbar Spine; Stage: Conditioning; Pulley Pin Placement: 5; Incline Guideline: 2-4; Starting Position: Upright Supine—Grasp handles 980 and pull the glideboard 330 halfway up the rails. Straddle the glideboard 330 and sit at the bottom edge facing away from the tower. Lie back, ensuring head is fully supported and chin tucked toward the chest. Place both feet on the bottom edge of the glideboard 330, with arms extended overhead and slightly anterior to the coronal plane. Elbows are flexed and do not go beyond shoulder height.

Exercise Description

Move the glideboard 330 up the rails by performing adduction of the shoulder in a wide arc movement. Maintain slight shoulder and elbow flexion throughout the exercise. Movement is completed when hands contact hips. Return to starting position with control.

Teaching Tips

Maintain lumbar spine in a flexed position.

Maintain neutral wrists.

Always maintain muscle activation at full shoulder flexion.

Safety Aspects

Do not raise the head during movement.

Move slowly and with control throughout the exercise.

REPETITIONS: 12-15 times; Sets: 2-4; Variations: None

GRAVITYPost-Rehab® Shoulder and Knee Exercises

| Shoulder Exercises | |
|---|---|
| Awareness | |
| 1 | Depression of Scapula |
| 2 | Elevation of Scapula |
| 3 | Retraction of Scapula |
| 4 | Protraction of Scapula |
| | Pre-Positioning |
| 5 | Shoulder Extension |
| 6 | Shoulder Flexion |
| 7 | Shoulder External Rotation |
| 8 | Shoulder Internal Rotation |
| | Dynamic |
| 9 | Pull Up |
| 10 | Pull Up with Pulleys |
| 11 | Shoulder Adduction (In Supine) |
| 12 | Shoulder Abduction (In Supine) |
| 13 | Single Arm Shoulder Flexion |
| 14 | Single Arm Shoulder Extension |
| 15 | Single Arm External Rotation and Overhead Press |
| 16 | Shoulder Extension with Trunk Flexion and Rotation |
| 17 | Kneeling Shoulder Flexion with Trunk Extension and Rotation |
| Shoulder Conditioning Exercises | |
| 1 | Squat |
| 2 | Leg Curl |
| 3 | Inverted Abdominal Crunch |
| 4 | Upper Back Extension |
| 5 | Biceps Curl |
| 6 | Triceps Press |
| KNEE Exercises | |
| Awareness | |
| 1 | Unilateral Squat |
| 2 | Unilateral Hamstring Curl |
| | Dynamic |
| 3 | Bilateral Squat |
| 4 | Unilateral Squat |
| 5 | Bilateral Squat with External Rotation of the Hips |
| 6 | Unilateral Squat with External Rotation of the Hip |

-continued

| Shoulder Exercises | |
|---|---|
| 7 | Bilateral Plyometric Squat |
| 8 | Unilateral Plyometric Squat |
| 9 | Bilateral Plyometric Skiing |
| 10 | Unilateral Plyometric Skiing |
| 11 | Side-lying Single Leg Squat |
| 12 | Quadraped |
| 13 | Triped |
| 14 | Seated Hamstring Curl |
| 15 | Reverse Lunge |
| 16 | Lateral Lunge |
| Knee Conditioning Exercises | |
| 1 | Pull Up |
| 2 | Row with Trunk Flexion and Extension |
| 3 | Chest Press |
| 4 | Pullover Crunch |
| 5 | Triceps Press |
| 6 | Biceps Curl |

GRAVITYPOST-REHAB®EXERCISE MANUAL

| Shoulder Conditioning Exercises | |
|---|---|
| 1 | Squat |
| 2 | Leg Curl |
| 3 | Inverted Abdominal Crunch |
| 4 | Upper Back Extension |
| 5 | Biceps Curl |
| 6 | Triceps Press |
| KNEE Exercises | |
| Awareness | |
| 1 | Unilateral Squat |
| 2 | Unilateral Hamstring Curl |
| | Dynamic |
| 3 | Bilateral Squat |
| 4 | Unilateral Squat |
| 5 | Bilateral Squat with External Rotation of the Hips |
| 6 | Unilateral Squat with External Rotation of the Hip |
| 7 | Bilateral Plyometric Squat |
| 8 | Unilateral Plyometric Squat |
| 9 | Bilateral Plyometric Skiing |
| 10 | Unilateral Plyometric Skiing |
| 11 | Side-lying Single Leg Squat |
| 12 | Quadraped |
| 13 | Triped |
| 14 | Seated Hamstring Curl |
| 15 | Reverse Lunge |
| 16 | Lateral Lunge |
| Knee Conditioning Exercises | |
| 1 | Pull Up |
| 2 | Row with Trunk Flexion and Extension |
| 3 | Chest Press |
| 4 | Pullover Crunch |
| 5 | Triceps Press |
| 6 | Biceps Curl |

Shoulder

Awareness

Definition of Awareness

To improve joint stability and, correspondingly, pain-free functional movement, it is essential that the client develop a correct perception of isolated muscle action and joint position. To do so, specific exercises are designed to enhance and develop a person's awareness of the position of the joint. The Awareness stage focuses on improving proprioception and coordination of the joint and surrounding local muscle system. Be aware of fatigue due to intensity; focus is on proprioception and coordination (quality of movement), NOT strength or endurance training Specific Objectives The client should be able to determine scapula positioning in depression, elevation, retraction and protraction, without external feedback.

Special Considerations

The client or trainer can assist in scapula awareness by the placement of hands to detect any movement.

Although focus is not placed specifically on the spine, ensure a neutral or pain-free position is maintained throughout the exercises.

1 Depression of Scapula

Joint Complex: Shoulder; Stage: Awareness; Incline Guideline: 2-3; Starting Position: Upright Prone with the LAT bars in the pull up position—Push the glideboard 330 330 halfway up the rails. Lie prone with chest near top edge of glideboard 330 with arms extended. Grasp the LAT bars, palms facing down. Bend the knees to keep the feet from hitting the base.

Exercise Description

While keeping arms extended, depress the scapula. Glideboard 330 will move slightly up the rails. Return with control.

Teaching Tips

Focus on pressing the shoulders down, away from the ears.

Maintain arms extended throughout the movement.

Avoid pressing down on the LAT bars.

For more pertinent shoulder positioning, the LAT bars can be secured in the folding position.

Maintain the head and neck in alignment.

Safety Aspects

Avoid flexion of the cervical spine and extension of the lumbar spine during the entire exercise. Encourage neutral spine positioning.

If client is unable to lie prone with full shoulder flexion, begin with client seated, arms by the sides, raising and lowering the shoulder girdle. Progress the exercise by having the client hold the arms in increasing degrees of flexion and abduction. Arms can be straight or with elbows flexed.

REPETITIONS: 12-15 times; Sets: 2-4; Variations: None

2 Elevation of Scapula

Joint Complex: Shoulder; Stage: Awareness; Pulley Pin Placement: 1; Incline Guideline: 2-3; Starting Position: Inverted Supine—Grasp handles and pull the glideboard 330 halfway up the rails. Straddle the glideboard 330 and sit at the top edge. Lie back, ensuring head is fully supported. Place both feet on top edge of glideboard 330 with knees flexed and arms parallel to the torso, palms facing thighs.

Exercise Description

While keeping arms extended, elevate the scapula. Glideboard 330 will move slightly up the rails. Return with control.

Teaching Tips

Maintain contact between scapula and glideboard 330 throughout the exercise with a slight lordosis of the thoracic spine.

Focus on elevating the shoulders toward the ears.

Maintain arms extended throughout the movement.

Safety Aspects

Lower and raise upper body with control when getting into and out of starting position.

If unable to assume the inverted position, perform the movement seated with hands by the sides and holding light weights.

If the client has thoracic kyphosis, support the head with a Support Wedge Pillow.

REPETITIONS: 12-15 times; Sets: 2-4; Variations: None

3 Retraction of Scapula

Joint Complex: Shoulder; Stage: Awareness; Pulley Pin Placement: 3; Incline Guideline: 2-3; Starting Position: Kneeling Backwards—Grasp one handle 980 and pull glideboard 330 halfway up the rails. Place hands, knuckles down, on the glideboard 330 to stabilize movement. Kneel at the top edge of the glideboard 330 facing the tower, sit back on heels. Hold the handle 980 in one hand and extend the arm toward the pulleys with palm facing down. Use the opposite hand to press against the thorax on the side performing the exercise to keep the shoulder and torso from rotating.

Exercise Description

While keeping the arm extended, retract the scapula on the same side. Glideboard 330 will move slightly up the rails. Return with control.

Teaching Tips

Maintain the spine in a neutral or pain-free position.

The spine should not flex, extend or rotate with the movement.

Focus on pulling the scapula back and toward the midline of the body.

Maintain arm extended throughout the movement.

Keep the shoulder, elbow and wrist in one line, without letting the arm drop toward the ground.

Safety Aspects

If client is unable to kneel with full knee flexion, place a Support Wedge Pillow between the calves and the buttocks.

If client is unable to go into full plantar flexion, place a rolled up towel between the ankle and glideboard 330.

The client can perform the exercise in the seated position with feet resting on ground. Allow the legs to assist, if necessary.

Avoid placing the resting hand on the clavical or sternum. Contact should be with the upper ribs.

REPETITIONS: 12-15 times on each side; Sets: 2-4; Variations: None

4 Protraction of Scapula

Joint Complex: Shoulder; Stage: Awareness; Pulley Pin Placement: 3; Incline Guideline; 2-4; Starting Position: Seated Forward—Grasp one handle, pull the glideboard 330 partway up the rails. Sit at the top edge of the glideboard 330, facing away from the tower. Allow feet to rest on the floor. Pull the handle 980 in front of the client with the cable 970 running in alignment with the shoulder. Hold the handle 980 with palm facing down, and arm extended, parallel to the shoulder. Use the free hand to press against the thorax on the opposite side performing the exercise to keep the shoulder and torso from rotating.

Exercise Description

While keeping the arm extended, protract the scapula on the same side. Glideboard 330 will move slightly up the rails. Return with control.

Teaching Tips

Maintain the spine in a neutral or pain-free position.

The spine should not flex, extend or rotate with the movement.

Allow feet to assist in the movement if necessary.

Maintain arm extended throughout the movement.

Focus on the scapula sliding laterally during the movement, pushing away from the midline of the body. Feel the shoulder blade slide around the thorax into the armpit.

Keep the shoulder, elbow and wrist in one line, without letting the arm drop toward the floor.

Safety Aspects

Adjust pin placement to ensure correct alignment with the shoulder.

Avoid placing the resting hand on the clavical or sternum. Contact should be with the upper ribs.

REPETITIONS: 12-15 times on each side; Sets: 2-4; Variations: None

Shoulder

Pre-Positioning

Definition of Pre-Positioning

Following the achievement of joint complex awareness the next step is to progressively improve the dynamic function of the joint. To do so, specific exercises are designed to actively and passively position one section of a joint complex, preventing it from movement, while actively moving another. This occurs by isometrically contracting all stabilizing muscle systems of a specific region while initiating functional movement with different levels of loading. The focus is on the quality and control of movement and the loading should be modified to achieve this.

Pre-Position

The pre-positioning of the scapula for all exercises in this section is retraction and depression.

Specific Objectives

By minimizing scapula movement through performing an isometric contraction, the supporting muscles are strengthened.

The client will be introduced to functional movement, utilizing the arms, while maintaining an appropriate scapula position.

Special Considerations

Care should be taken to maintain control throughout the exercises; avoid hyperextending or hyperflexing the shoulder joint.

During exercises utilizing handles, ensure neutral positioning of the wrist.

The pin placements provided are recommendations. Trainers should adjust as necessary, depending on the stature of the client, in order to maintain appropriate lines of pull.

5 Shoulder Extension (Scapula in Retraction and Depression)

Joint Complex: Shoulder; Stage: Pre-positioning; Pulley Pin Placement: 2-3; Incline Guideline: 2-4; Starting Position: Kneeling Backwards—Grasp handles and pull glideboard 330 halfway up the rails. Place hands, knuckles down, on the glideboard 330 to stabilize movement. Kneel at the top edge of the glideboard 330 facing the tower, sit back on heels. Slightly flex the elbows and hold the handles with palms facing in. Depress and retract the scapula.

Exercise Description

While maintaining the scapula in retraction and depression and the spine in a neutral or pain-free position, pull the handles toward the rib cage, leading with the elbows. The glideboard 330 will move up the rails. Return to starting position by slowly extending the arms, keeping the hands slightly behind the knees.

Teaching Tips

Throughout the row action, maintain scapula in retraction and depression and the spine in a neutral or pain-free position.

The range of motion at the gleno-humeral joint should remain limited as the scapula should be static throughout the exercise.

When returning to starting position, do not allow arms to fully extend.

Maintain static spinal posture throughout the exercise.

Safety Aspects

If client is unable to kneel with full knee flexion, place a Support Wedge Pillow between the calves and the buttocks.

If client is unable to go into full plantar flexion, place a rolled up towel between the ankle and glideboard 330.

When necessary provide tactile feedback by placing the hands between the scapula and encouraging client to maintain the position.

The client can perform the exercise in the seated position with feet resting on the ground. Allow the legs to assist, if necessary.

REPETITIONS: 12-15 times; Sets: 2-4; Variations: None

6 Shoulder Flexion (Scapula in Retraction and Depression)

Joint Complex: Shoulder; Stage: Pre-positioning; Pulley Pin Placement: 2-3; Incline Guideline: 2-4; Starting Position: Kneeling Forward—Grasp both handles, pull the glideboard 330 partway up the rails. Place hands, knuckles down, on the glideboard 330 to stabilize movement. Kneel at the top edge of the glideboard 330 facing away from the tower and sit back on heels. Feet should be positioned to allow the toes to hang over the top edge of the glideboard 330. Pull the handles 980 forward with the cables 970 running under the arms, next to the torso. Hold the handles 980 with palms facing in and elbows flexed, close to the torso. Retract and depress the scapula.

Exercise Description

While maintaining the scapula in retraction and depression and the spine in a neutral or pain-free position, push the handles 980 away from the rib cage. The glideboard 330 will move up the rails. Stop the movement before full elbow extension occurs to avoid the scapula moving into protraction. Return to starting position with control.

Teaching Tips

Throughout the press action, maintain scapula in retraction and depression and the spine in a neutral or pain-free position. Always consider that little movement occurs during shoulder flexion without scapula movement.

When performing press, do not allow arms to fully extend.

Maintain static spinal posture throughout the exercise.

Allow toes to lay over top edge of glideboard 330 for stability.

Handles 980 follow same pathway out and back.

Push parallel to the floor.

Safety Aspects

The client can perform the exercise in the seated position with feet resting on the ground. Allow the legs to assist, if necessary.

REPETITIONS: 12-15 times; Sets: 2-4; Variations: None

7 Shoulder External Rotation (Scapula in Retraction and Depression)

Joint Complex: Shoulder; Stage: Pre-positioning; Pulley Pin Placement: 2; Incline Guideline: 1-3; Starting Position: Seated Lateral—Stand to the side of the exercise device 100 with back facing the glideboard 330. Grasp the handle 980 on the same side of the exercise device 100 and pull the glideboard 330 halfway up. Sit toward the top edge of the glideboard 330 facing sideways with feet resting on the ground. Hold the handle 980 with the hand farthest from the tower, with elbow flexed at 90° and held close to the torso. Depress and retract the scapula on the same side. If possible, place the opposite hand behind the back to detect any movement of the scapula.

Exercise Description

While maintaining the scapula in retraction and depression and flexed elbow close to the torso, pull the handle 980 across the body in an arc motion to achieve external rotation. The glideboard 330 will move slightly up the rails. Return to starting position with control. Repeat for the desired number of repetitions then change arms.

Teaching Tips

- Maintain the scapula in retraction and depression and the spine in a neutral or pain-free position throughout the exercise.
- Place the opposite hand behind the back to detect any movement of the scapula.
- Avoid any trunk rotation.
- Maintain the elbow position as close to the torso as possible throughout the exercise.
- Encourage a full range of motion.
- Maintain the spine in a neutral or pain-free position.
- If needed, client can place a folded towel between elbow and torso to assist in maintaining elbow position.

Safety Aspects

- Be aware of appropriate intensity and ensure a pain-free movement.

REPETITIONS: 12-15 times on each side; Sets: 2-4; Variations: Kneeling Lateral—Perform the movement in a kneeling, heel sit position.

8 Shoulder Internal Rotation (Scapula in Retraction and Depression)

Joint Complex: Shoulder; Stage: Pre-positioning; Pulley Pin Placement: 2; Incline Guideline: 1-3; Starting Position: Seated Lateral—Stand to the side of the exercise device 100 with back facing the glideboard 330. Grasp the handle 980 on the same side of the exercise device 100 and pull the glideboard 330 halfway up. Sit toward the top edge of the glideboard 330 facing sideways with feet resting on the ground. Hold the handle 980 with the hand closest to the tower, with elbow flexed at 90° and held close to the torso. Depress and retract the scapula on the same side. If possible, place the opposite hand behind the back to detect any movement of the scapula.

Exercise Description

While maintaining the scapula in retraction and depression and flexed elbow close to the torso, pull the handle 980 across the body in an arc motion to achieve internal rotation. The glideboard 330 will move slightly up the rails. Return to starting position with control. Repeat for the desired number of repetitions then change arms.

Teaching Tips

- Maintain the scapula in retraction and depression and the spine in a neutral or pain-free position throughout the exercise.
- Avoid any trunk rotation.
- Maintain the elbow position as close to the torso as possible throughout the exercise.
- Encourage a full range of motion.
- To modify the force angle on the shoulder, use the opposite handle 980.
- If needed, client can place a folded towel between elbow and torso to assist in maintaining elbow position.

Safety Aspects

- Be aware of appropriate intensity and ensure a pain-free movement.

REPETITIONS: 12-15 times on each side; Sets: 2-4; Variations: Kneeling Lateral—Perform the movement in a kneeling, heel sit position. To modify the force angle on the shoulder, use the opposite handle 980.

Shoulder

Dynamic

Definition of Dynamic

The third stage is to allow the joint to progress into loaded functional tasks. These active movements of the joint complex through a pain-free range of motion focus on strength, endurance and appropriate range of motion. This final stage incorporates cognitive control of all stabilizing muscle systems, as well as the application of long-term functional behaviors. During this stage, a greater focus can be given to intensity, however the quality and control of movement should never be jeopardized.

Specific Objectives

- Throughout the Dynamic stage, the client should be able to maintain awareness and muscle control while performing multi joint movements.
- Consideration is given to exercises that will help the client perform normal, everyday tasks pain-free.
- Focus is placed on moving the shoulder through its extensive range of movement patterns.

Special Considerations

- Care should be taken to maintain control of the scapula and to remain pain-free throughout the exercises.
- The pin placements provided are recommendations. Trainers should adjust as necessary, depending on the stature of the client, in order to maintain appropriate lines of pull.
- Although focus is not placed specifically on the spine, ensure a neutral or pain-free position is maintained throughout the exercises.

9 Pull Up

Joint Complex: Shoulder; Stage: Dynamic; Pulley Pin Placement: N/A; Incline Guideline: 3-6; Starting Position: Upright Prone—With the LAT bars in the pull up position, push the glideboard 330 halfway up the rails. Lie prone with chest near the top edge of the glideboard 330, with neutral spinal curvature. Grasp the LAT bars, palms facing down and arms extended. If the telescoping squat stand is attached, bend the knees to ensure feet do not make contact with it.

Exercise Description

While maintaining the spine in a neutral or pain-free position, pull the glideboard 330 up the rails until hands are level with shoulders. Allow shoulders to move through full range of motion with scapular movement, from elevation through to depression. Lower the glideboard 330 back down the rails until arms are fully extended.

Teaching Tips

- Initiate pull up with scapula depression, followed by arm movement.
- Maintain neutral or pain-free spinal curvature throughout the exercise.
- Cue client to keep the shoulders away from the ears.
- Adjust body position on the glideboard 330 to allow for full range of motion.
- Reach the top of the head toward the tower to assist in maintaining cervical positioning.

Safety Aspects

- Avoid hyperextension of the lumbar and cervical spine.

REPETITIONS: 12-15 times; Sets: 2-4; Variations: None

10 Pull Up with Pulleys

Joint Complex: Shoulder; Stage: Dynamic; Pulley Pin Placement: 5; Incline Guideline: 3-6; Starting Position: Upright Prone—Grasp the handles 980 and pull the glideboard 330 halfway up the rails. Facing the tower, straddle the glideboard 330 and anchor the hands near the top of the glideboard 330. Enter into a four-point kneeling position then slowly lower into a prone position, with the chest near the top edge of the glideboard 330, with neutral spinal curvature. Hold handles 980 with palms facing down and arms extended. Bend the knees to ensure feet do not hit the squat stand.

Exercise Description

While maintaining the spine in a neutral or pain-free position, pull the glideboard 330 up the rails until hands are level with shoulders. Allow shoulders to move through full range of motion with scapular movement, from elevation through to depression. End with maximum elbow flexion. Lower the glideboard 330 back down the rails until arms are fully extended.

Teaching Tips

- Initiate pull up with scapula depression, followed by arm movement.
- Maintain neutral or pain-free spinal curvature throughout the exercise.
- Cue client to keep the shoulders away from the ears.
- Adjust body position on the glideboard 330 to allow for full range of motion.
- Handles 980 should always be higher than the glideboard 330.
- Move elbows in an arc motion.
- Gently press chest down onto the glideboard 330.
- Ensure that the scapula are retracted.
- Maintain consistent pressure between chest and glideboard 330 throughout the movement.

Safety Aspects

- Using the pulleys ensures the client must maintain external rotation of the shoulders.
- Avoid pressing downward with the handles 980.
- REPETITIONS: 12-15 times; Sets: 2-4; Variations: None 11 Shoulder Adduction (in Supine)

Joint Complex: Shoulder; Stage: Dynamic; Pulley Pin Placement: 5; Incline Guideline: 2-4; Starting Position: Upright Supine—Grasp handles 980 and pull the glideboard 330 halfway up the rails. Straddle the glideboard 330 and sit facing away from the tower. Lie back on the glideboard 330, ensuring head is fully supported. Knees are flexed and feet placed on the glideboard 330, shoulder-width apart. Holding the handles 980, arms are lengthened and abducted slightly above the torso with the shoulders flexed.

Exercise Description

Raise the glideboard 330 by adducting the arms to the torso. From this position, abduct the arms and bring the handles 980 back to starting position.

Teaching Tips

- Maintain a neutral spine throughout the exercise.
- Position scapula in depression and retraction prior to the movement.
- Adjust body position on the glideboard 330 to allow for full range of motion.
- Avoid shoulder protraction by keeping the shoulders on the glideboard 330.
- Maintain neutral wrists throughout the movement.
- Abduction should be at shoulder height and within a pain-free range of motion.

Safety Aspects

- Ensure head is fully supported on glideboard 330.
- Be aware of shoulder protraction.
- REPETITIONS: 12-15 times; Sets: 2-4; Variations: None 12 Shoulder Abduction (in Supine)

Joint Complex: Shoulder; Stage: Dynamic; Pulley Pin Placement: 5; Incline Guideline: 1-4; Starting Position: Inverted Supine—Grasp handles 980 and pull the glideboard 330 halfway up the rails. Straddle the glideboard 330 and sit at the top edge, facing the tower. Lie back on the glideboard 330, ensuring head is fully supported. Flex hips and knees. Hold handles 980 with arms extended by the sides of the torso.

Exercise Description

Raise the glideboard 330 by abducting the arms to no greater than parallel with the shoulders. Return to starting position with control.

Teaching Tips

- Keep arms straight with a slight flexion of the elbow throughout the movement.
- Maintain position of the elbows above the glideboard 330 with slight shoulder flexion.
- Ensure head is supported by the glideboard 330, with chin tucked toward the chest.
- Position scapula in depression and retraction prior to the movement.
- Adjust body position on the glideboard 330 to allow for full range of motion.
- Maintain a neutral spine throughout the exercise.

Safety Aspects

- Lower and raise upper body with control when getting into and out of position.
- If client is unable to assume the inverted position, use a Support Wedge Pillow to lift the head or perform the movement without the handles 980 in an upright supine position.
- REPETITIONS: 12-15 times; Sets: 2-4; Variations: None 13 Single Arm Shoulder Flexion Joint Complex: Shoulder; Stage: Dynamic; Pulley Pin Placement: 6; Incline Guideline: 1-4; Starting Position: Inverted Supine—Grasp handles 980 and pull the glideboard 330 halfway up the rails. Straddle the glideboard 330 and sit at the top edge, facing the tower. Lie back on the glideboard 330, ensuring head is fully supported. Flex hips and knees. Hold handles 980 with arms extended by the sides of the torso.

Exercise Description

Raise the glideboard 330 by moving one arm in an arc motion to an overhead position. Return to starting position with control. Maintain an extended arm throughout the movement. Repeat for the desired number of repetitions then change arms.

Teaching Tips

- Ensure head is supported by the glideboard 330, with chin tucked toward the chest.
- Position scapula in depression and retraction prior to the movement.
- Maintain arm extended with elbow slightly flexed.
- Adjust body position on the glideboard 330 to allow for full range of motion.
- Maintain a neutral spine throughout the exercise.

Safety Aspects

- Lower and raise upper body with control when getting into and out of position.
- REPETITIONS: 12-15 times; Sets: 2-4; Variations: None 14 Single Arm Shoulder Extension Joint Complex: Shoulder; Stage: Dynamic; Pulley Pin Placement: 1; Incline Guideline: 1-4; Starting Position: Upright Supine—Grasp one handle 980 and pull the glideboard 330 halfway up the rails. Straddle the glideboard 330 and sit facing away from the tower. Lie back, ensuring head is fully supported. Knees are flexed and feet placed on glideboard 330, shoulder-width apart. Hold the handle 980 with the arm extended overhead. The opposite arm is extended by the side of the torso.

Exercise Description

Raise the glideboard 330 by moving one arm in a downward arc motion. Return to starting position with control.

Maintain an extended arm throughout the movement with slight elbow flexion. Repeat for the desired number of repetitions then change arms.

Teaching Tips

Ensure head is supported by the glideboard 330, with chin tucked toward the chest.

Position scapula in depression and retraction prior to the movement.

Adjust body position on the glideboard 330 to allow for full range of motion.

Maintain arms extended with elbows slightly flexed.

Always maintain muscle activation at full shoulder flexion.

Maintain a neutral spine throughout the exercise.

Safety Aspects

Always move within a pain-free range of motion.

REPETITIONS: 12-15 times; Sets: 2-4; Variations: None

15 Single Arm External Rotation and Overhead Press

Joint Complex: Shoulder; Stage: Dynamic; Pulley Pin Placement: 1; Incline Guideline: 1-4; Starting Position: Inverted Supine—Grasp handles 980 and pull the glideboard 330 halfway up the rails. Straddle the glideboard 330 and sit at the top edge, facing the tower. Lie back on the glideboard 330, ensuring head is fully supported. Flex hips and knees and rest feet on glideboard 330. Hold handles 980 with arms extended by the sides of the torso.

Exercise Description

Using one arm, raise the glideboard 330 by the following sequence: Pull the handle 980 up the torso, leading with the elbow, then externally rotate the shoulder and perform an overhead press. Return to starting position with control, reversing the sequence. Repeat for the desired number of repetitions then change arms.

Teaching Tips

Ensure the head is supported by the glideboard 330, with chin tucked toward the chest.

Adjust body position on the glideboard 330 to allow for full range of motion.

Position scapula in depression and retraction prior to the movement.

Maintain a neutral spine throughout the exercise.

Move smoothly and with control throughout the shoulder action.

Maintain neutral wrist.

Safety Aspects

Ensure a pain-free movement, being aware of the torque placed on the shoulder.

REPETITIONS: 12-15 times; Sets: 2-4; Variations: None

16 Shoulder Extension with Trunk Flexion and Rotation

Joint Complex: Shoulder; Stage: Dynamic; Pulley Pin Placement: 5; Incline Guideline: 1-4; Starting Position: Upright Supine—Grasp one handle 980 and pull the glideboard 330 halfway up the rails. Straddle the glideboard 330 and sit facing away from the tower. Lie back, ensuring head is fully supported. Knees are flexed and feet placed on glideboard 330, shoulder-width apart. Hold the handle 980 with both hands and the arms extended diagonally overhead toward the pulley.

Exercise Description

Raise the glideboard 330 by pulling the handle 980 across the body to the inside of the opposite knee. Maintain extended arms and allow for trunk rotation throughout the movement. Return to starting position with control. Repeat for the desired number of repetitions then change sides.

Teaching Tips

Allow the shoulders and the head to raise off the glideboard 330 during the diagonal pulling action.

Follow hands with the eyes, allowing head to follow movement.

Adjust body position on the glideboard 330 to allow for full range of motion.

Maintain static pelvic positioning throughout the exercise.

Keep chin tucked in toward chest.

Move hands in a straight line from start to finish.

Safety Aspects

Maintain stability on glideboard 330 by ensuring the feet are fully supported on glideboard 330.

Ensure eyes follow handles 980 to avoid incorrect cervical spine movement.

REPETITIONS: 12-15 times; Sets: 2-4; Variations: None

17 Kneeling Shoulder Flexion with Trunk Extension and Rotation

Joint Complex: Shoulder; Stage: Dynamic; Pulley Pin Placement: 1; Incline Guideline: 1-4; Starting Position: Kneeling Backwards—Grasp one handle 980 with the opposite hand. Pull the glideboard 330 halfway up the rails. Straddle the glideboard 330 facing the tower. Place hands, knuckles down, on the glideboard 330 to stabilize movement. Kneel at the top edge of the glideboard 330 facing the tower, sit back on heels. Extend the arm holding the handle 980 and place the other hand behind the back. Allow the torso to flex and rotate toward the pulley.

Exercise Description

Pull the glideboard 330 up the rails by bringing the handle 980 up and across the front of the torso in an arc motion until the handle 980 is overhead and outside the shoulder. Allow the trunk to rotate throughout the movement. Return to starting position with control. Repeat for the desired number of repetitions then change sides.

Teaching Tips

Lead with the elbow throughout the arc motion.

Follow hand with the eyes, allowing head to follow movement.

Maintain arm extension with slight elbow flexion throughout the exercise.

Stabilize the trunk prior to and throughout the movement.

Movement is initiated by cervical and then thoracic spine extension.

Safety Aspects

If client is unable to kneel with full knee flexion, place a wedge between the calves and the buttocks or in a sitting position.

Anchor in and out of starting position by placing knuckles on the glideboard 330.

Adjust body position on the glideboard 330 to allow for full range of motion.

REPETITIONS: 12-15 times; Sets: 2-4; Variations: None

Shoulder

Conditioning Exercises

1 Squat

Joint Complex: Shoulder; Stage: Conditioning; Pulley Pin Placement: N/A; Incline Guideline: 3-6; Starting Position: Upright Supine—Push the glideboard 330 halfway up the rails. Straddle the glideboard 330 and sit at the bottom edge, facing away from the tower. Lie back with head resting on glideboard 330, legs extended but knees not locked, feet placed against telescoping squat stand in alignment directly under hip joints.

Exercise Description

While maintaining the spine in a neutral or pain-free position, lower the glideboard 330 by flexing the knees. Return to the starting position with control.

Teaching Tips

Be aware of degree of knee flexion, always maintaining a pain-free range of motion.

Ensure that middle of patellae align with middle of the feet throughout the motion.

Relax the head, neck and shoulders.

Maintain the spine in a neutral or pain-free position throughout the exercise.

Safety Aspects

Do not lock knees at the top of the movement.

REPETITIONS: 12-15 times; Sets: 2-4; Variations: None

2 Leg Curl

Joint Complex: Shoulder; Stage: Conditioning; Pulley Pin Placement: N/A; Incline Guideline: 2-4; Starting Position: Inverted Supine—Straddle the rails and sit at the top edge of the glideboard 330, facing the tower. Once body weight is fully supported by the glideboard 330, secure feet into the Folding Foot Holder and extend legs with knees slightly flexed. Lie back on the glideboard 330 with head fully supported and chin tucked toward the chest. Maintain lumbar spine in flexion throughout the exercise.

Exercise Description

While maintaining the spine in a neutral or pain-free position, use the heels to pull the glideboard 330 up the rails, allowing the knees to flex through a pain-free range of motion. Return to starting position with control.

Teaching Tips

Ensure that middle of patellae align with middle of the feet throughout the motion.

Be aware of knee flexion: maintain alignment and flex through pain-free range of motion.

Safety Aspects

Lower and raise upper body with control when getting into and out of position.

REPETITIONS: 12-15 times; Sets: 2-4; Variations: None

3 Inverted Abdominal Crunch

Joint Complex: Shoulder; Stage: Conditioning; Pulley Pin Placement: N/A; Incline Guideline: 1-4; Starting Position: Inverted Supine—Push the glideboard 330 halfway up the rails. Straddle the rails and sit at the top edge of the glideboard 330, facing the tower. Once body weight is fully supported by the glideboard 330, secure feet into the Folding Foot Holder and extend legs. Lie back on the glideboard 330 with head fully supported and chin tucked toward the chest. Place hands behind the head or crossed over the chest. Using heels, pull the glideboard 330 up the rails by flexing the knees to a 90° angle.

Exercise Description

While maintaining bent leg position, raise head and shoulder blades off the glideboard 330 by contracting the abdominal muscles. Return to starting position with control.

Teaching Tips

Keep tension on the abdominals throughout the entire movement.

Maintain the spine in a neutral or pain-free position.

If the movement is too difficult, place arms across the chest or reach arms to outer thighs.

Slightly plantar flex the feet.

Safety Aspects

If hand placement is behind the head, do not allow client to pull excessively on the head.

Lower and raise upper body with control when getting into and out of position.

If client is unable to assume the inverted position, perform the movement at a lower incline and in an upright position.

REPETITIONS: 12-15 times; Sets: 2-4; Variations: None

4 Upper Back Extension

Joint Complex: Shoulder; Stage: Conditioning; Pulley Pin Placement: N/A; Incline Guideline: 2-3; Starting Position: Kneeling Backwards—With glideboard 330 resting at the base, place hands, knuckles down, on top to stabilize movement. Kneel in the middle of the glideboard 330 facing the tower, sit back on the heels. Place hands, palms up, behind the back and resting on the lumbar spine. Lean forward, resting chest and trunk on thighs.

Exercise Description

While maintaining the lumbar position, lift the ribcage off the thighs by extending the cervical and thoracic spine. Movement should begin with cervical spine and articulate into the thoracic spine.

Teaching Tips

Initiate the movement by lengthening the neck and slightly raising the head.

Avoid hyperextension of the cervical spine.

Keep lumbar movement to a minimum.

End of the movement occurs when ribcage and upper trunk lose contact with the thighs.

Maintain contact between the buttocks and the heels.

Safety Aspects

If client is unable to kneel with full knee flexion, place a Support Wedge Pillow between the calves and the buttocks.

REPETITIONS: 12-15 times; Sets: 2-4; Variations: None

5 Biceps Curl

Joint Complex: Shoulder; Stage: Conditioning; Pulley Pin Placement: 1; Incline Guideline: 3-6; Starting Position: Backwards Seated—Grasp handles 980 and pull the glideboard 330 halfway up the rails. Straddle the rails and sit toward the top edge of the glideboard 330, facing the tower. Position the upper arms in tight by the torso, palms facing up. Extend arms directly toward the pulleys with minimal shoulder flexion. Lift feet off the floor.

Exercise Description

Pull the glideboard 330 up the rails by curling the handles 980 up toward the shoulders, keeping elbows stationary. Return to the starting position with control.

Teaching Tips

Keep upper arms close to the torso and stationary.

Maintain upright, neutral or pain-free posture.

Maintain neutral wrists.

Safety Aspects

Avoid movement at the shoulder throughout the exercise.

Avoid torso movement in the sagittal plane.

REPETITIONS: 12-15 times; Sets: 2-4; Variations: None

6 Triceps Press

Joint Complex: Shoulder; Stage: Conditioning; Pulley Pin Placement: 3; Incline Guideline: 2-4; Starting Position: Upright Supine—Grasp handles 980 and pull the glideboard 330 halfway up the rails. Straddle the glideboard 330 and sit at the bottom edge facing away from the tower. Lie back, ensuring head is fully supported. Place both feet on the bottom edge of the glideboard 330. Position the upper arms in tight by the torso, palms facing up with elbows flexed.

Exercise Description

Keeping elbows stationary, press down on the handles 980 until arms are fully extended next to the thighs. Lower the glideboard 330 back down the rails by bringing the handles 980 back to the starting position.

Teaching Tips

Maintain the upper arms stationary and close to the torso throughout the exercise.

Maintain neutral wrists.

Safety Aspects

Avoid movement at the shoulder throughout the exercise.

Maintain the spine in a neutral or pain-free position throughout the movement.

Do not lock the elbows at the bottom of the press.

Do not raise head during movement.

REPETITIONS: 12-15 times; Sets: 2-4; Variations: None

Knee

Awareness

Definition of Awareness

To improve joint stability and, correspondingly, pain-free functional movement, it is essential that the client develop a correct perception of isolated muscle action and joint position. To do so, specific exercises are designed to enhance and develop a person's awareness of the position of the joint. The Awareness stage focuses on improving proprioception and coordination of the joint and surrounding local muscle system. Be aware of fatigue due to intensity; focus is on proprioception and coordination (quality of movement), NOT strength or endurance training Specific Objectives The client should become aware of maintaining a linear relationship between the hip, knee and ankle, for the purpose of maintaining correct alignment during active knee flexion.

Clients should also become aware of the degree of flexion that is occurring at the knee during specific exercises.

As clients improve in their awareness of knee flexion, they should be able to correctly perform the exercises without external cues from the trainer.

Special Considerations

During the unilateral squat exercise, specific focus is given to maintaining a normal arch of the foot. This assists in controlling proper alignment throughout the exercise by reducing medial and lateral knee movement. To increase awareness of the arch position, have the client remove his or her shoes (in the awareness stage only).

Although focus is not placed specifically on the spine, ensure a neutral or pain-free position is maintained throughout the exercises.

To assist the client in obtaining awareness during knee flexion exercises, trainer can provide verbal or visual cues, indicating an endpoint of flexion.

To determine a client's competency in achieving correct alignment and degree of flexion, have the client close his or her eyes and perform the exercise.

1 Unilateral Squat

Joint Complex: Knee; Stage: Awareness; Pulley Pin Placement: N/A; Incline Guideline: 1-2; Starting Position: Upright Supine—Push the glideboard 330 halfway up the rails, straddle the glideboard 330 and sit at the bottom edge, facing away from the tower. Lie back, ensuring head is fully supported. Place one foot toward the center of the squat stand and the other on the lower edge of the glideboard 330.

Exercise Description

Lower the glideboard 330 down the rails by flexing the active knee and squatting with one leg down to a set degree of flexion which is determined by the PFT. Return to starting position with control. Repeat by returning to the set degree of flexion and for the desired number of repetitions. Change legs.

Teaching Tips

Ensure that middle of patella aligns with middle of foot throughout the motion.

Maintain the arch in the foot; do not allow foot to pronate.

Be aware of knee flexion: maintain alignment and flex through pain-free range of motion.

Maintain a slow tempo throughout the exercise.

Align foot with hip, knee and ankle.

Keep weight evenly distributed between the ball and heel of the foot.

Safety Aspects

Do not lock knee at top of the movement.

REPETITIONS: 12-15 times; Sets: 2-4; Variations: Have client close their eyes and move within a set range of motion to test knee flexion awareness.

2 Unilateral Hamstring Curl

Joint Complex: Knee; Stage: Awareness; Pulley Pin Placement: N/A; Incline Guideline: 1-2; Starting Position: Inverted Supine—Straddle the rails and sit at the top edge of the glideboard 330, facing the tower. Once body weight is fully supported by the glideboard 330, secure one foot into the Folding Foot Holder. Lie back on the glideboard 330 with secured leg extended and foot aligned directly above the hip joint. Rest the head on the glideboard 330 with the chin tucked toward the chest. Hold the opposite knee to the chest.

Exercise Description

Using the heel, pull the glideboard 330 up the rails, allowing the knee to flex through a pain-free range of motion. The PFT can set degree of knee flexion. Return to starting position with control. Repeat by returning to set degree of flexion and for the desired number of repetitions. Change legs.

Teaching Tips

Ensure that middle of patella aligns with middle of the foot throughout the motion.

Be aware of knee flexion: maintain alignment and flex through pain-free range of motion.

Maintain a slow tempo during the movement.

Slightly plantar flex the foot.

Align foot with hip, knee and ankle.

Close the eyes to test knee flexion awareness.

Safety Aspects

Be aware of appropriate intensity, as hamstrings may experience early fatigue.

If client is unable to assume the inverted position, use a Support Wedge Pillow or perform the movement in an upright position.

REPETITIONS: 12-15 times; Sets: 2-4; Variation: Have client close their eyes and move within a set range of motion to test knee flexion awareness.

Knee

Dynamic

Definition of Dynamic

The dynamic stage is to allow the joint to progress into loaded functional tasks. These active movements of the joint complex through a pain-free range of motion focus on strength, endurance and appropriate range of motion. This final stage incorporates cognitive control of all stabilizing muscle systems, as well as the application of long-term functional behaviors. During this stage, a greater focus can be given to intensity, however the quality and control of movement should never be jeopardized.

Specific Objectives

Throughout the Dynamic stage, the client should be able to maintain proper alignment and muscle control while performing complex movement patterns.

The client should be able to place the knee into flexion with control through the eccentric and concentric contractions of the surrounding muscles. These movements reflect high impact actions such as running and jumping.

Consideration is given to exercises that will help the client perform normal, everyday tasks pain-free.

Special Considerations

Although focus is not placed specifically on the spine, ensure a neutral or pain-free position is maintained throughout the exercises.

Low impact movements can be performed without shoes. This increases internal feedback for the client and allows the trainer to visually spot the foot.

Due to the nature of the high impact movements included in this stage, the trainer should be aware of how the client is absorbing the impact through the hips, knees and ankles 3 Bilateral Squat Joint Complex: Knee; Stage: Dynamic; Pulley Pin Placement: N/A; Incline Guideline: 3-6; Starting Position: Upright Supine—Push the glideboard 330 halfway up the rails. Straddle the glideboard 330 and sit at the bottom edge, facing away from the tower. Lie back with head resting on glideboard 330, legs extended but knees not locked, feet placed against telescoping squat stand in alignment directly under hip joint.

Exercise Description

While maintaining the spine in a neutral or pain-free position, lower the glideboard 330 by flexing the knees. Slowly return to starting position.

Teaching Tips

Be aware of degree of knee flexion, always maintaining a pain-free range of motion.

Ensure that middle of patellae align with middle of the feet throughout the motion.

Relax the head, neck and shoulders.

Maintain the spine in a neutral or pain-free position throughout the exercise.

Safety Aspects

Do not lock knees at the top of the movement.

REPETITIONS: 12-15 times; Sets: 2-4; Variations: None

4 Unilateral Squat

Joint Complex: Knee; Stage: Dynamic; Pulley Pin Placement: N/A; Incline Guideline: 3-6; Starting Position: Upright Supine—Push the glideboard 330 halfway up the rails, straddle the glideboard 330 and sit at the bottom edge. Lie back, ensuring head is fully supported. Place one foot toward the center of the squat stand and the other on the lower edge of the glideboard 330.

Exercise Description

Lower the glideboard 330 down the rails by flexing the active knee and squatting with one leg. Return to starting position with control. Repeat for the desired number of repetitions then change legs.

Teaching Tips

Ensure that middle of patella aligns with middle of the foot throughout the motion.

Maintain the arch in the foot; do not allow foot to pronate.

Be aware of degree of knee flexion, always maintaining a pain-free range of motion.

Maintain the spine in a neutral or pain-free position throughout the exercise.

Safety Aspects

Do not lock knee at top of the movement.

REPETITIONS: 12-15 times; Sets: 2-4; Variations: None

5 Bilateral Squat with External Rotation of the Hips

Joint Complex: Knee; Stage: Dynamic; Pulley Pin Placement: N/A; Incline Guideline: 3-6; Starting Position: Upright Supine—Push the glideboard 330 halfway up the rails. Straddle the glideboard 330 and sit at the bottom edge, facing away from the tower. Lie back, ensuring head is fully supported. Place feet on squat stand, shoulder-width apart, with toes pointing outward 45°. Legs are extended but knees not locked.

Exercise Description

While maintaining external hip rotation, lower the glideboard 330 by flexing the knees. Slowly return to starting position.

Teaching Tips

Be aware of degree of knee flexion, always maintaining a pain-free range of motion.

Maintain external rotation of the hip and ensure the knees track over the feet throughout the movement.

Focus on the ball of the foot remaining in contact with the squat stand.

Relax the head, neck and shoulders.

Maintain the spine in a neutral or pain-free position throughout the exercise.

By externally rotating the hip, focus is placed on the vastus medialis.

Safety Aspects

Do not lock knees at the top of the movement.

REPETITIONS: 12-15 times; Sets: 2-4; Variations: None

6 Unilateral Squat with External Rotation of the Hip

Joint Complex: Knee; Stage: Dynamic; Pulley Pin Placement: N/A; Incline Guideline: 3-6; Starting Position: Upright Supine—Push the glideboard 330 halfway up the rails. Straddle the glideboard 330 and sit at the bottom edge, facing away from the tower. Lie back, ensuring head is fully supported. Place one foot on the center of the squat stand, with toes pointing outward 45°. Contact only with the ball of the foot not with the heel. Leg is extended but knee not locked. Flex the opposite leg in hip and knee joint and externally rotate the hip. Maintain this position by holding the lower leg with the same hand.

Exercise Description

While maintaining external hip rotation, lower the glideboard 330 by flexing the knee. Heel moves off the squat stand during knee flexion. Slowly return to starting position. Repeat for the desired number of repetitions then change legs.

Teaching Tips

Be aware of degree of knee flexion, always maintaining a pain-free range of motion.

Maintain external rotation of the hip and ensure the knee tracks over the feet throughout the movement.

Focus on the ball of the foot remaining in contact with the squat stand.

Relax the head, neck and shoulders.

Maintain the spine in a neutral or pain-free position throughout the exercise.

By externally rotating the hip, focus is placed on the vastus medialis.

Safety Aspects

Do not lock knees at the top of the movement.

REPETITIONS: 12-15 times; Sets: 2-4; Variations: None

7 Bilateral Plyometric Squat

Joint Complex: Knee; Stage: Dynamic; Pulley Pin Placement: N/A; Incline Guideline: 3-6; Starting Position: Upright Supine—Push the glideboard 330 halfway up the rails. Straddle the glideboard 330 and sit at the bottom edge, facing away from the tower. Lie back, ensuring head is fully supported. Place feet on the squat stand, in direct alignment with the hip joints. Legs are extended but knees not locked.

Exercise Description

Lower the glideboard 330 by flexing the knees. Push off forcefully against the squat stand, causing the glideboard 330 to move up the rails and the feet to clear the squat stand. Land softly with knees slightly flexed and explode back up the rails.

Teaching Tips

Be aware of degree of knee flexion, always maintaining a pain-free range of motion.

Ensure the knees track over the feet throughout the movement.

Maintain the lumbar spine in neutral and in contact with the glideboard 330 throughout the movement.

Relax the head, neck and shoulders.

Use caution during this exercise: progress from a lesser to greater degree of clearance.

Safety Aspects

Do not allow the glideboard 330 to hit the tower at the top of the movement. Push only hard enough for the feet to leave the squat stand.

Rest hands on the sides of the glideboard 330 or cross arms over torso. Do not reach underneath the glideboard 330.

For self-assessment and security purposes have client watch alignment and foot placement on the squat stand.

If lumbar spine is unable to maintain contact with the glideboard 330 then perform the unilateral plyometric.

REPETITIONS: 12-15 times; Sets: 2-4; Variations: None

8 Unilateral Plyometric Squat

Joint Complex: Knee; Stage: Dynamic; Pulley Pin Placement: N/A; Incline Guideline: 3-6; Starting Position: Upright Supine—Push the glideboard 330 halfway up the rails. Straddle the glideboard 330 and sit at the bottom edge, facing away from the tower. Lie back, ensuring head is fully supported. Place one foot toward the center of the squat stand. Leg is extended but knee not locked.

Exercise Description

Lower the glideboard 330 by flexing the active knee. Push off forcefully against the squat stand, causing the glideboard 330 to move up the rails and the foot to clear the squat stand. Land softly with knee slightly flexed and explode back up the rails. Repeat for the desired number of repetitions then change legs. During the entire exercise the lumbar spine should not lose contact with glideboard 330.

Teaching Tips

Be aware of degree of knee flexion, always maintaining a pain-free range of motion.

Ensure the knee tracks over the foot throughout the movement.

Relax the head, neck and shoulders.

Use caution during this exercise: progress from a lesser to greater degree of clearance.

Safety Aspects

Do not allow the glideboard 330 to hit the tower at the top of the movement. Push only hard enough for the foot to leave the squat stand.

For self-assessment and security purposes have client watch alignment and foot placement on the squat stand.

REPETITIONS: 12-15 times; Sets: 2-4; Variations: If the client is unable to maintain contact between lumbar spice and glideboard 330, pull inactive knee toward chest to stabilize lumbar spine in flexion.

9 Bilateral Plyometric Skiing

Joint Complex: Knee; Stage: Dynamic; Pulley Pin Placement: N/A; Incline Guideline: 3-6; Starting Position: Upright Supine—Push the glideboard 330 halfway up the rails. Straddle the glideboard 330 and sit at the bottom edge, facing away from the tower. Lie back, ensuring head is fully supported. Place feet on the squat stand, with knees and feet together. Legs are extended but knees are not locked.

Exercise Description

Lower the glideboard 330 by flexing the knees. Push off forcefully against the squat stand, causing the glideboard 330 to move up the rails and the feet to clear the squat stand. Rotate the hips to 45° and land softly with knees slightly flexed. Explode back up the rails, rotate the hips 45° to the other side and land softly with knees slightly flexed. Repeat the sequence of alternating sides, as in a skiing motion, for the desired number of repetitions. Do not allow the lumbar spine to move into lordosis when the legs are in the air.

Teaching Tips

Maintain scapula in contact with glideboard 330 throughout the exercise.

Be aware of degree of knee flexion, always maintaining a pain-free range of motion.

Ensure alignment of the hips, knees and feet throughout the movement.

Maintain the lumbar spine in neutral throughout the movement.

Relax the head, neck and shoulders.

Use caution during this exercise: progress from a lesser to greater degree of clearance.

Focus must be on hip rotation and not rotation of lower leg.

Safety Aspects

Do not allow the glideboard 330 to hit the tower at the top of the movement. Push only hard enough for the feet to leave the squat stand.

Rest hands on the sides of the glideboard 330 or cross arms over torso. Do not reach underneath the glideboard 330.

For self-assessment and security purposes have client watch alignment and foot placement on the squat stand.

REPETITIONS: 12-15 times; Sets: 2-4

10 Unilateral Plyometric Skiing

Joint Complex: Knee; Stage: Dynamic; Pulley Pin Placement: N/A; Incline Guideline: 3-6; Starting Position: Upright Supine—Push the glideboard 330 halfway up the rails. Straddle the glideboard 330 and sit at the bottom edge, facing away from the tower. Lie back, ensuring head is fully supported. Place one foot toward the center of the squat stand. Leg is extended but knee is not locked.

Exercise Description

Lower the glideboard 330 by flexing the active knee. Push off forcefully against the squat stand, causing the glideboard 330 to move up the rails and the foot to clear the squat stand. Internally rotate the hip to 45° and land softly with knee slightly flexed. Explode back up the rails, externally rotate the hip to 45° and land softly with knee slightly flexed. Repeat the sequence of alternating internal and external rotation for the desired number of repetitions then change legs. Do not allow the lumbar spine to move into lordosis when the legs are in the air.

Teaching Tips

Maintain scapula in contact with glideboard 330 throughout the exercise.

Be aware of degree of knee flexion, always maintaining a pain-free range of motion.

Ensure alignment between the hip, knee and foot throughout the movement.

Keep inactive knee held towards chest to stabilize the hip and allow the lumbar spine to maintain flexion.

Relax the head, neck and shoulders.

Use caution during this exercise: progress from a lesser to greater degree of clearance.

Focus must be on hip rotation and not rotation of lower leg.

Safety Aspects

Do not allow the glideboard 330 to hit the tower at the top of the movement. Push only hard enough for the foot to leave the squat stand.

For self-assessment and security purposes have client watch alignment and foot placement on the squat stand.

REPETITIONS: 12-15 times; Sets: 2-4

11 Side-Lying Single Leg Squat

Joint Complex: Knee; Stage: Dynamic; Pulley Pin Placement: N/A; Incline Guideline: 3-6; Starting Position: Side-lying—Push the glideboard 330 halfway up the rails and lie sideways with buttocks toward the bottom edge. Place the foot of the top leg on the squat stand, in alignment with the torso, with leg extended. Bend bottom leg to 90° and allow it to rest on the glideboard 330, under the extended leg. The head is supported and secured by the bottom arm.

Exercise Description

Lower the glideboard 330 by flexing the knee of the extended leg. Return to starting position with control. Repeat for the desired number of repetitions then change sides.

Teaching Tips

- Be aware of degree of knee flexion, always maintaining a pain-free range of motion.
- Ensure alignment of the hips, knees and feet throughout the movement.
- Relax the head, neck and shoulders.
- Move active foot forward or backwards depending on comfort level.
- Allow the heel to move off the squat stand during knee flexion.
- If pain exists during movement, move toe forward with the heel maintaining contact with the telescoping squat stand.

Safety Aspects

Stabilize trunk throughout the movement.

REPETITIONS: 12-15 times; Sets: 2-4; Variations: None

12 Quadraped

Joint Complex: Knee; Stage: Dynamic; Pulley Pin Placement: N/A; Incline Guideline: 2-6; Starting Position: Quadraped—From a straddle position facing the tower, rest the elbows and forearms toward the top edge of the glideboard 330. Place one knee on the glideboard 330 directly beneath the hip. Place the other foot toward the top of the squat stand and extend the leg, pushing the glideboard 330 halfway up the rails.

Exercise Description

While maintaining the spine in a neutral or pain-free position, lower the glideboard 330 by flexing the knee of the extended leg. Return to starting position with control. Repeat for desired number of repetitions then change legs.

Teaching Tips

- Avoid rotation of the lumbar spine.
- Keep elbows directly below the shoulders.
- Avoid any movement of the inactive hip and knee.
- Maintain the spine in a neutral or pain-free position.

Safety Aspects

- Be aware of placement of foot on squat stand to ensure correct alignment.

REPETITIONS: 12-15 times; Sets: 2-4; Variations: None

13 Triped

Joint Complex: Knee; Stage: Dynamic; Pulley Pin Placement: N/A; Incline Guideline: 2-6; Starting Position: Quadraped—From a straddle position facing the tower, rest the elbows and forearms toward the top edge of the glideboard 330. Place one knee on the glideboard 330 directly beneath the hip. Place the other foot toward the top of the squat stand and extend the leg, pushing the glideboard 330 halfway up the rails.

Exercise Description

While maintaining the spine in a neutral or pain-free position, lift the inactive knee off the glideboard 330 and hold. Lower the glideboard 330 by flexing the knee of the extended leg. Return to starting position with control. Repeat for desired number of repetitions then change legs.

Teaching Tips

- Avoid rotation of the lumbar spine.
- Keep elbows directly below the shoulders.
- Avoid any movement of inactive hip and knee.
- Maintain the spine in a neutral or pain-free position.

Safety Aspects

- This exercise is very difficult. Be aware of intensity placed on shoulders and active knee.
- Be aware of placement of foot on squat stand to ensure correct alignment.

REPETITIONS: 12-15 times; Sets: 2-4; Variations: None

14 Seated Hamstring Curl

Joint Complex: Knee; Stage: Dynamic; Pulley Pin Placement: N/A; Incline Guideline: 1-4; Starting Position: Seated Backwards—Straddle the rails and sit at the top edge of the glideboard 330, facing the tower. Once body weight is fully supported by the glideboard 330, secure feet into the Folding Foot Holder and extend legs, keeping knees slightly flexed.

Exercise Description

While maintaining the spine in a neutral or pain-free position, use the heels to pull the glideboard 330 up the rails, allowing the knees to flex through a pain-free range of motion. Return to starting position with control.

Teaching Tips

- Ensure that the middle of patellae align with middle of the feet throughout the motion.
- Be aware of knee flexion: maintain alignment and flex through pain-free range of motion.
- Focus on neutral or pain-free spine position throughout the exercise.

Safety Aspects

- Maintain control of glideboard 330 during entry and exit of the Folding Foot Holder.
- Lower and raise upper body with control when getting into and out of position.

REPETITIONS: 12-15 times; Sets: 2-4; Variations: A: On Elbows, B: Inverted Supine 15 Reverse Lunge Joint Complex: Knee; Stage: Dynamic; Pulley Pin Placement: N/A; Incline Guideline: 1-2; Starting Position: With the telescoping squat stand removed, stand at the bottom end of the exercise device 100, facing away from the tower. Place the ball of one foot on the bottom edge of the glideboard 330 with the heel of the active leg near the base, toes pointed forward.

Exercise Description

Perform a single leg, reverse lunge with the active leg, allowing the glideboard 330 to move up the rails. Return to the starting position with control. Repeat for the desired number of repetitions then change legs.

Teaching Tips

- Avoid rotation of the pelvis.
- Maintain spine in a neutral or pain-free position.
- Be aware of degree of knee flexion, always maintaining a pain-free range of motion.
- Ensure alignment of the hip, knee and foot throughout the movement.
- If necessary, have client use extended arms for balance assistance.
- Adjust foot position on glideboard 330 if topping out.

Safety Aspects

- Avoid extension of the lumbar spine during the exercise.
- Be aware of degree of knee flexion throughout exercise.

REPETITIONS: 12-15 times; Sets: 2-4; Variations: None

16 Lateral Lunge

Joint Complex: Knee; Stage: Dynamic; Pulley Pin Placement: N/A; Incline Guideline: 1-2; Starting Position: With the folding squat stand removed, stand at the bottom end of the exercise device 100, facing sideways. Place the foot that is closest to the base on the bottom edge of the glideboard 330. Externally rotate the opposite leg to 45° from the base.

Exercise Description

Perform a single leg, lateral lunge with the active leg, allowing the other leg to move with the glideboard 330 up the rails. Return to starting position with control. Repeat for the desired number of repetitions then change legs.

Teaching Tips

Avoid rotation of the pelvis.

Maintain spine in a neutral or pain-free position.

Be aware of degree of knee flexion, always maintaining a pain-free range of motion.

Ensure alignment of the hip, knee and foot throughout the movement.

If necessary, have client use extended arms for balance assistance.

Adjust foot position on glideboard 330 if topping out.

Safety Aspects

Be aware of degree of knee flexion in the stabilizing leg.

REPETITIONS: 12-15 times; Sets: 2-4; Variations: None

Knee

Conditioning Exercises

1 Pull Up

Joint Complex: Knee; Stage: Conditioning; Pulley Pin Placement: N/A; Incline Guideline: 3-6; Starting Position: With the LAT bars in the pull up position, push the glideboard 330 halfway up the rails. Lie prone with chest near the top edge of the glideboard 330, with neutral spinal curvature. Grasp the LAT bars, palms facing down and arms extended. Bend the knees to ensure feet do not hit the squat stand.

Exercise Description

While maintaining the spine in a neutral or pain-free position, pull the glideboard 330 up the rails until hands are level with shoulders. Allow shoulders to move through full range of motion with scapular movement, from elevation through to depression. Lower the glideboard 330 back down the rails until arms are fully extended.

Teaching Tips

Initiate pull up with scapula depression, followed by arm movement.

Ensure sternum maintains contact with the glideboard 330.

Maintain neutral or pain-free spinal curvature throughout the exercise.

Cue client to keep the shoulders away from the ears.

Avoid hyperextension of the lumbar spine.

Safety Aspects

Avoid hyperextension of the cervical spine.

REPETITIONS: 12-15 times; Sets: 2-4; Variations: None

2 Row with Trunk Flexion and Extension

Joint Complex: Knee; Stage: Conditioning; Pulley Pin Placement: 2; Incline Guideline: 2-4; Starting Position: Grasp the handles 980 and pull the glideboard 330 halfway up the rails. Straddle the glideboard 330 facing the tower and sit at the bottom edge of the glideboard 330. Place feet on the glideboard 330 with knees flexed. Hold the handles 980 with arms extended toward the pulleys and palms facing in. Lean forward and rest abdominals and chest against the thighs.

Exercise Description

Move the glideboard 330 up the rails by flexing and leading with the elbows, pulling the handles 980 toward the chest. While maintaining the abdominals in contact with the thighs (lumbar extension), move into extension of the thoracic spine. Allow chest to lose contact with the thighs. Return to starting position with control.

Teaching Tips

Avoid any movement of the hips. Maintain a flexed position throughout the exercise.

Flex forward as far as possible in the start position.

Maintain contact between lower abdominals and thighs throughout the exercise.

Safety Aspects

Maintain control of glideboard 330 throughout the exercise especially during arm extension.

REPETITIONS: 12-15 times; Sets: 2-4;

3 Chest Press

Joint Complex: Knee; Stage: Conditioning; Pulley Pin Placement: 2 or 3; Incline Guideline: 3-6; Starting Position: Forward Seated—Grasp handles 980 and pull the glideboard 330 halfway up the rails. Straddle the rails and sit toward the top edge of the glideboard 330, facing away from the tower. Place legs in a comfortable position. Bring hands to the side of the torso, at chest level. Cables 970 should be inside forearm.

Exercise Description

Slide the glideboard 330 up the rails by pressing the handles 980 straight out to chest level until arms are fully extended. Return to starting position with control.

Teaching Tips

Bring the handles 980 together at the top of the movement to maximize contraction of the pectoral muscles.

Maintain the spine in an upright, neutral or pain-free position.

Safety Aspects

Avoid flexion or extension of the torso.

Avoid hyperextension during horizontal abduction of the shoulder.

Avoid excessive shoulder protraction and retraction during the movement.

REPETITIONS: 12-15 times; Sets: 2-4; Variations: None

4 Pullover Crunch

Joint Complex: Knee; Stage: Conditioning; Pulley Pin Placement: 2; Incline Guideline: 2-4; Starting Position: Grasp handles 980 and pull the glideboard 330 halfway up the rails. Straddle the glideboard 330 and sit at the bottom edge. Lie back, ensuring the head is fully supported. Bend knees and rest the feet on the bottom edge of the glideboard 330. Arms are extended overhead toward the tower, with palms facing up.

Exercise Description

In an arc motion, bring the handles 980 over the chest toward the outer thighs. Simultaneously raise the head and shoulders off the glideboard 330 by contracting the abdominal muscles. Return to the starting position with control.

Teaching Tips

Minimize cervical flexion by looking to the ceiling and keeping chin tucked in during the entire exercise.

Keep palms facing forward throughout the exercise.

Maintain neutral wrists.

Keep elbows slightly bent throughout the exercise.

Safety Aspects

REPETITIONS: 12-15 times; Sets: 2-4; Variations: None

5 Triceps Press

Joint Complex: Knee; Stage: Conditioning; Pulley Pin Placement: 2; Incline Guideline: 2-4; Starting Position: Upright Supine—Grasp handles 980 and pull the glideboard 330 halfway up the rails. Straddle the glideboard 330 and sit at the bottom edge facing away from the tower. Lie back, ensuring head is fully supported. Place both feet on the bottom edge of the glideboard 330. Position the upper arms in tight by the torso, palms facing up with elbows flexed.

Exercise Description

Keeping elbows stationary, press down on the handles 980 until arms are fully extended next to the thighs. Return to the starting position with control.

Teaching Tips

Maintain the upper arms stationary and close to the torso throughout the exercise.

Maintain neutral wrists.

Maintain the spine in a neutral or pain-free position.

Safety Aspects

Avoid movement at the shoulder throughout the exercise.

Do not lock the elbows at the bottom of the press.

Do not raise head during movement.

REPETITIONS: 12-15 times; Sets: 2-4; Variations: None

6 Biceps Curl

Joint Complex: Knee; Stage: Conditioning; Pulley Pin Placement: 1; Incline Guideline: 3-6; Starting Position: Backwards Seated—Grasp handles 980 and pull the glideboard 330 halfway up the rails. Straddle the rails and sit toward the top edge of the glideboard 330, facing the tower. Position the upper arms in tight by the torso, palms facing up. Extend arms directly toward the pulleys with minimal shoulder flexion. Lift feet off the floor.

Exercise Description

Pull the glideboard 330 up the rails by curling the handles 980 up toward the shoulders, keeping elbows stationary. Return to the starting position with control.

Teaching Tips

Maintain upright, neutral or pain-free posture.

Maintain neutral wrists.

Safety Aspects

Avoid torso movement in the sagittal plane.

Avoid excessive shoulder protraction and depression during the exercise.

REPETITIONS: 12-15 times; Sets: 2-4; Variations: None

It will be apparent to those skilled in the art that various modifications and variations can be made in the exercise devices described above, features of the exercise devices, the methods of using the exercise devices, the methods of instruction using the exercise devices, and other methods described herein without departing from the spirit or scope of the invention. In the claims that follow, elements are generally described in a singular sense; however, the claimed element includes the element in the singular or more than one of the claimed element. Thus, it is intended that the present invention cover modifications and variations of this invention provided they come within the scope of the appended claims and their equivalents.

FIG. 23 is an exemplary strength chart with guidelines for selecting various parameters according to the skill level of the user for the gradual improvement of strength using the exercise device described above. FIG. 24 is an exemplary hypertrophy chart with guidelines for selecting various parameters according to the skill level of the user for the gradual improvement of hypertrophy using the exercise device described above. FIG. 25 is an exemplary power chart with guidelines for selecting various parameters according to the skill level of the user for the gradual improvement of power using the exercise device described above. FIG. 26 is an exemplary endurance chart with guidelines for selecting various parameters according to the skill level of the user for the gradual improvement of endurance using the exercise device described above. A user selects one of the charts of FIGS. 23 to 26 and selects the skill level of beginner, intermediate, and advanced from the chart, then selects the appropriate selection parameter, order parameter, loading parameter, volume parameter, rest interval parameter, velocity parameter, and frequency parameter from the selected chart. The user then adjusts the inclination of the adjustable incline based on the selected loading parameter or exercise load, as described above in connection with FIG. 22, and mounts the user support platform and engages the exercise device for performance of exercise training according to the selected skill level, selection parameter, order parameter, loading parameter, volume parameter, rest interval parameter, velocity parameter, and frequency parameter.

What is claimed is:

1. A method of using an adjustably inclinable exercise device including a vertical support member, an adjustable incline having a first end and a second end and adjustably supported by the vertical support member for adjusting the incline of the adjustable incline, and a user support platform for engagement by a user movably attached to the adjustable incline and configured for movement along the incline, comprising:

a user of the exercise device first selecting a table from one of the following four tables;

| | BEGINNER | INTERMEDIATE | ADVANCED |
|---|---|---|---|
| Selection | Single Joint & Multiple Joint | Single Joint & Multiple Joint Emphasis on MJ | Single Joint & Multiple Joint |
| Order | Large to Small Muscle Groups | Multiple Joint to Single Joint | High Intensity to Low Intensity |
| Loading | 60%-70% of 1 Rep Max. | 70-80% of 1 Rep Max. | 70%-100% of 1 Rep Max. 70-85% Periodized |
| Volume | 1-3 Sets, 8-12 Reps | Multiple Sets 6-12 Reps | Multiple Sets, 1-12 Reps with Emphasis on 6-12 Reps Periodized |
| Rest Interval | 2-3 Mins. for Core 1-2 Mins. for Others | 2-3 Mins. for Core 1-2 Mins. for Others | 2-3 Mins. for Core 1-2 Mins. for Others |
| Velocity | Slow to Moderate | Moderate | Intentionally Slow to Fast |
| Frequency | 2-3x/Week | 2-4x/Week | 4-6x/Week |

| | BEGINNER | INTERMEDIATE | ADVANCED |
|---|---|---|---|
| Selection | Single Joint & Multiple Joint | Single Joint & Multiple Joint Emphasis on MJ | Single Joint & Multiple Joint |
| Order | Large to Small Muscle Groups | Multiple Joint to Single Joint | High Intensity to Low Intensity |
| Loading | 60%-70% of 1 Rep Max. | 70-80% of 1 Rep Max. | 70%-100% of 1 Rep Max. 70-85% Periodized |
| Volume | 1-3 Sets, 8-12 Reps | Multiple Sets 6-12 Reps | Multiple Sets, 1-12 Reps with Emphasis on 6-12 Reps Periodized |
| Rest Interval | 1-2 Mins. | 1-2 Mins. | 2-3 Mins. for Heavy Sets, 1-2 Mins. for Light to Moderate |
| Velocity | Slow to Moderate | Slow to Moderate | Slow, Moderate, Fast |
| Frequency | 2-3x/Week | 2-4x/Week | 4-6x/Week |

| | BEGINNER | INTERMEDIATE | ADVANCED |
|---|---|---|---|
| Selection | Primarily Multiple Joint | Primarily Multiple Joint | Primarily Multiple Joint |
| Order | Large to Small Muscle Groups | Most Complex to Least Complex | High Intensity to Low Intensity |
| Loading | >80% 1 RM-Strength 30-60% 1 RM Endurance | >80% 1 RM-Strength 30-60% 1 RM Endurance | >80% 1 RM-Strength 30-60% 1 RM Endurance |
| Volume | Train for Strength | 1-3 Sets, 3-6 Reps | 1-3 Sets, 3-6 Reps |
| Rest Interval | 2-3 Mins. for Core | 2-3 Mins. for Core 1-2 Mins. for Others | 2-3 Mins. for Core 1-2 Mins. for Others |
| Velocity | Moderate | Fast | Fast |
| Frequency | 2-3x/Week | 2-4x/Week | 4-6x/Week |

| | BEGINNER | INTERMEDIATE | ADVANCED |
|---|---|---|---|
| Selection | Single Joint & Multiple Joint | Single Joint & Multiple Joint | Single Joint & Multiple Joint |
| Order | Variety in Sequencing | Variety in Sequencing | Variety in Sequencing |
| Loading | 50%-70% of 1 Rep Max. | 50%-70% of 1 Rep Max. | 30%-80% of 1 Rep Max. |
| Volume | 1-3 Sets, 10-15 Reps | Multiple Sets 10-15 Reps or More | Multiple Sets 10-25 Reps or More |
| Rest Interval | 1-2 Mins. for High Rep Sets | 1-2 Mins. for High Rep Sets | <1 Min. for 10-15 Reps |
| Velocity | Slow to Moderate Repetitions | Moderate to High Repetitions | Moderate to High Repetitions |
| Frequency | 2-3x/Week | 2-4x/Week | 4-6x/Week |

the user then selecting a skill level of beginner, intermediate, and advanced from the selected table and selecting the following parameters for the selected skill level from the selected table in any sequence;

selecting a Selection parameter from said selected table;

selecting an Order parameter from said selected table;

selecting a Loading parameter from said selected table;

selecting a Volume parameter from said selected table;

selecting a Rest Interval parameter from said selected table;

selecting a Velocity parameter from said selected table;

selecting a Frequency parameter from said selected table;

the user subsequently positioning the adjustable incline at a selected inclination based on the selected Loading parameter to adjust the exercise load required to move the user support platform along the incline; and the user mounting the user support platform and engaging the exercise device for performance of exercise training moving the user support platform along the adjustable incline according to the selected skill level, Selection parameter, Order parameter, Loading parameter, Volume parameter, Rest Interval parameter, Velocity parameter, and Frequency Parameter.

2. The method of claim 1, wherein the exercise device includes first and second pulleys coupled to the adjustable incline; and one or more cables extendable through first and second pulleys and coupled to the user support platform, the user moving the support platform along the adjustable incline through cable movement.

3. The method of claim 2, wherein the exercise device further includes first and second combination pulley-support and pull-up bars each pivotally connected to the first end of the adjustable incline for movement between at least a substantially vertical position and a substantially non-vertical position, and first and second pulleys movably connected to the first and second combination pulley-support and pull-up bars for movement of the pulleys to a desired location, and the method further includes the user moving the first and second combination pulley-support and pull-up bars to a desired position; moving the first and second pulleys connected to the first and second combination pulley-support and pull-up bars to a desired location; and moving the support platform along the adjustable incline through cable movement through the first and second pulleys on the combination pulley-support and pull-up bars.

4. The method of claim 3, wherein the first and second combination pulley-support and pull-up bars each have a trapezoidal configuration.

5. The method of claim 3, wherein the first and second pulleys each include a collar slidably attached to the combination pulley-support and pull-up bar and a pull pin carried by the collar for locking the pulley in position on the combination pulley-support and pull-up bar.

6. The method of claim 2, further comprising a folding squat platform pivotally and removably connected to the second end of the adjustable incline, and engaging the exercise device further includes the user engaging the folding squat platform for exercise training.

7. The method of claim 6, further including a squat stand telescopingly and removably engaged with the folding squat platform.

8. The method of claim 2, further comprising a push-up bar removably connected to the second end of the adjustable incline, and engaging the exercise device further includes the user engaging the push-up bar for exercise training.

9. The method of claim 2, further comprising a padded foot support removably connected to the second end of the adjustable incline, and engaging the exercise device further includes the user engaging the padded foot support for exercise training.

10. The method of claim 2, further comprising a dip bar assembly connected to the adjustable incline, and the dip bar assembly including a pair of dip bars movable between at least a retracted, out-of-the way position, and a non-retracted, ready-for-use position, and engaging the exercise device further includes the user engaging the dip bar assembly for exercise training.

11. The method of claim 2, further comprising a foot support assembly pivotally connected to the adjustable incline, and the foot support assembly pivotable between at least a retracted, out-of-the way position, and a non-retracted, ready-for-use position, and engaging the exercise device further includes the user engaging the foot support assembly for exercise training.

12. The method of claim 1, wherein the exercise device is used for personal Training.

13. The method of claim 1, wherein the exercise device is used for group Training.

14. The method of claim 1, wherein the exercise device is used for Pilates training.

15. The method of claim 1, wherein the exercise device is used for rehabilitation.

* * * * *